United States Patent [19]

Langenbeck et al.

[11] Patent Number: 5,009,053

[45] Date of Patent: Apr. 23, 1991

[54] STORAGE AND TRANSPORT TRAY AND TRAY PACKING SYSTEM

[75] Inventors: Keith A. Langenbeck, 4005 University Blvd., Dallas, Tex. 75205; Jesse P. Kensinger, Richardson, Tex.

[73] Assignee: Keith A. Langenbeck, Dallas, Tex.

[21] Appl. No.: 435,540

[22] PCT Filed: Jan. 29, 1988

[86] PCT No.: PCT/US88/00290

§ 371 Date: Sep. 26, 1989

§ 102(e) Date: Sep. 26, 1989

[87] PCT Pub. No.: WO88/07478

PCT Pub. Date: Oct. 6, 1988

[51] Int. Cl.[5] ..... B65D 6/34; B65D 8/06; B65B 5/10; B65B 39/00

[52] U.S. Cl. ..... 53/58; 53/251; 53/260; 53/534; 220/512; 220/608; 220/671; 220/DIG. 15; 206/509; 206/203; 206/427; 206/557

[58] Field of Search ..... 206/139, 203, 427, 557, 206/566; 220/21, 74, 72, DIG. 14, DIG. 15; 53/534, 251, 250, 58, 448, 260

[56] References Cited

U.S. PATENT DOCUMENTS

| | | | |
|---|---|---|---|
| D. 98,200 | 1/1936 | Worthington | 220/21 X |
| D. 150,031 | 6/1948 | Richards | 220/21 X |
| 2,181,150 | 11/1939 | Pittenger | 220/265 |
| 2,758,742 | 8/1956 | Farrell | 220/21 |
| 2,918,379 | 12/1959 | Lurie | 426/129 |
| 3,130,860 | 4/1964 | Oberkircher | 206/509 |
| 3,354,613 | 11/1967 | Anderson et al. | 53/534 X |
| 3,377,774 | 4/1968 | Nigrelli et al. | 53/534 X |
| 3,599,397 | 8/1971 | Standley et al. | 53/534 X |
| 4,195,746 | 4/1980 | Cottrell | 220/72 X |
| 4,518,160 | 5/1985 | Lambrechts et al. | 53/260 X |
| 4,727,708 | 3/1988 | Conforto et al. | 53/534 |

*Primary Examiner*—James F. Coan
*Attorney, Agent, or Firm*—W. Kirk McCord

[57] ABSTRACT

Individual beverage containers 16 are transported by conveyor track 14A to conveyor track 14B, along which they are advanced by parallel chains 34 and 36 carrying flight bars 44. Trays 26 to receive containers 16 are advanced by an inclined conveyor track 24B having projections 30 to engage the trays. A plurality of support members 130 are disposed at the downstream end of track 14B to introduce the containers into the trays. Special trays are used having a plurality of structural members on their inner wall surfaces to define recessed regions between the structural members into which the curved surfaces of the containers fit so that they are held upright.

57 Claims, 45 Drawing Sheets

STORAGE AND TRANSPORT TRAY AND TRAY PACKING SYSTEM

DESCRIPTION

1. Technical Field

The present invention relates generally to storage and transport trays and to a system for packing containers into the trays.

2. Background Art

Beverages, such as soft drinks and beer, are distributed commercially in glass and plastic bottles and in aluminum cans. Single service beverage containers, which typically contain six to twenty-four ounces of the beverage, are grouped into individual cases, each of which contains twenty-four individual containers. These cases may be further subdivided into groups of six, eight or twelve individual beverage container packages. Typically, each case of individual containers or multiple container packages is loaded by an automated tray packing system into a separate tray for transport from the site of a bottling company to the point of sale, such as at a grocery store.

According to prior practice, trays used for transporting beverage containers are made of corrugated paper or wood. Corrugated paper trays are typically rectangular in shape, with upright walls around the perimeter of the tray. Thus, the beverage containers must be loaded vertically into the tray, which is a relatively slow and complex process. Alternatively, if the containers are loaded into the corrugated paper tray when the tray is disposed at an angle relative to the incoming containers, the volume of the tray must be substantially greater than the volume occupied by the containers when the containers are loaded into the tray, thereby resulting in excessive free play or "slop" among the containers in the tray after loading.

Another problem associated with corrugated paper trays is their lack of durability. Such trays are usually discarded after one trip from the bottling company to the point of sale. Because these trays are "non-returnable", the cost of the bottling operation is increased by approximately $0.07 per tray, which can be substantial for a large bottling company shipping millions of beverage cases per year.

Wood trays are typically of older design and are more suitable for transporting bottles than cans. Such wood trays may have individual rectangular compartments within the tray for receiving an individual bottle. Because of the thickness of the wooden partitions between compartments, such wooden trays are typically used only to transport individual bottles and not beverage containers which have been pre-packaged or prewrapped into groups of six, eight or twelve individual containers. Because the spacing between individual containers is different when wooden transport trays are used instead of corrugated paper trays, the automatic tray packing system must be adjusted for a different setting, which complicates and slows down the packing process. Although wood transport trays are returnable, they have vertically upright walls, which prevent them from being "nested" together to save storage space.

Automated systems for loading individual beverage containers into respective trays for transportation are known in the art. According to prior practice, such automated systems typically fall into one of the following three categories: (1) tray former loader systems; (2) vertical drop/set packer systems; and (3) ski packer systems. All such systems rely on synchronization between the movement of the individual cans or bottles on a first conveyor track with the movement of the individual trays into which the cans or bottles are to be packed on a second conveyor track.

In tray former loader systems a corrugated paper tray is typically pushed onto the track carrying the beverage containers at right angles with respect to the direction of movement thereof. The leading edge of the tray is folded up to catch the cans on the leading edge and subsequently the side edges and back edge of the tray are folded up to form the container. Tray former loader systems have the advantage of being relatively fast in that they can package approximately 60–80 cases per minute, but have the disadvantage of being relatively complex and costly and the corrugated paper tray is not reusable. The cost of a typical tray former loader system is on the order of $150,000–$250,000.

Vertical drop/set packer systems employ a device for dropping/setting the individual beverage containers vertically downward into a pre-formed transport tray. This type of system has the disadvantage of being relatively slow in that it is only able to process approximately 30–35 cases per minute, but the system can pack individual containers into a wide variety of tray types and designs.

Ski packer systems use a spring-loaded mechanism, which is tripped by the weight of the individual beverage containers. When the mechanism is tripped, 24 individual beverage containers comprising a case are launched down a ramp and into a transport tray. Because of the manner in which the cans are launched into the tray, the vertical depth of the tray must be greater than one-half of the height of the individual beverage containers in order to properly capture the containers within the tray. Ski packer systems can typically process approximately 50–55 cases per minute. Although ski packer systems are useful for loading six-packs into transport trays, they are not well-suited for packing individual beverage containers. Ski packer systems typically use pre-formed, non-reusable corrugated paper trays.

U.S. Pat. No. 4,704,841 discloses a beverage tray packing system in which a packing ramp is pivotably mounted for being selectively raised and lowered to introduce a group of containers into a transport and storage tray. The containers are transported along a first rack and are divided into discrete groups, each of which has a predetermined number of containers, by divider members. The trays are moved along a second track which is inclined relative to the first track. A plurality of sensors, such as photoeyes, are used in conjunction with a computer to control the operation of the system.

DISCLOSURE OF INVENTION

In one aspect of the invention a tray for storing and transporting a plurality of cylindrically-shaped articles is comprised of a bottom member and four walls extending upwardly from the bottom member and interconnected to provide an enclosure for receiving the articles. Each of the four walls has cooperating pairs of structural members extending inwardly therefrom to define respective recessed regions therebetween. Each of the cooperating pairs contacts a corresponding one of the articles at respective positions on the curved surfaces thereof so that a predetermined portion of each article is received within the corresponding recessed region and at least a portion of the curved surface of the article is in contact with the corresponding wall within the recessed region, thereby retaining the articles in a substantially upright position within the tray.

In one embodiment each of the four walls is comprised of a plurality of recessed regions separated by corresponding ones of a plurality of inwardly extending surfaces to provide a substantially scalloped appearance. The wall surface within each region is curved to conform to the curved surface of the corresponding article so that substantially the entire curved surface of the portion of the article which is disposed within the corresponding recessed region is in contact with the wall surface within each region. The bottom member has a plurality of receptacles disposed therein for receiving a predetermined lower portion of a corresponding one of the articles when the articles are disposed within the tray in an upright position.

In another embodiment the tray has a substantially rectangular shape and the four walls are comprised of a pair of oppositely positioned first and second side walls extending longitudinally along the tray and a pair of oppositely positioned first and second end walls extending transversely across the tray. Each of the first and second end walls is comprised of a plurality of first recessed regions separated by corresponding ones of a plurality of inwardly extending surfaces to provide a substantially scalloped appearance on the end walls. The first and second side walls have respective first and second sets of rib members extending vertically along at least a portion of the height of the respective side walls and partially inwardly along the bottom member. Selected ones of the first and second sets of rib members are arranged in cooperating pairs to define respective second recessed regions therebetween. The bottom member has a plurality of receptacles disposed thereon for receiving a predetermined lower portion of corresponding ones of the articles when the articles are disposed within the tray in an upright position.

In still another embodiment the structural members are comprised of a first set of rib members extending vertically at least partially along the height of the first side wall, transversely across the bottom member and vertically at least partially along the height of the second side wall, and second and third sets of rib members extending vertically at least partially along the heights of the respective first and second end walls and partially inwardly along the bottom member and terminating at respective intersections on the bottom member with respective ones of the first set of rib members which are closest to the respective first and second end walls. The first, second and third sets of rib members are arranged in respective cooperating pairs at predetermined locations on the tray. Each of the cooperating pairs defines a corresponding one of the recessed regions therebetween. The spacing between the rib members in each cooperating pair is sufficient to allow the curved surface of the corresponding article which is received within the corresponding recessed region to contact the corresponding pair of rib members at respective first and second points of tangency and to contact the corresponding wall of the tray within the corresponding recessed region at a third point of tangency. In an alternate embodiment the first set of rib members extends vertically at least partially along the height of the first end wall, longitudinally along the bottom member and vertically at least partially along the height of the second end wall. The second and third sets of rib members extend vertically at least partially along the heights of the respective first and second side walls and partially inwardly across the bottom member and terminate at respective intersections on the bottom member with respective ones of the first set of rib members which are closest to the respective first and second side walls.

In yet another embodiment the tray includes first and second sets of rib members extending at least partially along the heights of the respective first and second side walls and partially inwardly across the bottom member and third and fourth sets of rib members extending vertically at least partially along the heights of the respective first and second end walls and partially inwardly along the bottom member. The bottom member has a plurality of receptacles disposed thereon for receiving predetermined lower portions of corresponding ones of the articles when the articles are disposed within the tray in a substantially upright position.

In yet another embodiment the structural members of the tray are comprised of a plurality of rib members extending partially along the height of each of the four walls of the tray. Selected ones of the rib members are arranged in respective cooperating pairs to define the recessed regions therebetween. The tray further includes a plurality of posts disposed between each of the cooperating pairs of rib members on each of the four walls. The posts extend upwardly from the bottom member to a predetermined position on the corresponding walls for engaging the bottom member of another tray to prevent the trays from being nested beyond the predetermined position. The rib members preferably have a substantially half-conical shape with the width of each rib member decreasing upwardly along the corresponding wall so that the width of each rib member is greatest adjacent to the bottom member and smallest adjacent to an upper edge of the corresponding wall. In another embodiment the walls are each comprised of a first portion extending from the bottom member to a first selected position on the corresponding wall, a second portion extending from the first selected position to a second selected position on the corresponding wall and a third portion extending from the second selected position to the upper edge of the corresponding wall. The first, second and third portions of each wall are angled at respective predetermined draft angles to facilitate separation of adjacent ones of the trays and to allow a plurality of the trays to be nested together. In still another embodiment the bottom member is comprised of a plurality of elongated support members arranged to define a predetermined grid pattern. Portions of the support members define a substantially circular support base for the substantially circular bottom portion of each of the articles to be stored and transported in the tray.

In another aspect of the invention a system for packing containers into corresponding trays is comprised of first conveyor means for transporting the containers along a first track, means for dividing the containers into selected groups corresponding to the number of containers to be packed into each tray, second conveyor means for transporting the trays along a second track, a portion of which is inclined with respect to the first track, and a support member disposed adjacent to the downstream end of the first track for journally supporting the containers as the containers are being packed into the corresponding tray. The support member is reciprocally moveable along an upstream-downstream axis between a first position at which the support member is substantially fully extended for introducing a corresponding group of containers into the corresponding tray and a second position at which the support member is substantially fully retracted for allowing the trailing edge of the corresponding tray to clear the support member as the tray is moved along the inclined portion of the second track.

In one embodiment the system includes means for selectively moving the support member between the first and second positions. The moving means is comprised of cam means which is moveable along the first track and stationary spring-loaded push rod follower means coupled to the support member for engaging the cam means as the cam means is moved along the first track. The cam means exerts downward pressure on the push rod follower means to move the support member to the second position when the cam means is in engagement with the push rod follower means. The push rod follower means is moved upwardly by springbias when the push rod, follower means is not in engagement with the cam means, to move the support member to the first position.

In another embodiment the means for selectively moving the support member between the first and second positions is comprised of eccentric cam means which is rotatable about a predetermined axis and spring-loaded push rod follower means coupled to the support member for engaging the cam means as the cam means is rotated. The cam means exerts a force on the push rod follower means which is directed upstream relative to the first track to move the support member to the second position when the push rod follower means is in engagement with the eccentric portion of the cam means. The push rod follower means is moved in a downstream direction relative to the first track by spring-bias when the push rod follower means is not in engagement with the eccentric portion of the cam means, to move the support member to the first position.

In yet another aspect of the invention the system includes first and second flap members positioned downstream of the support member and the inclined portion of the second track. The first and second flap members are pivotally attached to a common shaft for being independently moveable between respective third positions at which the flap members are oriented substantially parallel with respect to the inclined portion of the second track and respective fourth positions at which the flap members are oriented substantially parallel with respect to the first track. The flap members are maintained in the respective third positions to maintain each tray at an inclined position while each group of containers is being packed into a corresponding tray and for being disposed in respective fourth positions after each group of containers has been packed into the corresponding tray, to move the packed tray to a substantially horizontal position.

BEST MODE FOR CARRYING OUT THE INVENTION

Figure 1:
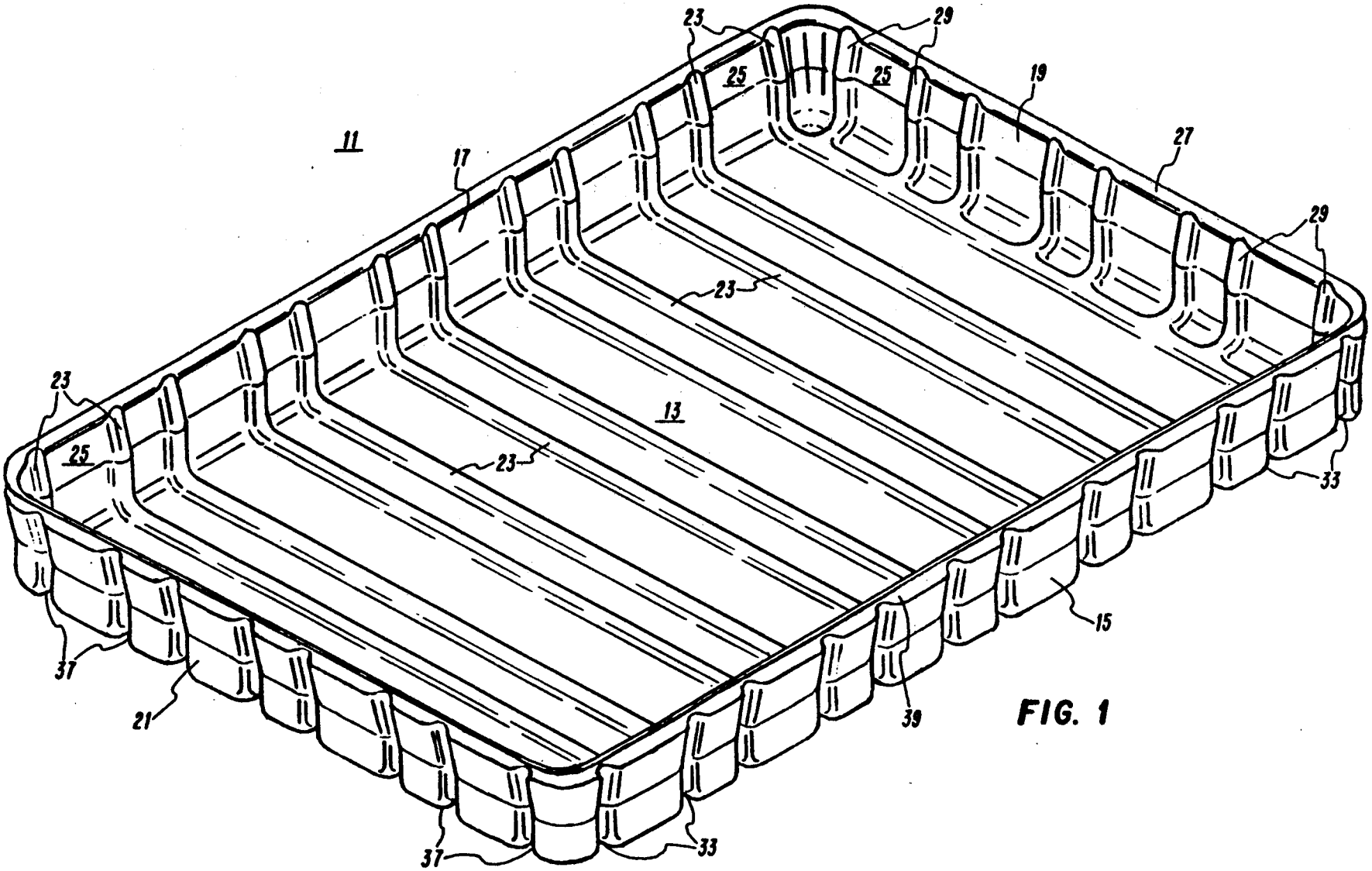
FIG. 1–4 are perspective, side elevation, end elevation and top plan views, respectively, of a first embodiment of a tray for storing and transporting beverage containers and the like, according to the present invention.

In the description which follows, like parts are marked throughout the specification and drawings, respectively. The drawings are not necessarily to scale and in some instances proportions have been exaggerated in order to more clearly depict certain features of the invention.

Referring to FIGS. 1-4, a first embodiment of a storage and transport tray 11 according to the present invention is depicted. Tray 11 is comprised of a bottom member 13, a pair of oppositely positioned side walls 15 and 17 and a pair of oppositely positioned end walls 19 and 21, interconnected to form an enclosure for receiving articles therein. The respective intersections between adjacent ones of the tray walls and between each of the walls and bottom member 13 define respective curved surfaces to provide respective areas of transition therebetween, thereby enhancing the strength and rigidity of tray 11.

Disposed on respective inner surfaces of side walls 15 and 17 and on bottom member 13 are a first set of rib members 23. First rib members 23 are arranged in cooperating pairs to define respective recessed regions 25 therebetween. The spacings between adjacent ones of rib members 23 are dependent upon the thickness of rib members 23 (measured perpendicularly inward from the respective side walls 15 and 17) and the diameter of the container. The greater the thickness of rib members 23, the greater will be the spacings between adjacent ones of the rib members, so that cylindrically-shaped articles, such as beverage containers, stored in tray 11 are able to contact the respective side walls 15 and 17 within the respective recessed regions 25, as will be described in greater detail with reference to FIGS. 25-28.

First rib members 23 extend substantially along the entire height of side wall 15, transversely across bottom member 13 and substantially along the entire height of opposite side wall 17 and terminate at respective intersections with a perimeter rim member 27, which is disposed adjacent to the upper edge of tray 11. Rim member 27 extends inwardly from each of the walls of tray 11 along the perimeter thereof, to enhance the structural strength and rigidity of the upper edges of tray 11.

Figure 4:
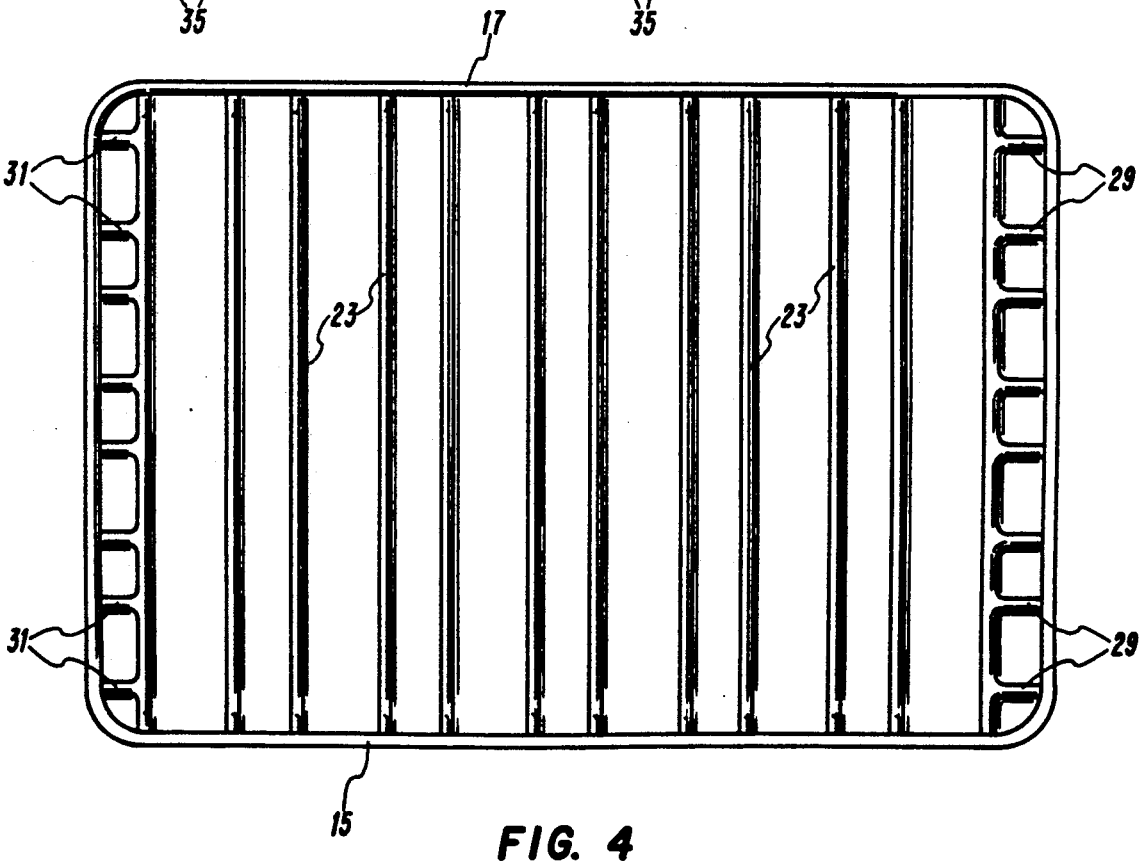

A second set of rib members 29 is disposed on an inner surface of end wall 19 and extends substantially along the entire height of end wall 19 and partially inwardly along bottom member 13 and terminating at the respective intersections on bottom member 13 with the particular one of the first set of rib members 23 which is closest to end wall 19. A third set of rib members 31 is disposed on an inner surface of end wall 21 and extends substantially along the entire height of end wall 21 and partially inwardly along bottom member 13 and terminating at the respective intersections on bottom member 13 with the particular one of the first set of rib members 23 which is closest to end wall 21, as shown in FIG. 4.

Second and third rib members 29 and 31 are also arranged in respective cooperating pairs at predetermined locations on tray 11. Each of the cooperating pairs defines a corresponding one of a plurality of recessed regions 25 therebetween, in much the same manner as first rib members 23. The spacings between adjacent ones of rib member 29 and 31 along the respective end walls 19 and 21 are dependent upon the thickness of the rib members (measured perpendicularly inward from the respective end walls) and the diameter of the container. The greater the thickness of the rib members, the greater will be the spacing between adjacent ones of rib members 29 and 31, so that cylindrically-shaped articles, such as beverage containers, stored in tray 11 are able to contact the respective end walls 19 and 21 within the respective recessed regions 25, as will be described in greater detail with reference to FIGS. 25-28. One skilled in the art will appreciate that second and third rib members 29 and 31 are in effect a mirror image of one another.

Bottom member 13, side walls 15 and 17, end walls 19 and 21, rim member 27 and first, second and third rib members 23, 29 and 31 are preferably formed as an integral unit using a conventional thermoforming process. Tray 11 is preferably comprised of a lightweight, translucent plastic material. Each rib member of tray 11 forms a corresponding groove in the corresponding outer surface of tray 11. First rib members 23 form a corresponding first set of grooves 33 in the respective outer surfaces of side walls 15 and 17 and in bottom member 13. Second and third rib members 29 and 31 form corresponding second and third sets of grooves 35 and 37 in respective outer surfaces of end walls 19 and 21 and in bottom member 13. Rim member 27 forms a corresponding groove 39 in the respective outer surfaces around the perimeter of tray 11.

Figure 2:
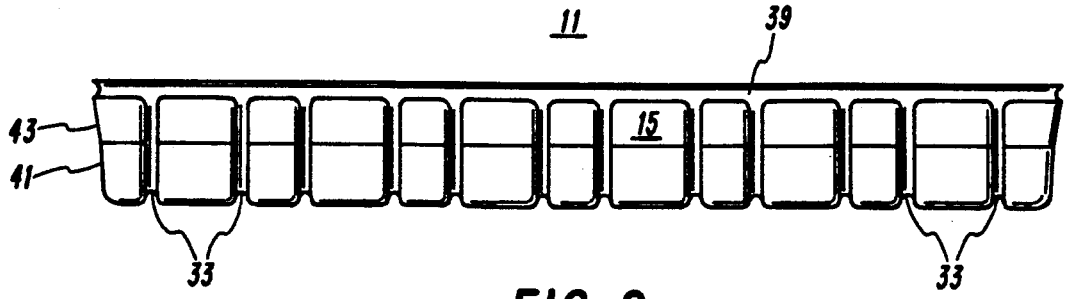
Figure 3:
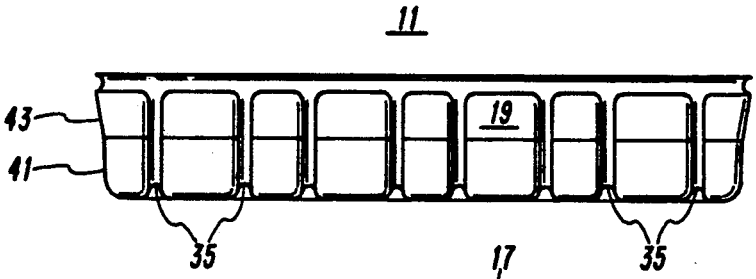

Tray 11 is particularly well-suited for storing and transporting cylindrically-shaped articles, such as beverage container bottles or cans, in a substantially upright position, without excessive free play or "slop" of the beverage containers within tray 11. Side walls 15 and 17 and end walls 19 and 21 are preferably "compound" walls, the respective lower portions 41 of which are oriented substantially vertically and the respective upper portions 43 of which are angled outwardly with respect to lower portions 41 (as best seen in FIGS. 2 and 3), to provide a predetermined draft angle to facilitate loading of beverage containers into tray 11.

Figure 5:
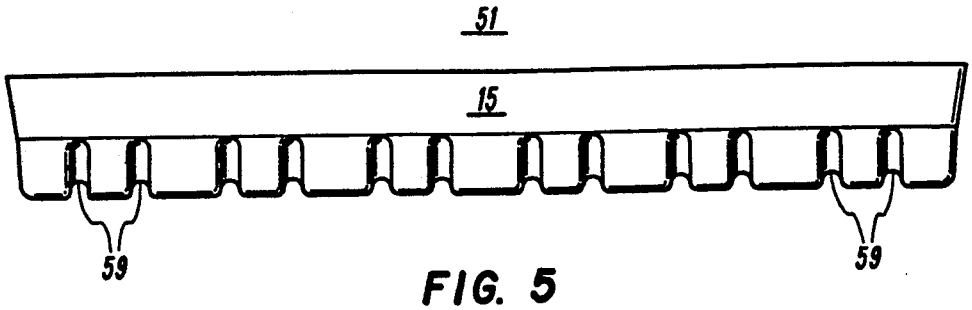
FIGS. 5–7 are side elevation, end elevation and top plan views, respectively, of a second embodiment of the tray, according to the present invention.
Figure 6:
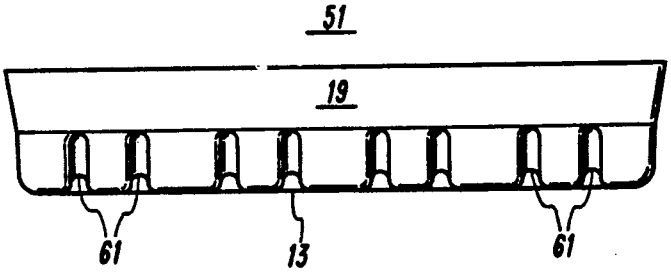
Figure 7:
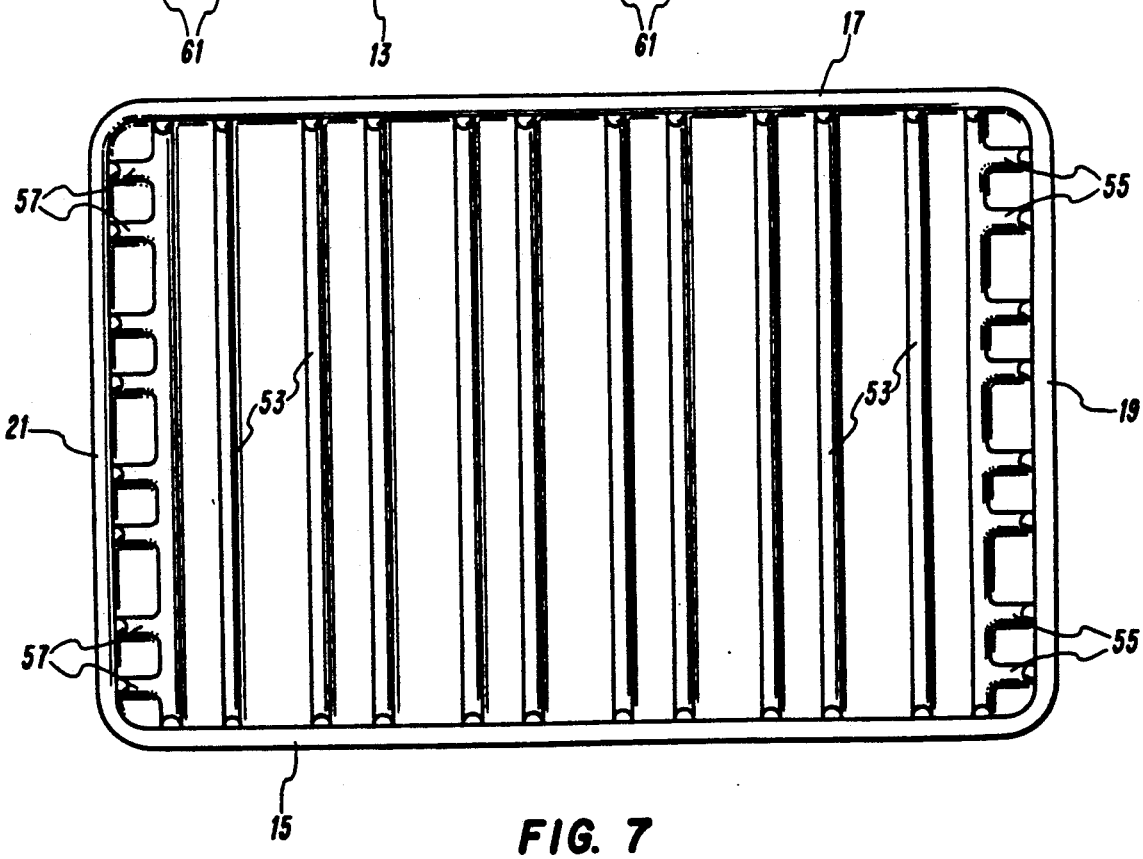

Referring to FIGS. 5–7, a second embodiment of a tray 51 according to the present invention is depicted. Tray 51 is substantially the same as tray 11, described above with reference to FIGS. 1–4, except that first, second and third sets of rib members 53, 55 and 57 extend only partially upward along respective side walls 15 and 17 and end walls 19 and 21 and tray 51 contains no perimeter rim member, as best seen in FIGS. 5 and 6. First, second and third sets of rib members 53, 55 and 57 preferably extend vertically along substantially the entire height of the respective lower portions 41 of the compound walls of tray 51 and terminate at or adjacent to the area of transition between the respective lower portions 41 and upper portions 43 of the tray walls, as best seen in FIGS. 5 and 6. First, second and third rib members 53, 55 and 57 form corresponding first, second and third sets of grooves in the respective outer surfaces of tray 51. First and second sets of grooves 59 and 61 are illustrated in FIGS. 5 and 6.

Figure 8:
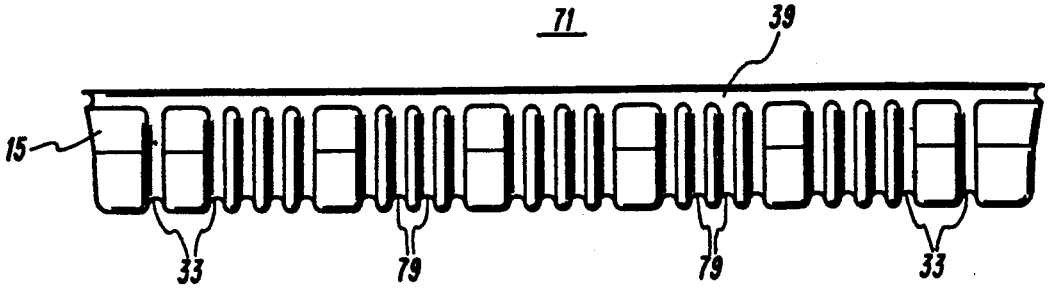
FIGS. 8–10 are side elevation, end elevation and top plan views, respectively, of a third embodiment of the tray, according to the present invention.
Figure 9:
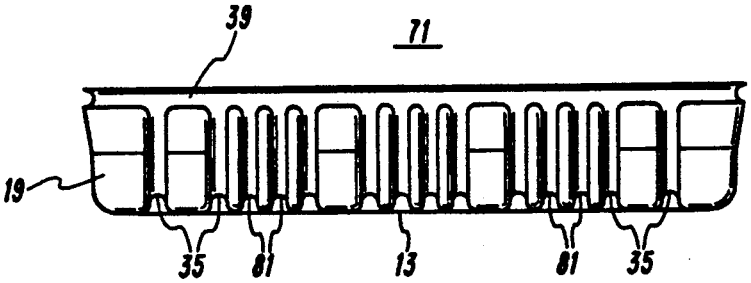
Figure 10:
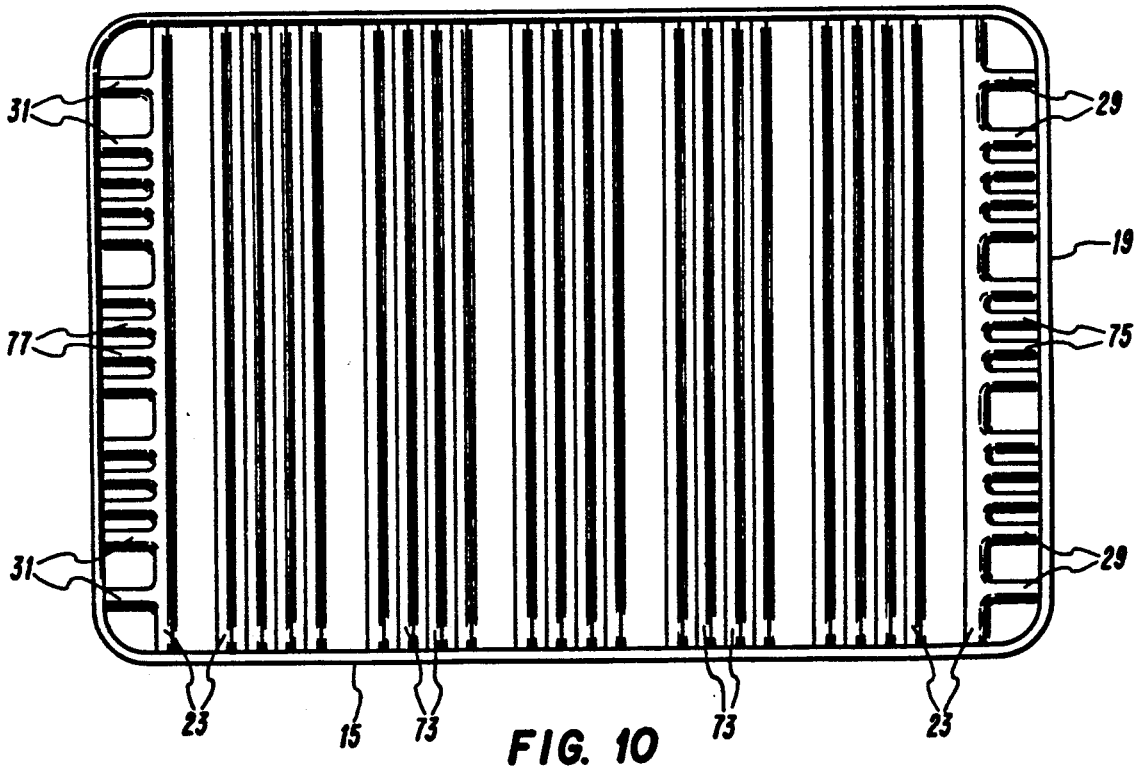

Referring to FIGS. 8–10 a third embodiment of a tray 71 according to the present invention is depicted. Tray 71 is substantially the same as tray 11 described above with reference to FIGS. 1–4, except that tray 71 further includes a fourth set of rib members 73 extending vertically along substantially the entire height of first side wall 15, transversely across bottom member 13 and vertically along substantially the entire height of second side wall 17, and fifth and sixth sets of rib members 75 and 77 extending vertically along substantially the entire height of respective first and second end walls 19 and 21 and partially inwardly along bottom member 13 and terminating at the respective intersections on bottom member 13 with respective ones of first rib members 23 which are closest to the respective first and second end walls 19 and 21. Fourth, fifth and sixth sets of rib members 73, 75 and 77 are disposed at substantially equal intervals between the respective adjacent cooperating pairs of rib members 23, 29 and 31 on the respective walls of tray 71. Fourth, fifth and sixth sets of rib members 73, 75 and 77 form corresponding fourth, fifth and sixth sets of grooves in the respective outer surfaces of tray 71. Fourth and fifth sets of grooves 79 and 81 are illustrated in FIGS. 8 and 9.

Figure 11:
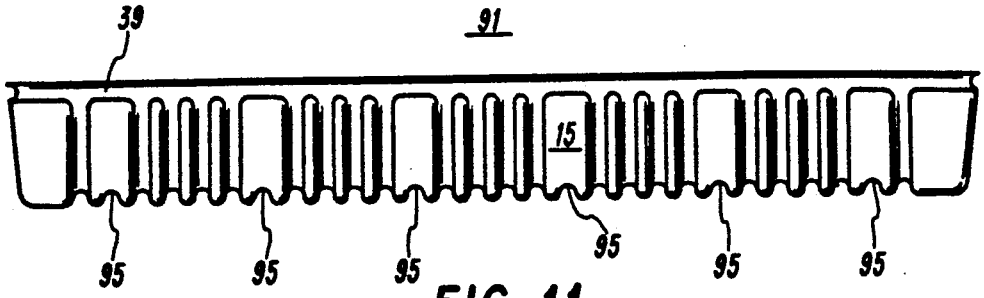
FIGS. 11–13 are side elevation, end elevation and top plan views, respectively, of a fourth embodiment of the tray, according to the present invention.
Figure 12:
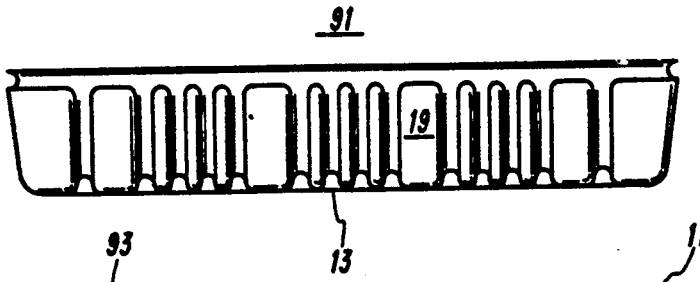
Figure 13:
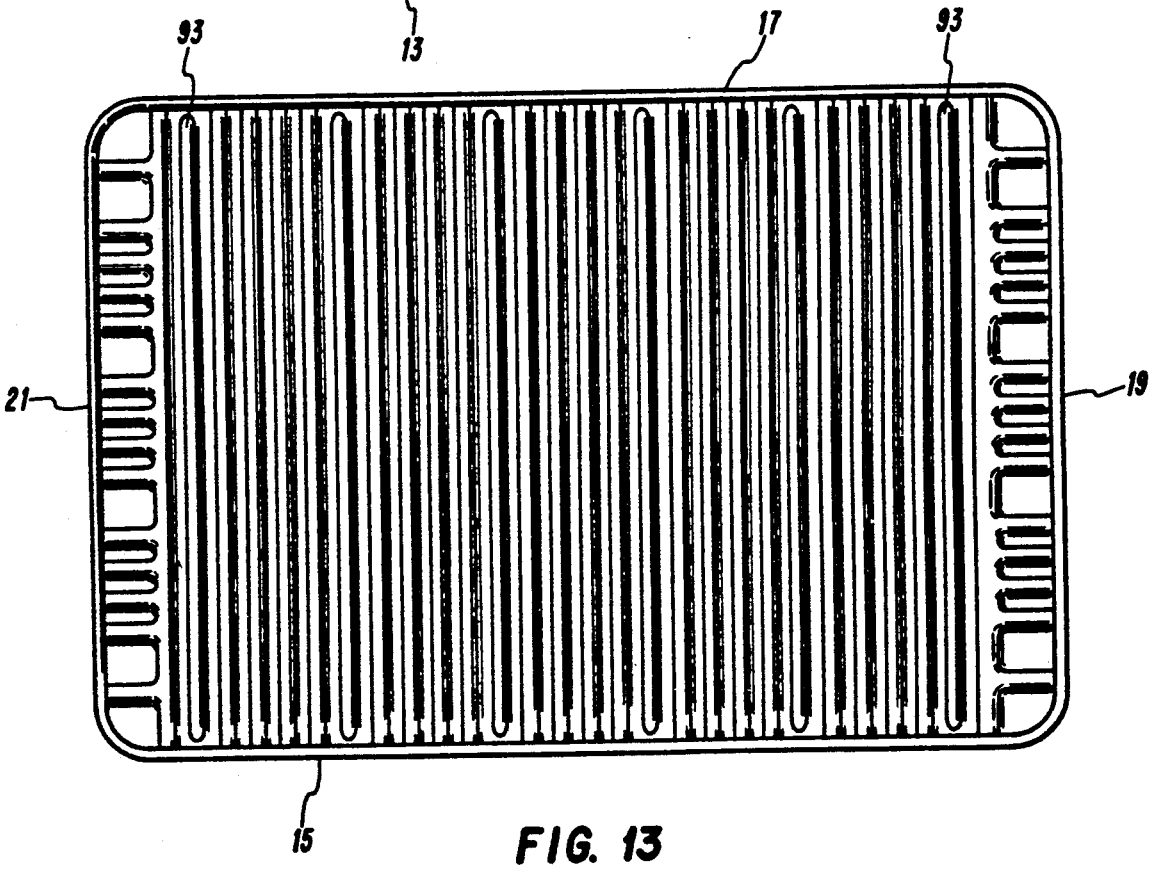
Figure 14:
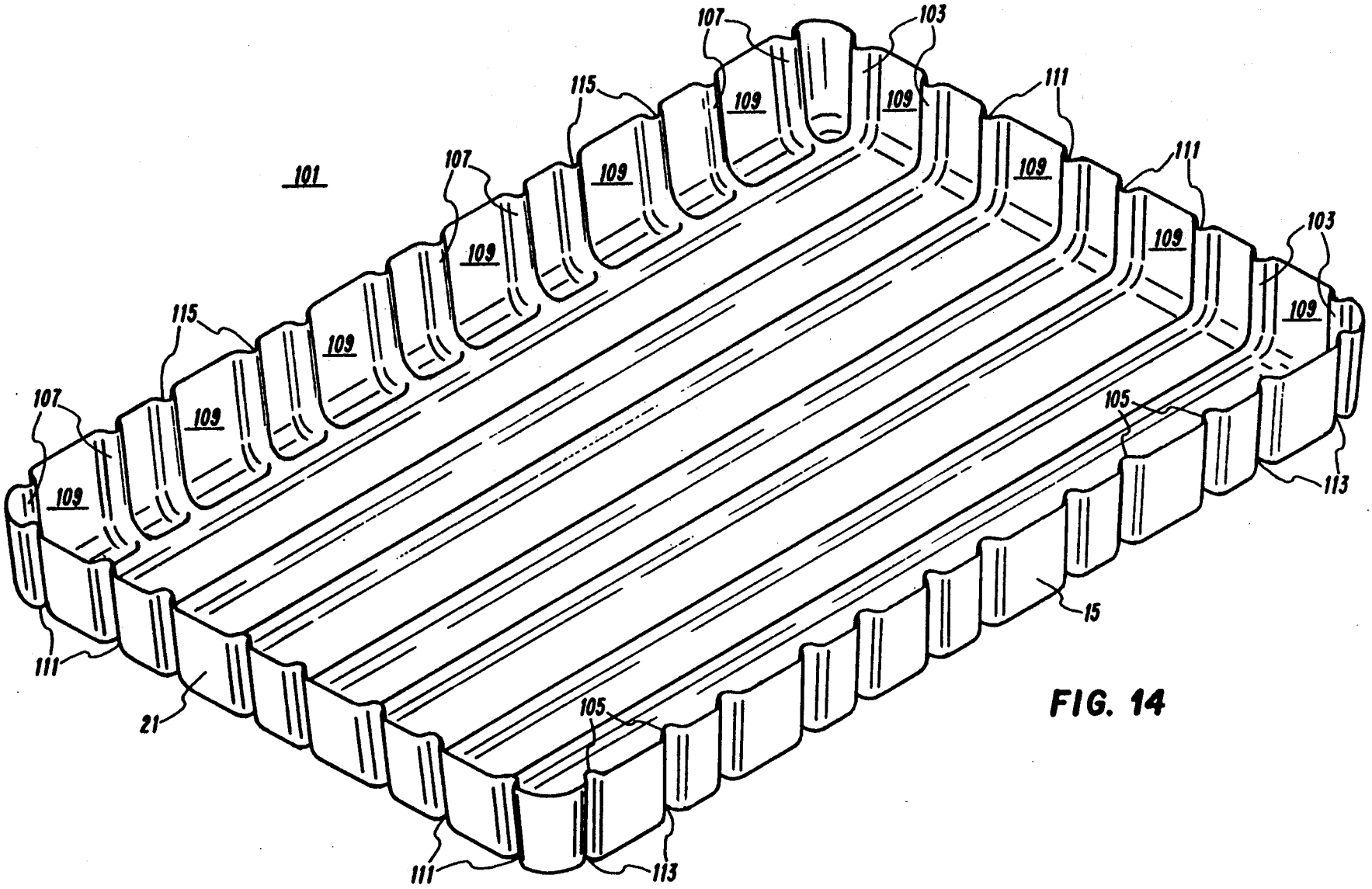
FIGS. 14–17 are perspective, side elevation, end elevation and top plan views, respectively, of a fifth embodiment of the tray, according to the present invention.
Figure 15:
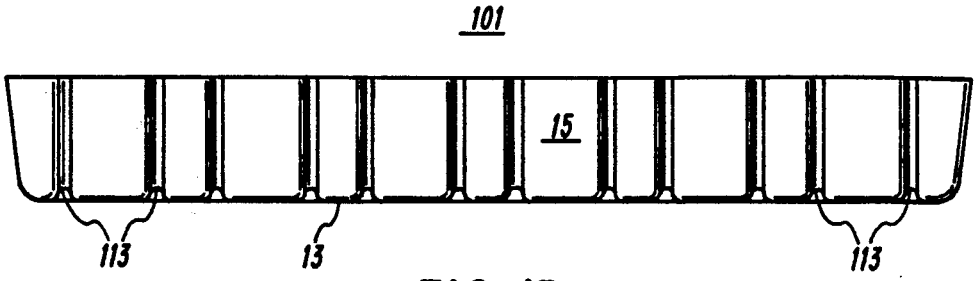
Figure 16:
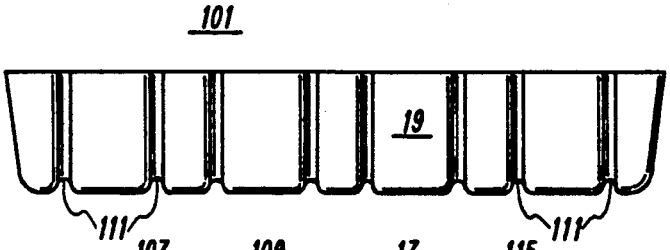
Figure 17:
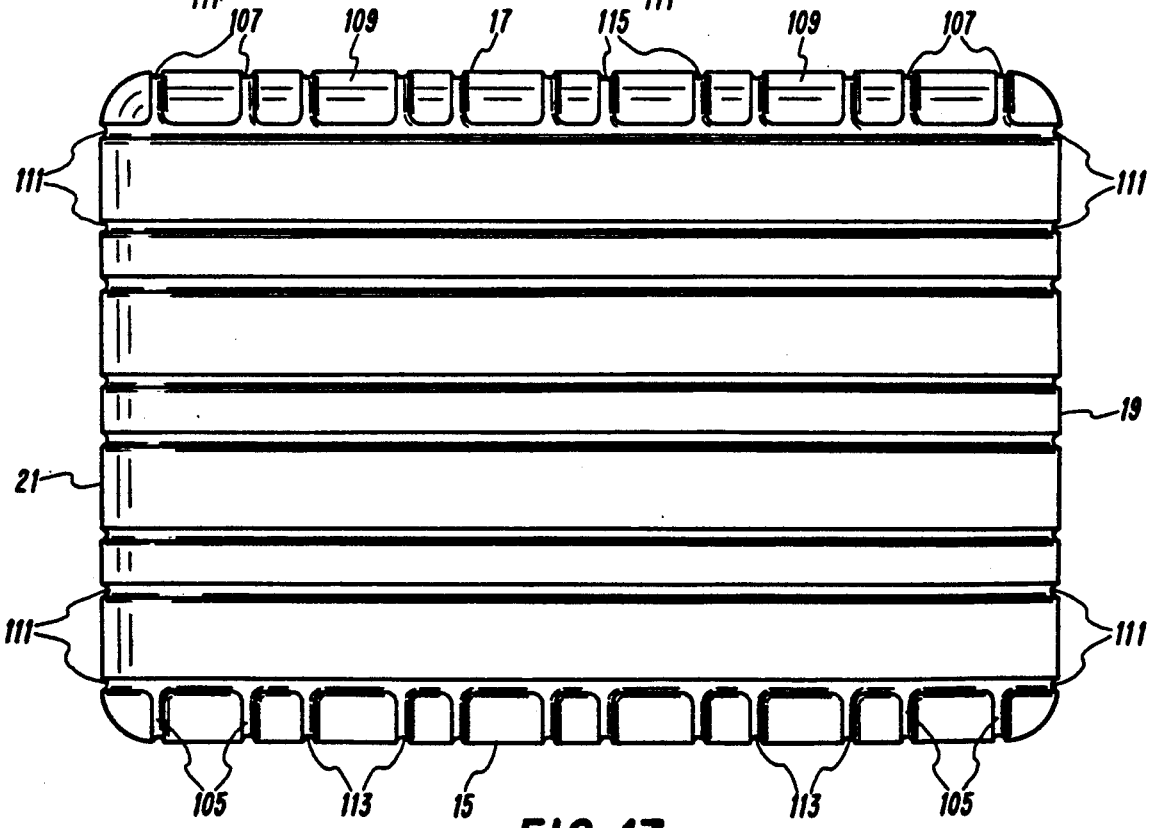

Referring to FIGS. 11–13, a fourth embodiment of a tray 91 according to the present invention is depicted. Tray 91 is substantially the same as tray 71 described above with reference to FIGS. 8–10, except that tray 91 further includes a seventh set of rib members 93 extending transversely across bottom member 13 between first and second side walls 15 and 17 and walls 15, 17, 19 and 21 are "single slope" walls (i.e., the walls have a relatively constant slope from bottom member 13 to rim member 17) instead of "compound" walls. Seventh rib members 93 do not extend vertically along the respective surfaces of side walls 15 and 17, but rather terminate at the respective intersections with side walls 15 and 17. Seventh set of rib members 93 are disposed between individual ones of each cooperating pair of first set of rib members 23, at substantially equal distances between individual rib members 23 of each cooperating pair, for dividing the corresponding recessed region 25 substantially in half along bottom member 13. Seventh set of rib members 93 form a corresponding seventh set of grooves 95 on the outer surface of bottom member 13, as best seen in FIG. 11.

Referring to FIGS. 14–17, a fifth embodiment of a tray 101 according to the present invention is depicted. Tray 101 has a first set of rib members 103 extending vertically along substantially the entire height of first end wall 19, longitudinally along bottom member 13 and vertically along substantially the entire height of second end wall 21. First rib members 103 terminate at the respective upper edges of first and second end walls 19 and 21.

Second and third sets of rib members 105 and 107 extend vertically along substantially the entire height of respective first and second side walls 15 and 17 and partially inwardly across bottom member 13 and terminate at the respective intersections on bottom member 13 with a particular one of first set of rib members 103 which is closest to the respective side walls 15 and 17.

First, second and third sets of rib members 103, 105 and 107 are arranged in respective cooperating pairs at predetermined locations on tray 101. Each of the cooperating pairs of rib members defines a corresponding one of a plurality of recessed regions 109 therebetween. The spacings between adjacent ones of rib members 103, 105 and 107 are dependent upon the thickness of the rib members (measured perpendicularly inward from the respective walls). The greater the thickness of the rib members, the greater will be the spacings between adjacent ones of the rib members, so that cylindrically-shaped articles, such as beverage containers, stored in tray 101 are able to contact the respective walls of tray 101 within the respective recessed regions 109, as described in greater detail with reference to FIGS. 25–28. First, second and third sets of rib members 103, 105 and 107 define respective first, second and third sets of grooves 111, 113 and 115 on the corresponding outer surfaces of tray 101.

Side walls 15 and 17 and end walls 19 and 21 are preferably angled outwardly with respect to a vertical axis which is perpendicular to bottom member 13, to provide a predetermined draft angle to facilitate loading of beverage containers into tray 101. Bottom member 13, side walls 15 and 17, end walls 19 and 21 and first, second and third rib members 103, 105 and 107 are preferably formed as an integral unit using a convention thermoforming process. Tray 101 is preferably comprised of a lightweight plastic material.

Figure 18:
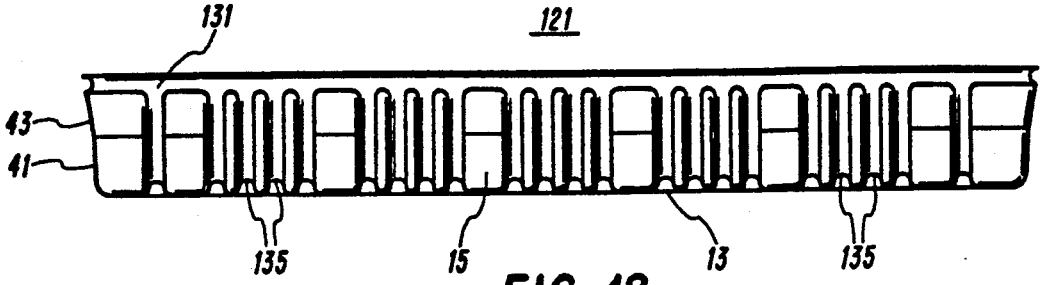
FIGS. 18–20 are side elevation, end elevation and top plan views, respectively, of a sixth embodiment of the tray, according to the present invention.
Figure 19:
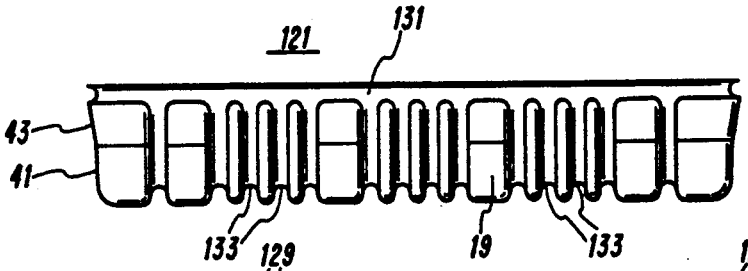
Figure 20:
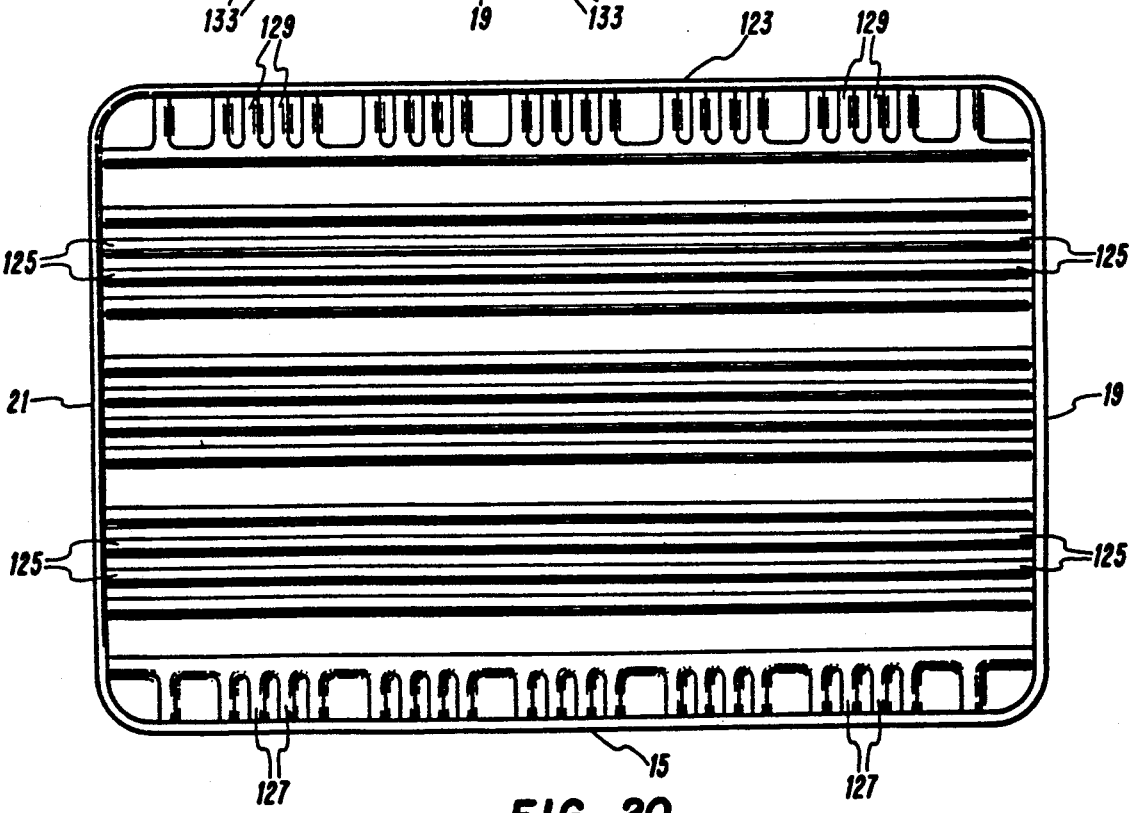

Referring to FIGS. 18–20, a sixth embodiment of a tray 121 according to the present invention is depicted. Tray 121 is substantially the same as tray 101, described above with reference to FIGS. 14–17, except that tray 121 includes a rim member 123 extending inwardly around the perimeter of tray 121 and has "compound" walls wherein respective lower portions 41 thereof are oriented substantially vertically and respective upper portions 43 thereof are angled outwardly with respect to a vertical axis to provide a predetermined draft angle.

Tray 121 further includes fourth, fifth and sixth sets of rib members 125, 127 and 129 disposed at substantially equal intervals between respective adjacent cooperating pairs of first, second and third sets of rib members 103, 105 and 107. Fourth set of rib members 125 extends vertically along substantially the entire height of first end wall 19, longitudinally along bottom member 13 and vertically along substantially the entire height of second end wall 21. Fifth and sixth sets of rib members 127 and 129 extend vertically along substantially the entire heights of respective first and second side walls 15 and 17 and partially inwardly across bottom member 13 and terminate at respective intersections on bottom member 13 with the respective ones of first set of rib members 103 which are closest to respective first and second side walls 15 and 17. Rim member 123 and fourth, fifth and sixth rib members 125, 127 and 129 define corresponding sets of grooves 131, 133 and 135 in the respective outer surfaces of tray 121.

Figure 21:
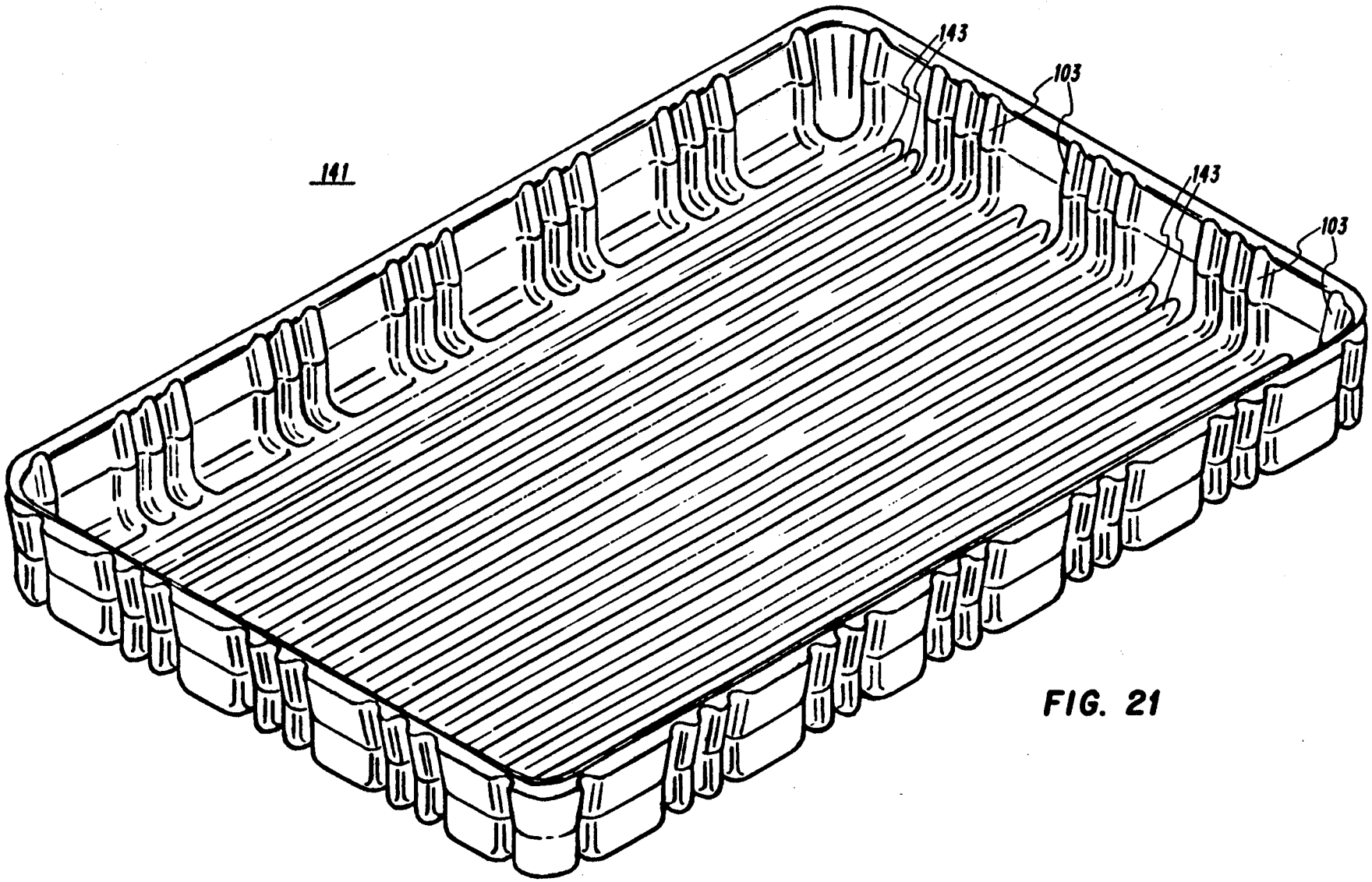
FIG. 21 is a perspective view of a seventh embodiment of the tray, according to the present invention.

Referring to FIG. 21, a seventh embodiment of a tray 141 according to the present invention is depicted. Tray 141 is substantially the same as tray 121, described above with reference to FIGS. 18–20, except that tray 141 further includes a seventh set of rib members 143 extending longitudinally along bottom member 13 between first and second end walls 19 and 21. Seventh set of rib members 143 are disposed between individual ones of each cooperating pair of first rib members 103, for dividing the corresponding recessed regions 109 between cooperating pairs of first rib members 103 into substantially equal sub-regions along bottom member 13. Seventh rib members 143 do not extend vertically along respective end walls 19 and 21, but rather terminate at the respective intersections with end walls 19 and 21. Seventh rib members 143 define a corresponding seventh set of grooves 145 in the respective outer surfaces of tray 141.

Figure 22:
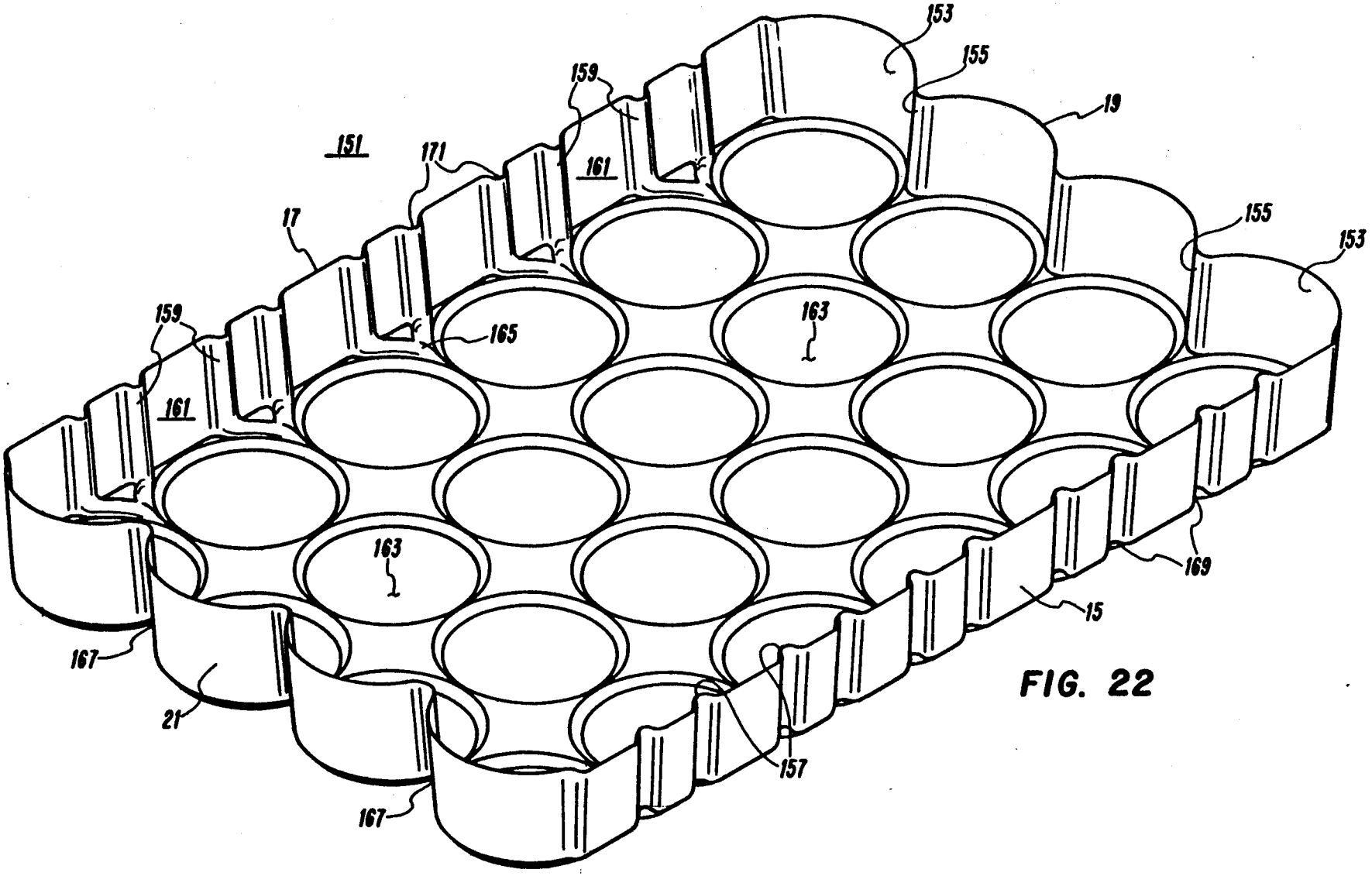
FIG. 22 is a perspective view of an eighth embodiment of the tray, according to the present invention.
Figure 28:
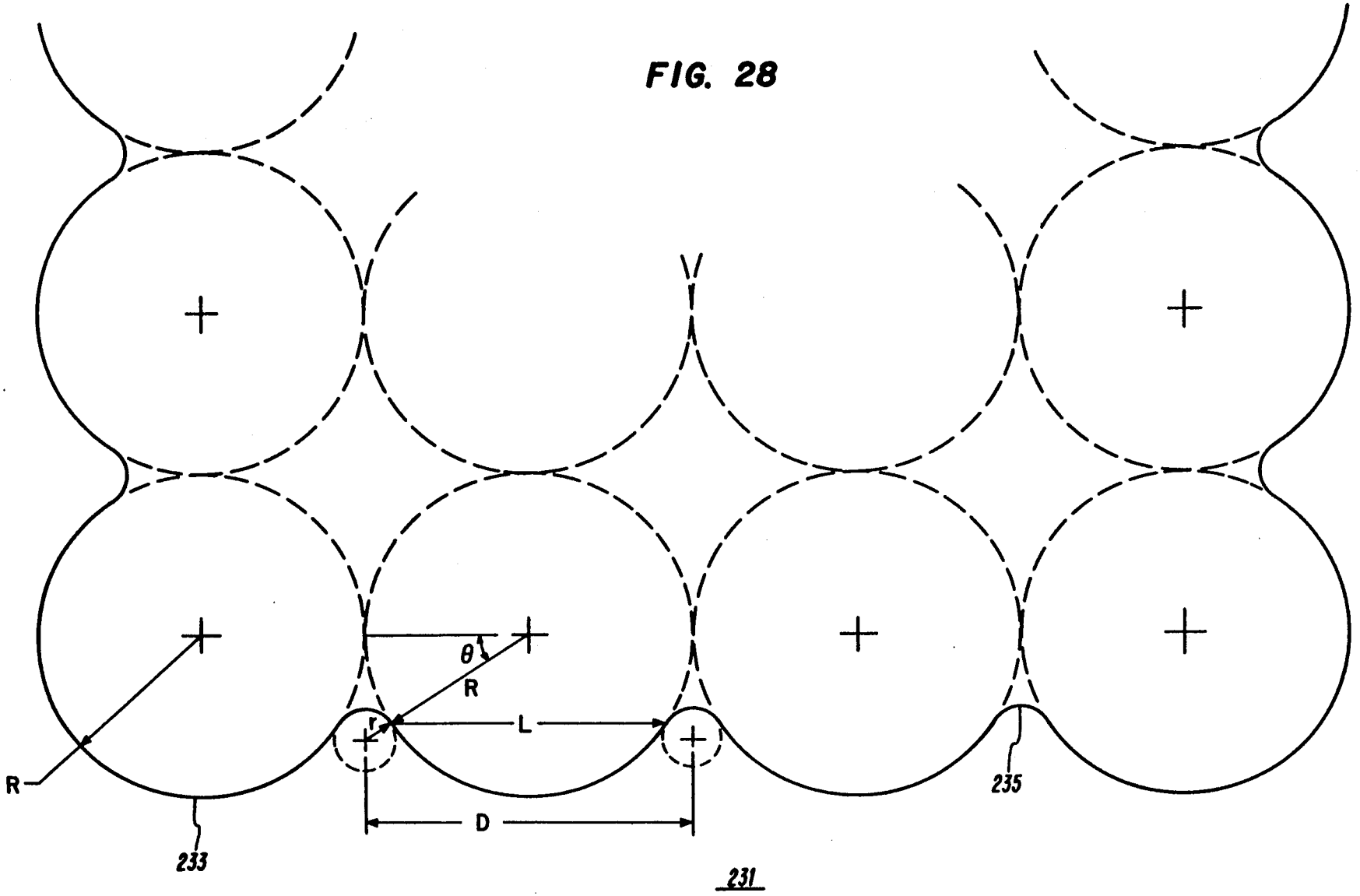

Referring to FIG. 22, an eighth embodiment of a tray 151 according to the present invention is depicted. First and second end walls 19 and 21 are comprised of a plurality of recessed regions 153 separated by corresponding ones of a plurality of inwardly extending surfaces 155 to provide a substantially scalloped appearance on end walls 19 and 21. The end wall surface within each recessed region 153 is curved to conform to the curved surface of the corresponding article which is to be stored and transported within tray 151, so that substantially the entire curved surface of the portion of the article which is disposed within the corresponding recessed region 153 is in contact with the end wall surface within each region 153, as best seen in FIG. 28.

First and second side walls 15 and 17 have respective first and second sets of rib members 157 and 159 extending vertically along substantially the entire height of the respective side walls 15 and 17 and partially inwardly across bottom member 13. Selected ones of first and second sets of rib members 157 and 159 are arranged in cooperating pairs to define respective recessed regions 161 therebetween.

Bottom member 13 includes a plurality of receptacles 163, which are preferably circularly shaped to conform to the cylindrical shape of the articles which are stored and transported within tray 151. The portion of bottom member 13 surrounding each receptacle 163 is beveled to substantially conform to the beveled shape of the chine portion of a typical beverage can which is loaded into tray 151. Individual rib members 157 and 159 in each cooperating pair diverge away from one another along bottom member 13 so that at least a portion of a corresponding receptacle 163 is received within the corresponding recessed region 161 defined by each cooperating pair of rib members. Similarly, the individual rib members 157 and 159 in each cooperating pair converge toward the respective adjacent rib members 157 and 159 on opposite sides of the corresponding recessed region 161, so that the individual rib members in each cooperating pair intersect with respective adjacent rib members between respective adjacent receptacles 163, as indicated at 165. Side walls 15 and 17 and end walls 19 and 21 are oriented substantially vertically with respect to bottom member 13 so that walls 15, 17, 19 and 21 have a negligible draft angle. Inwardly extending surfaces 155 and first and second sets of rib members 157 and 159 form respective grooves 167, 169 and 171 in the corresponding outer surfaces of tray 151.

Figure 23:
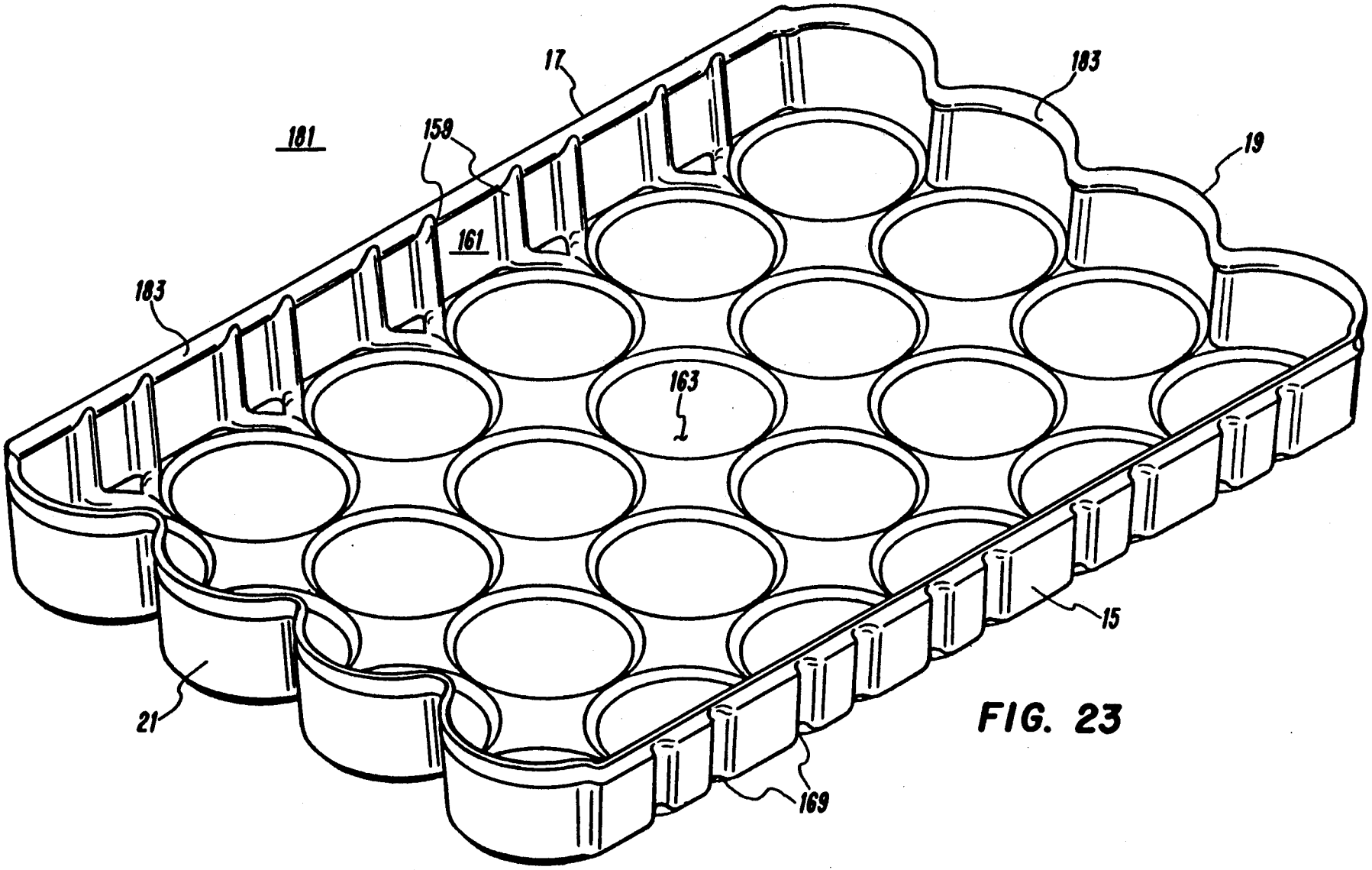
FIG. 23 is a perspective view of a ninth embodiment of the tray, according to the present invention.

Referring to FIG. 23, a ninth embodiment of a tray 181 is depicted. Tray 181 is substantially the same as tray 151, described above with reference to FIG. 22, except that tray 181 includes a rim member 183 extending inwardly adjacent to the upper edge of tray 181 around the perimeter thereof. Rim member 183 forms a corresponding groove in the respective outer surfaces of tray 181.

Figure 24:
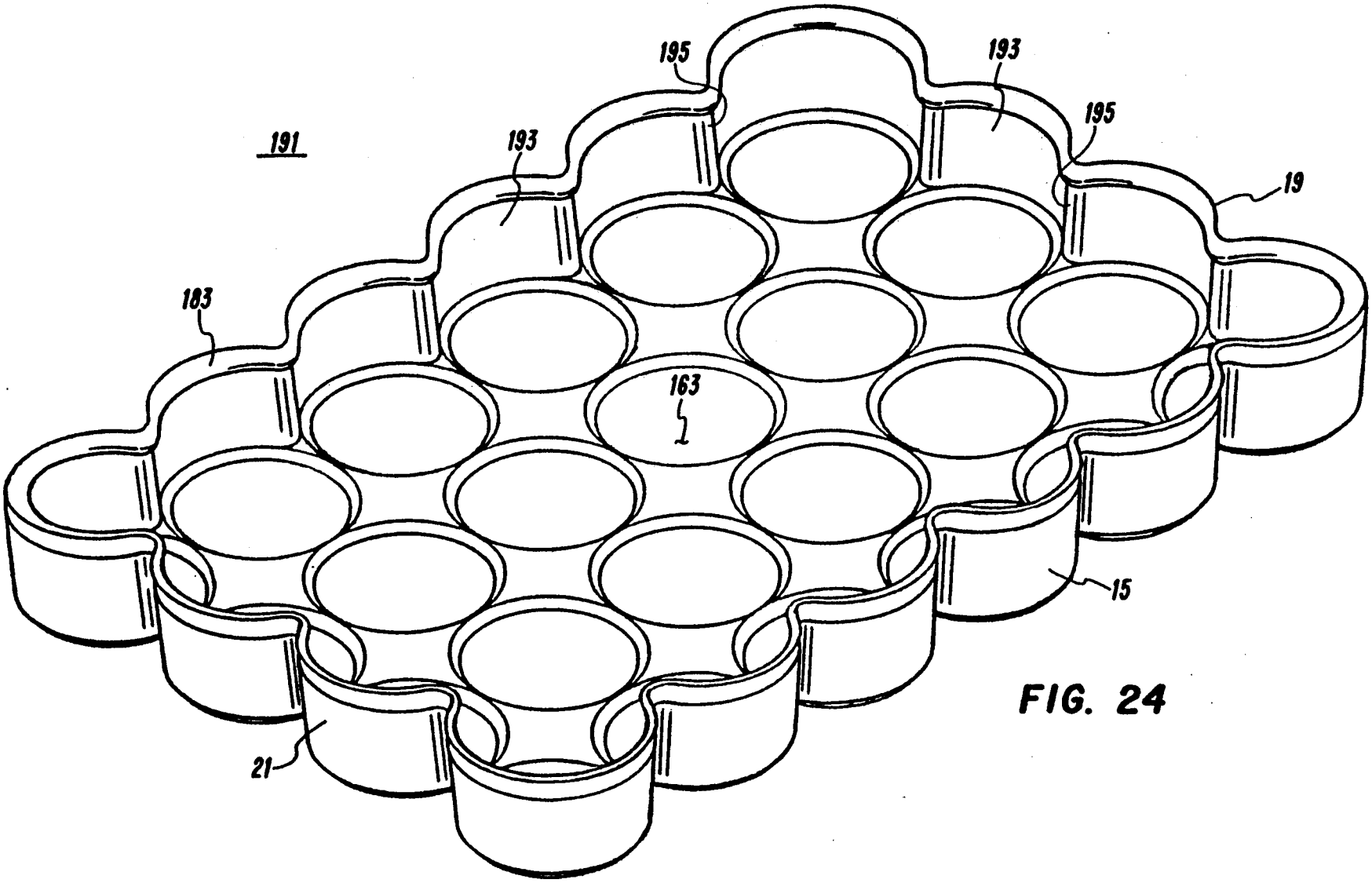
FIG. 24 is a perspective view of a tenth embodiment of the tray, according to the present invention.

Referring to FIG. 24, a tenth embodiment of a tray 191 according to the present invention is depicted. Each of the four walls 15, 17, 19 and 21 of tray 191 is comprised of a plurality of recessed regions 193 separated by corresponding ones of a plurality of inwardly extending surfaces 195, to provide a substantially scalloped appearance on all four walls of tray 191. Otherwise, tray 191 is substantially the same as tray 181, described above with reference to FIG. 23.

Figure 25:
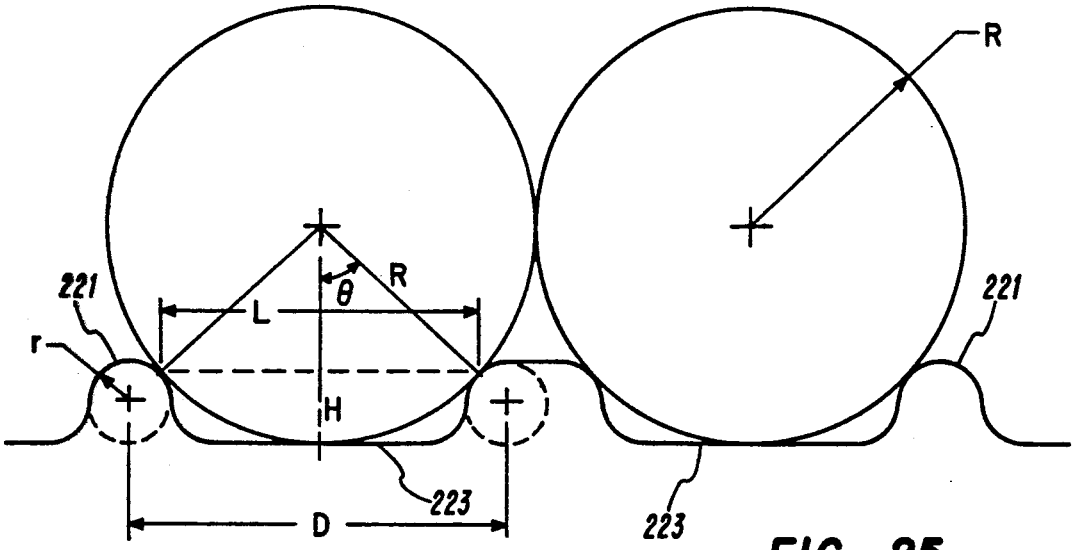
FIGS. 25–28 are top plan views illustrating the contact between the articles loaded into the tray and the walls of the tray, according to the present invention.
Figure 26:
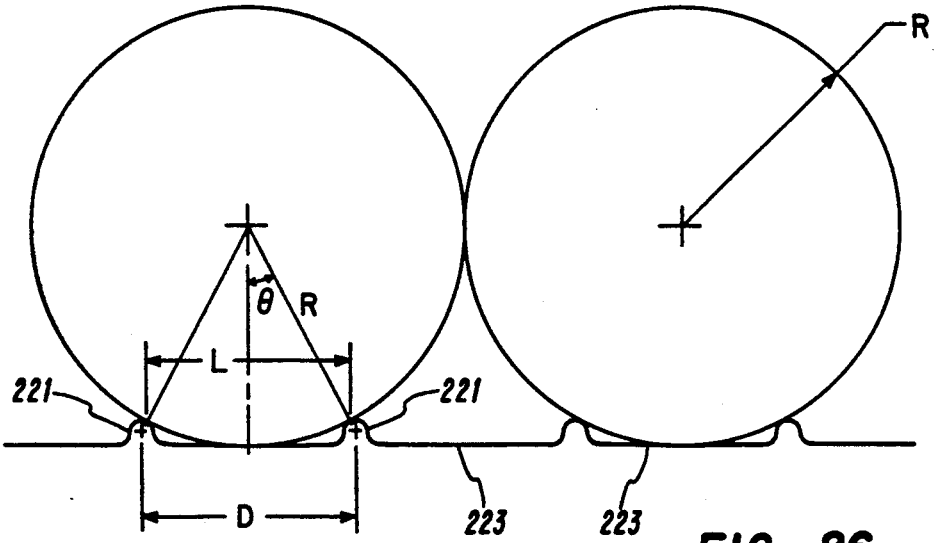
Figure 27:
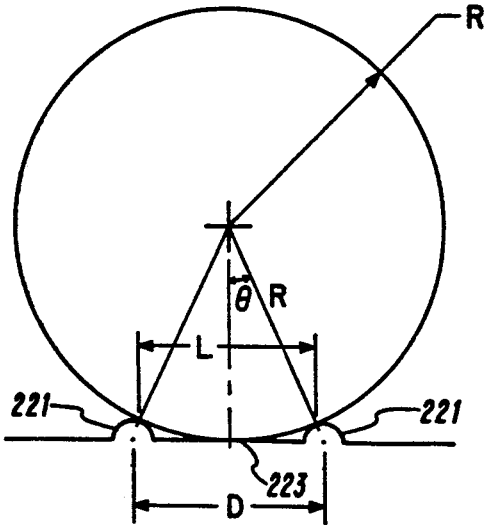

Referring to FIGS. 25–27, the respective points of contact between each article 197 and the corresponding rib members 221 and wall 223 of tray 201 are depicted. In FIGS. 25 and 26, the curvature of each rib member 221 is such that an imaginary circle is transcribed by a crosssection of each rib member 221, taken horizontally along an axis perpendicular to the corresponding wall 223. The imaginary circle is tangent to the plane of the particular wall 223 from which rib member 221 extends, as represented by the dotted curve. FIGS. 25 and 26 illustrate the dependency of the spacing between individual rib members 221 as a function of the "thickness" of rib members 221. Because of the curvilinear nature of rib members 221, it is convenient to represent the "thickness" thereof in terms of the radius of curvature r of rib members 221, as measured from the center of the imaginary circle. The radius of each cylindrical container 197 is represented by R. The lateral distance D between the respective centers of adjacent rib members 221 is represented geometrically as follows:

$$D = 4\sqrt{rR}$$

The distance H between wall 223 and the point of tangency between container 197 and each rib member 221, as measured along an axis perpendicular with respect to wall 223, is represented by the following geometrical relationship:

$$H=2rR/(r+R)$$

The lateral distance L between points of tangency of each container 197 with adjacent rib members 221 of the corresponding cooperating pair of rib members, as measured parallel to the corresponding wall 223, is represented by the following geometrical relationship:

$$L=2R\sin\theta=Rd/2(R+r)$$

One skilled in the art will recognize that the spacing D between adjacent rib members 221 of each cooperating pair is proportional to the square root of the radius of curvature r of rib members 221. For example, in FIG.

26 the radius of curvature r of rib members 221 is substantially less than the corresponding radius of curvature r of rib members 221 in FIG. 25. Therefore, the distance D between the respective centers of adjacent rib members 221 is substantially less in FIG. 26 than in FIG. 25.

Referring to FIG. 27, rib members 221 have a semicircular shape. The geometric relationships D, H and L are expressed as follows as a function of the radius of curvature r of rib members 221 and the radius R of articles 197.

$$D = 2\sqrt{r(2R + r)}$$

$$H=Rr/(R+r)$$

$$L=2R\sin\theta=RD/2(R+r)$$

Referring to FIG. 28, a tray 231 in which all four walls 233 are scalloped, as in FIG. 24, is depicted. In this case r represents the radius of curvature (as measured from the center of the imaginary circle represented by the dotted curve) of each inwardly extending portion 235 along each of the four walls 233. The spacing D between respective centers of adjacent ones of extension portions 235 along each wall 233 and the lateral distance L between the respective points of tangency of each container 197 with the respective extension portions 235 are represented by the following geometric relationship:

$$D=2R$$

$$L=2R\cos\theta=R^2/(r+R)$$

One skilled in the art will appreciate that when articles 197 are stored in tray 231, the spacing D between the respective centers of adjacent ones of extension portions 235 is solely dependent upon the radius R of each article 197. The lateral distance L between the respective points of tangency of each container 197 and the respective extension portions 235 decreases as the radius of curvature r increases.

Figure 29:
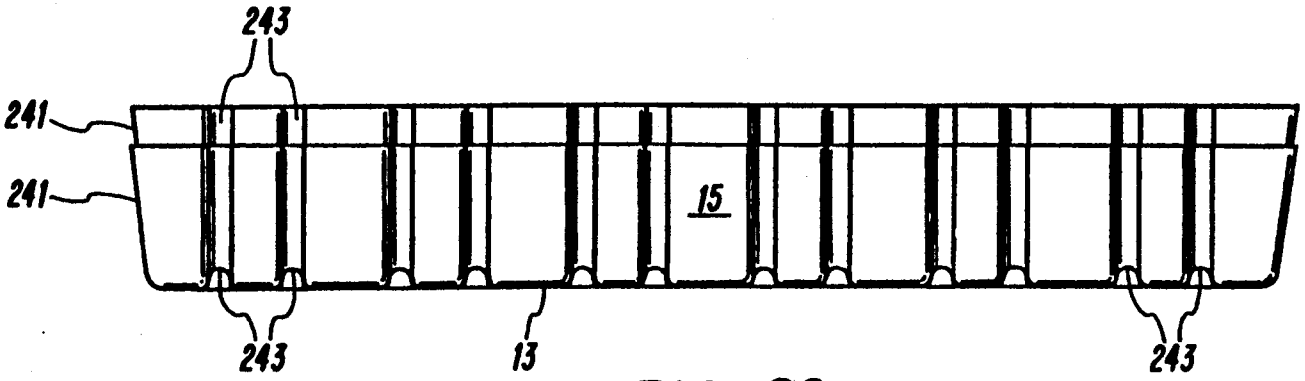
FIGS. 29 and 30 are side elevation and end elevation views, respectively, of two trays being nested together while empty, according to the present invention.
Figure 30:
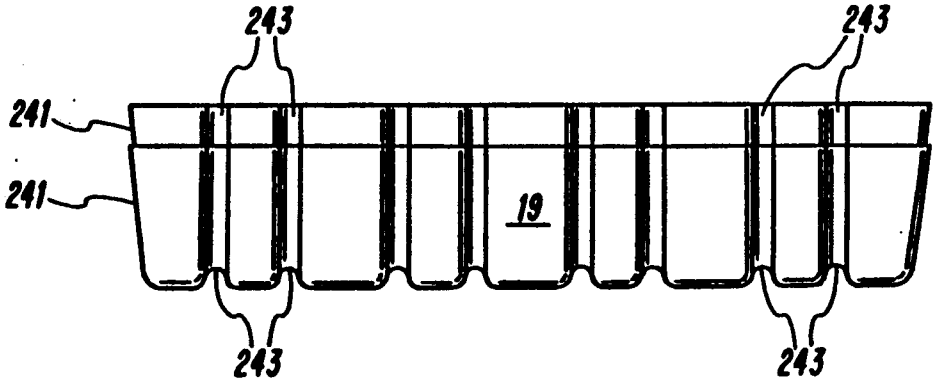
Figures 31, 32:
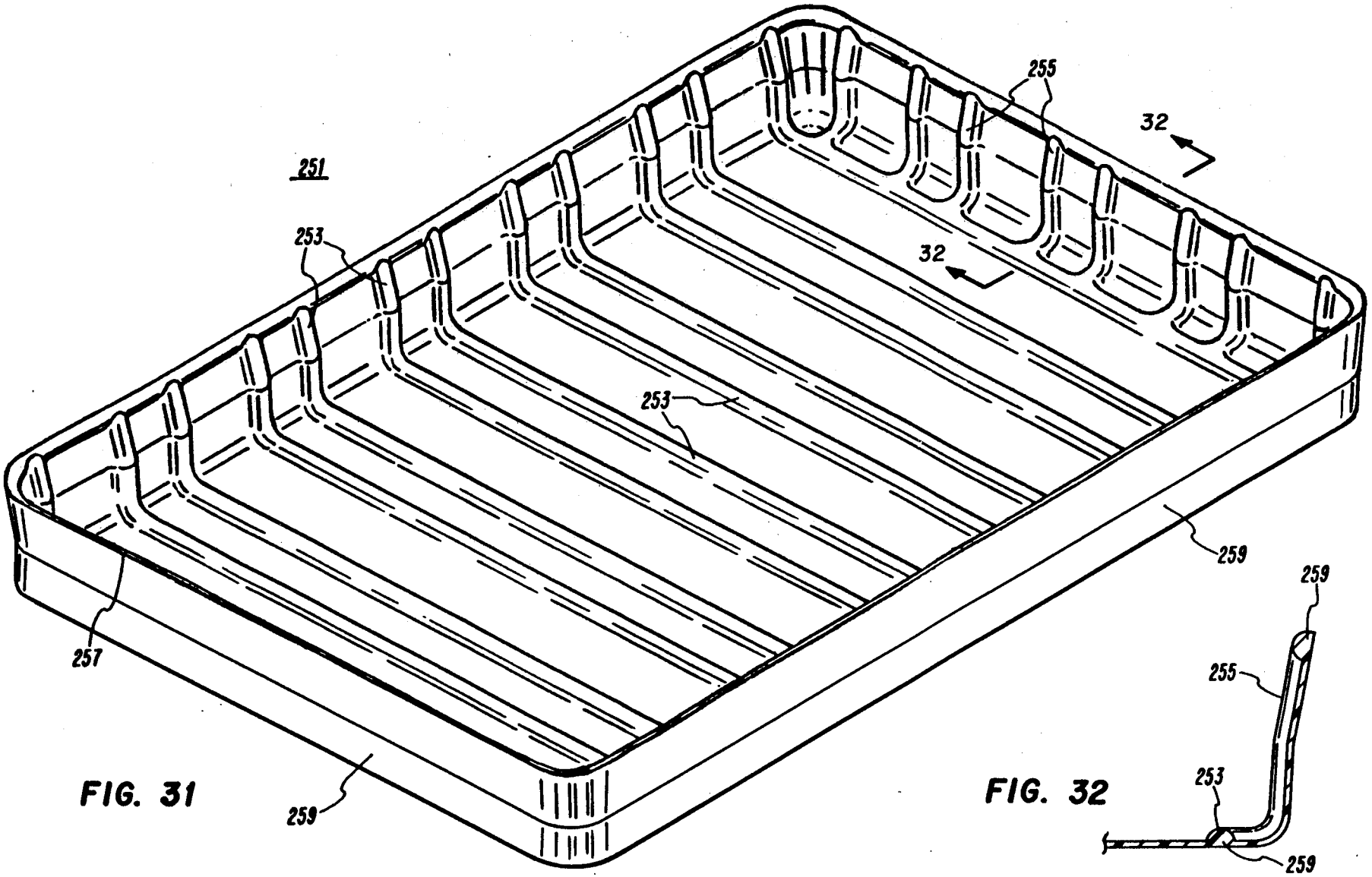
FIG. 31 is a perspective of an eleventh embodiment of the tray according to the present invention.
FIG. 32 is a sectional view of a portion of the tray, taken along the section line indicated in FIG. 31.
Figure 33:
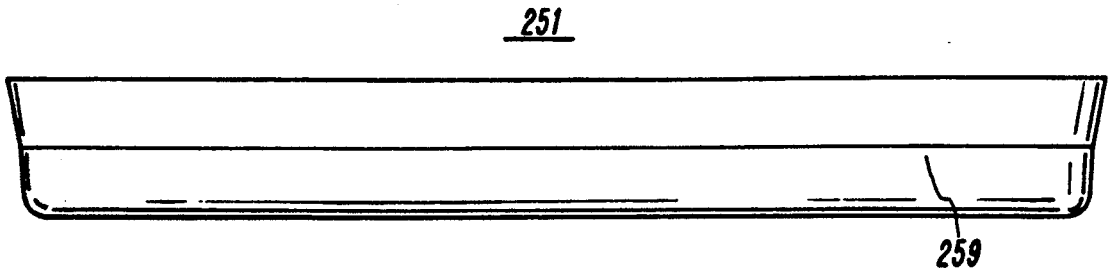
FIG. 33 is a side elevation view of tbe tray shown in FIG. 31.
Figure 34:
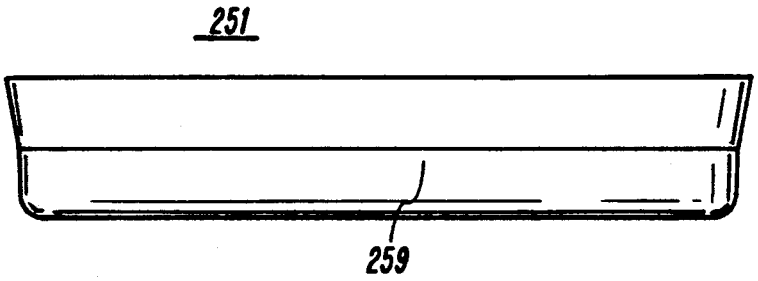
FIG. 34 is an end elevation view of the tray shown in FIG. 31.
Figure 35:
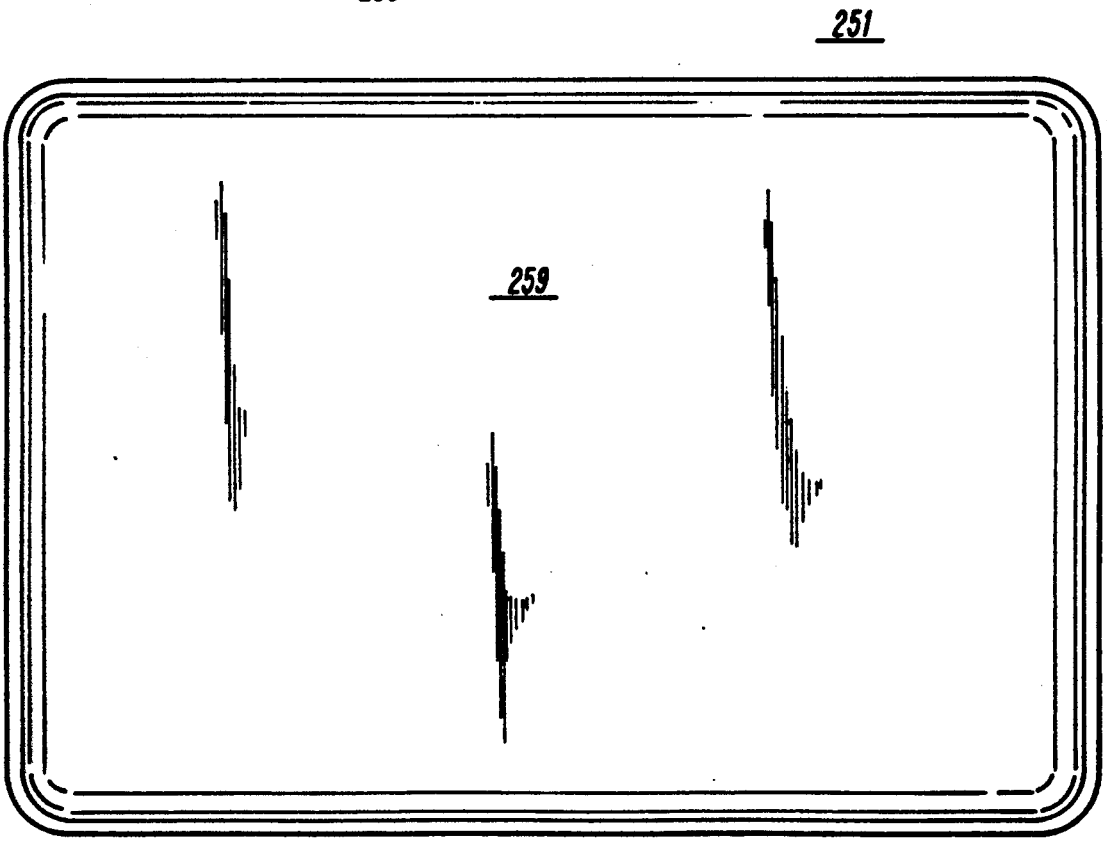
FIG. 35 is a bottom plan view of the tray shown in FIG. 31.

Another aspect of the invention is illustrated in FIGS. 29 and 30. Two trays 241 are nested together by inserting the bottom portion of a first one of trays 241 into the enclosure formed by the bottom member and four walls of a second tray 241. The draft angle of the walls of each tray 241 facilitates the nesting of trays 241. One skilled in the art will appreciate that grooves 243 defined by the corresponding rib members (not shown) on the outer surfaces of first tray 241 will mate with the complementary rib members on the inner surfaces of second tray 241 along the respective four walls of the two trays 241, to conserve storage space when the trays are not in use.

Referring to FIGS. 31–35, an eleventh embodiment of a tray 251 according to the present invention is depicted. Tray 251 is substantially the same as tray 11, described above with reference to FIGS. 1–4, except that first, second and third sets of rib members 253, 255 and 257 do not define corresponding grooves on the respective outer surfaces of tray 251. Rather, the respective outer surfaces of tray 251 are substantially smooth to enhance the structural integrity of the tray. When multiple trays filled with canned beverages are stacked one on top of the other, the rib members of the trays in the vicinity of the bottom of the stack, particularly the portions of the rib members formed on the respective bottom members of the trays, are subjected to large compressive forces. By forming the rib members on the inner surfaces of the tray to eliminate the corresponding grooves on the respective outer surfaces 259 so that respective outer surfaces 259 are substantially smooth, the structural strength of the rib members is substantially enhanced One skilled in the art will appreciate that it is advantageous to eliminate the grooves on the outer surfaces opposite the respective rib members in all of the trays described above with references to FIGS. 1–23, so that the respective outer surfaces are substantially smooth.

Figure 36:
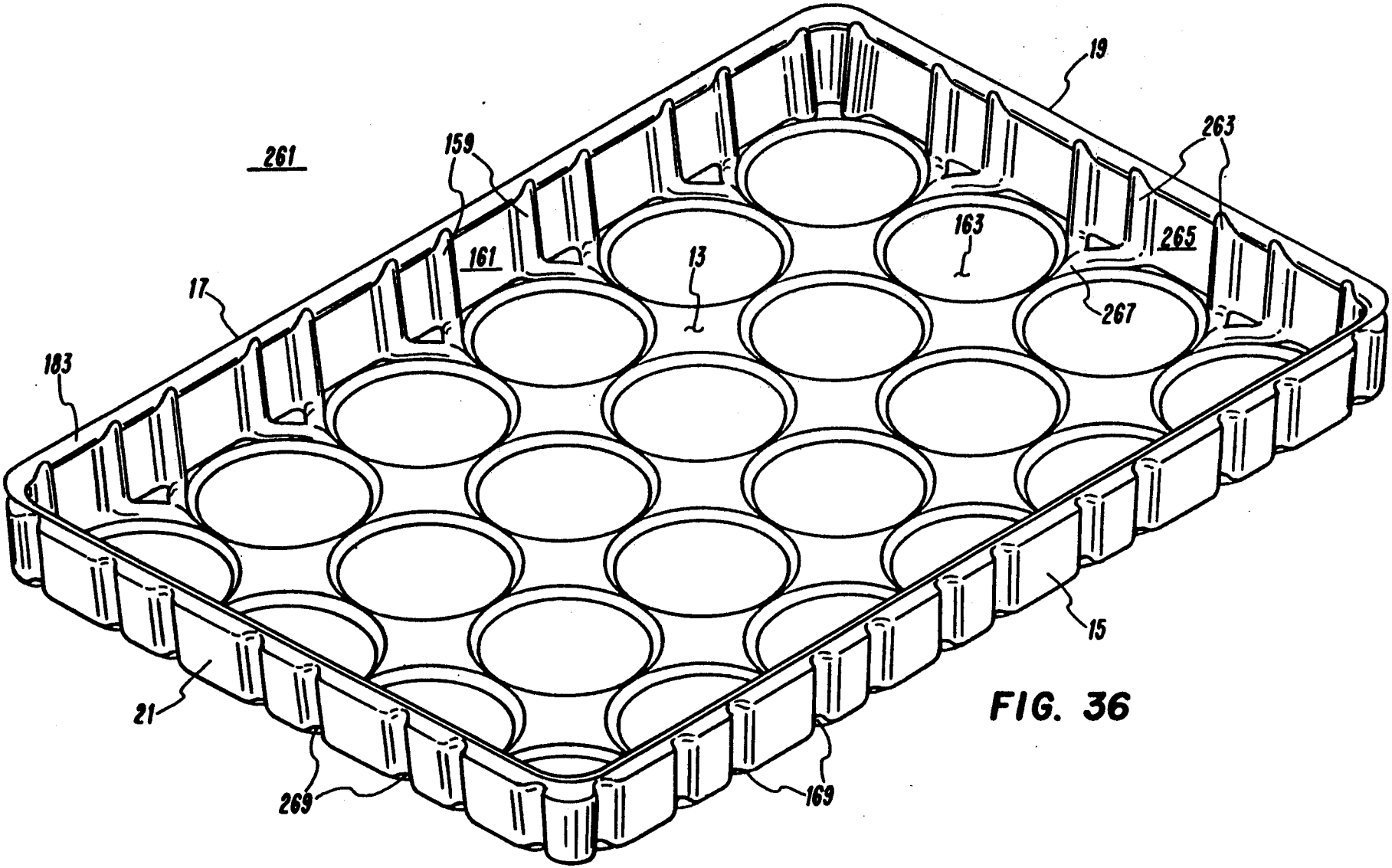
FIG. 36 is a perspective view of a twelfth embodiment of the tray according to the present invention.

Referring to FIG. 36, a twelfth embodiment of a tray 261 according to the present invention is depicted. Tray 261 is substantially the same as tray 181, described above with reference to FIG. 23, except that the scalloped surfaces comprising end walls 19 and 21 of tray 181 are replaced with relatively flat wall surfaces having respective third and fourth sets of rib members 263 disposed on respective inner surfaces thereof. Only the third set of rib members 263 is shown in FIG. 36.

Third and fourth sets of rib members 263 extend vertically along substantially the entire height of the respective end walls 19 and 21 and partially inwardly along bottom member 13. Selected ones of third and fourth sets of rib members 263 are arranged in cooperating pairs to define respective recessed regions 265 therebetween. Individual rib members 263 in each cooperating pair diverge away from one another along bottom member 13 so that at least a portion of the corresponding receptacle 163 is received within the corresponding recessed region 265 defined by each cooperating pair of rib members 263. Similarly, individual rib members 263 in each cooperating pair converge toward the respective adjacent rib members 263 on opposite sides of the corresponding recessed region 265, so that individual rib members in each cooperating pair intersect with respective adjacent rib members between respective adjacent receptacles 163, as indicated at 267. Third and fourth sets of rib members 263 define respective grooves 269 on the respective outer surfaces of end walls 19 and 21 of tray 261. Only grooves 269 associated with fourth set of rib members 263 are shown in FIG. 36.

The tray according to the present invention provides a cost effective, returnable tray for storing and transporting cylindrically shaped articles, such as beverage containers. The tray is lightweight, but sturdy and is able to store and transport beverage containers in either a loose state or in multi-container packages, such as in packages of six, eight or twelve individual containers. The nestability feature of the trays allows multiple trays to be stored in a minimum of storage space when not in use. The tray is integrally formed to retain fluid leaks and spills so as to prevent contamination of the contents of other trays.

Referring to FIGS. 37–40, a thirteenth embodiment of a tray 271 according to the present invention is depicted. Tray 271 is comprised of a bottom member 273, a pair of oppositely positioned side walls 275 and 277 and a pair of oppositely positioned end walls 279 and 281, interconnected to form an enclosure for receiving articles therein.

Disposed on respective inner surfaces of side walls 275 and 277 and end walls 279 and 281 are a plurality of substantially vertical rib members 283, which are arranged in cooperating pairs to define respective recessed regions 285 therebetween. The spacings between adjacent ones of vertical rib members 283 are dependent upon the thickness of rib members 283 (measured perpendicularly outward from the respective walls) and the diameter of the container, as previously described. The greater the thickness of rib members 283, the greater will be the spacings between adjacent ones of rib members 283, so that cylindrically-shaped articles, such as beverage containers, stored in tray 271 are able to contact the respective walls within respective recessed regions 285.

Vertical rib members 283 extend substantially along the entire height of corresponding walls and terminate at respective intersections with a perimeter rim member 287, which is disposed adjacent to the upper edge of tray 271. Rim member 287 extends outwardly and curves downwardly from the upper edge of tray 271.

Figure 40:
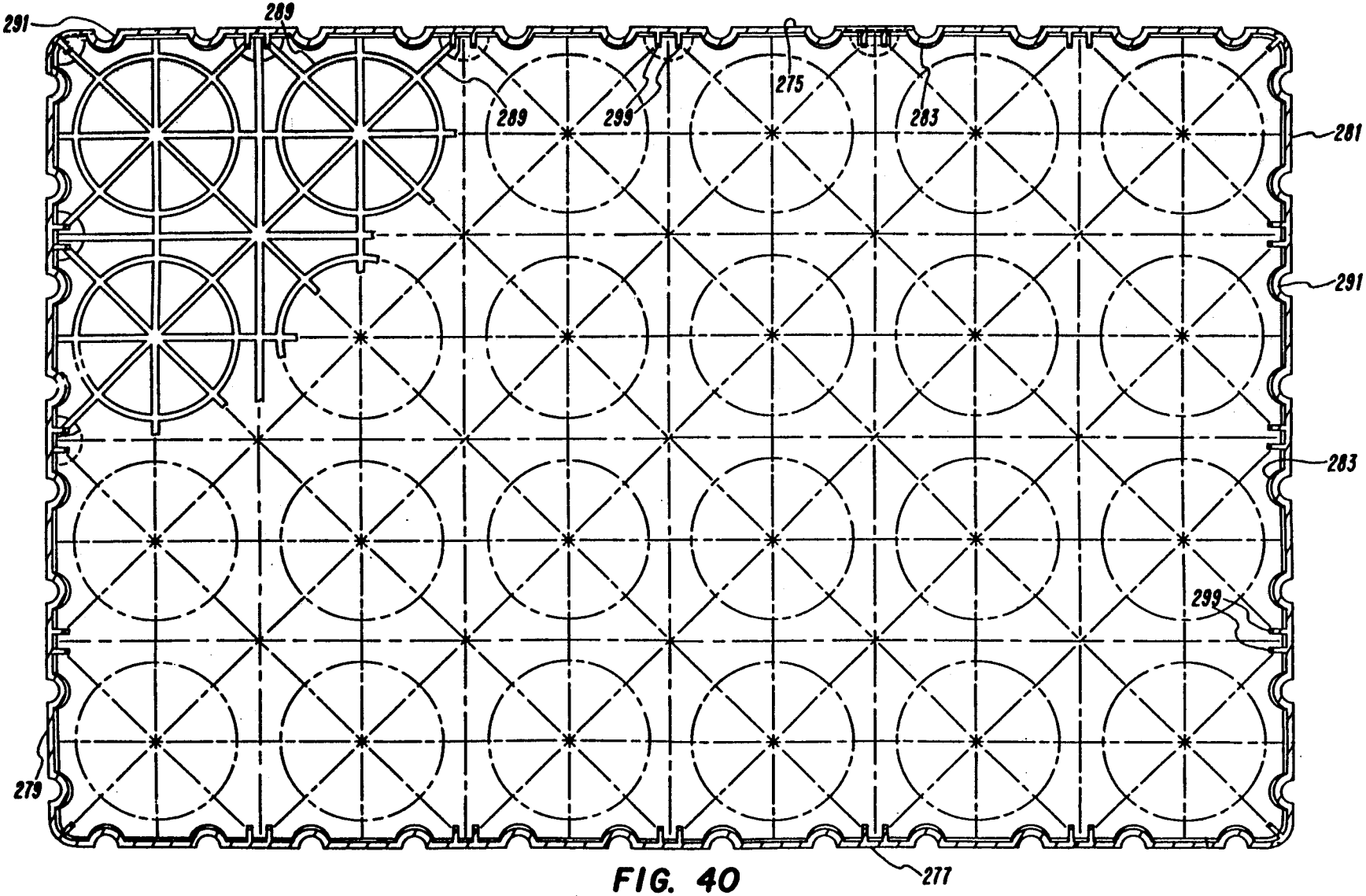

Tray 271 is preferably formed as an integral unit using a conventional injection molding process Tray 271 is preferably comprised of a lightweight, translucent plastic material. Bottom member 273 is comprised of a plurality of horizontal rib members 289 having a substantially rectangular shape, which define a predetermined grid pattern as best shown in FIG. 40. Rib members 289 are T'ed into the corresponding walls of tray 271, portions of rib members 289 define a substantially circular shape for supporting the cylindrically shaped articles packed into tray 271. In one embodiment horizontal rib members 289 are formed on a relatively thin bottom surface, while in an alternate embodiment, the bottom of tray 271 is open between rib members 289 to conserve material and reduce the cost of manufacturing the tray.

Each vertical rib member 283 defines a corresponding vertical groove 291 in the corresponding outer surface of tray 271. Vertical rib members 283 have a substantially half-conical shape, such that a horizontal section line taken through any rib member 283 defines a substantially semi-circular shape. The width of each rib member 283 (as measured horizontally along the corresponding wall) is greatest adjacent to bottom member 273 and decreases upwardly along the corresponding wall so that the width of each rib member 283 is smallest adjacent to its intersection with rim member 287. The shape of the corresponding groove 291 defined by each rib member 283 is substantially a mirror image of the corresponding rib member 283. The half-conical shape of rib members 283 allows multiple trays 271 to be nested to a predetermined depth within the bottom tray 271. Otherwise, the thickness of the tray walls will prevent nesting to the predetermined depth.

Figure 38:
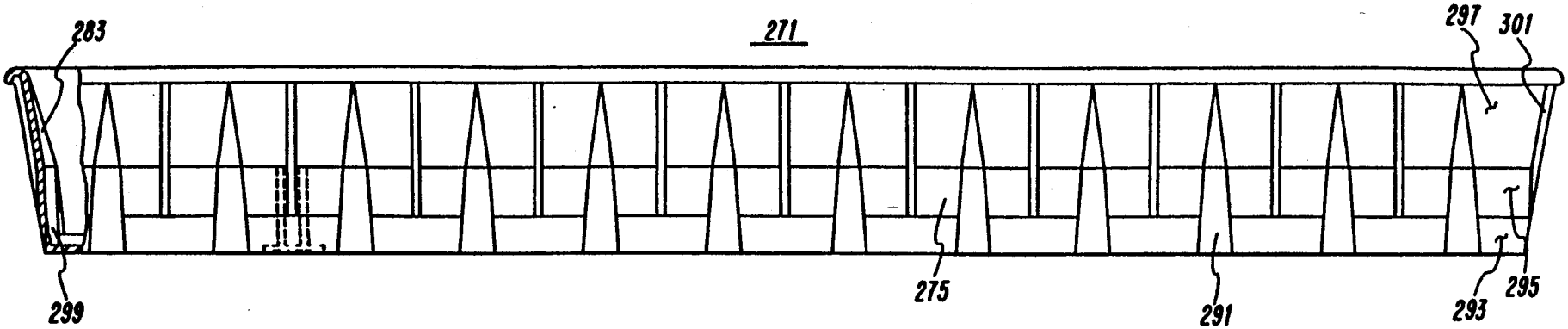
Figure 39:
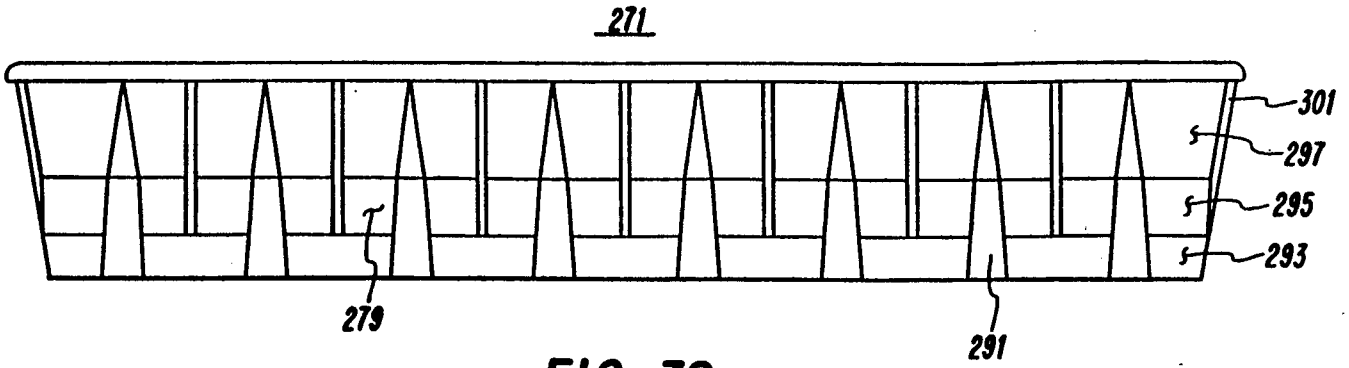

Side walls 275 and 277 and end walls 279 and 281 are preferably "compound" walls, as best seen in FIGS. 38 and 39, to allow multiple trays 271 to be nested together when empty, thereby saving storage space. Each wall is comprised of three portions, a lower portion 293 having a draft angle of approximately ten degrees, a central portion 295 having a draft angle of approximately two degrees and an upper portion 297 having a draft angle of approximately ten degrees. The compound wall configuration also provides spacing between adjacent trays when the upper edges of the trays are in contact to facilitate separation of the trays.

Figure 41:
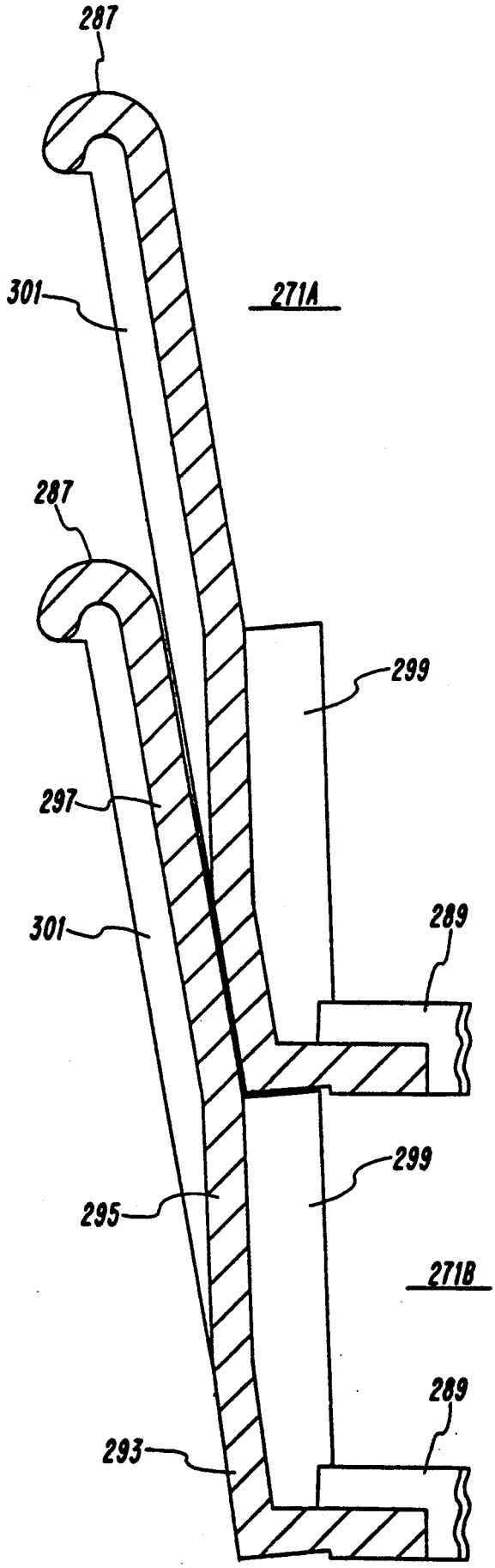
FIG. 41 is a sectional view showing the nesting of a pair of trays illustrated in FIGS. 37–40.

Tray 271 further includes a plurality of posts 299 arranged in cooperating pairs along the inner surfaces of side walls 275 and 277 and end walls 279 and 281. Each cooperating pair of posts is disposed between each cooperating pair of rib members 283 on the inner surfaces of the tray walls. A single post 299 is positioned at each intersection between walls. Posts 299 have a substantially rectangular shape and taper slightly downwardly from the respective intersections of the post with the corresponding walls to respective ends of the post, as best seen in FIG. 40. Posts 299 are used to support bottom member 273 of another tray 271 when two or more trays 271A and 271B are nested together, as best seen in FIG. 41. Posts 299 extend from bottom member 273 upwardly to a horizontal line passing through the intersection of central portion 295 and upper portion 297 on each of the tray walls (hereinafter referred to as the "nesting plane") to prevent tray 271A from being inserted within the enclosure formed by tray 271B below the nesting plane of tray 271B.

As best seen in FIG. 38, the half-conical shape defined by rib members 283 and corresponding groove 291 is different above and below the nesting plane. The shape defined by rib members 283 and corresponding grooves 291 below the nesting plane on lower portion 293 and central portion 295 defines a truncated half-conical shape, while the portion of each rib member 283 and corresponding groove 291 above the nesting plane on upper portion 297 defines a substantially half-conical shape.

Figure 37:
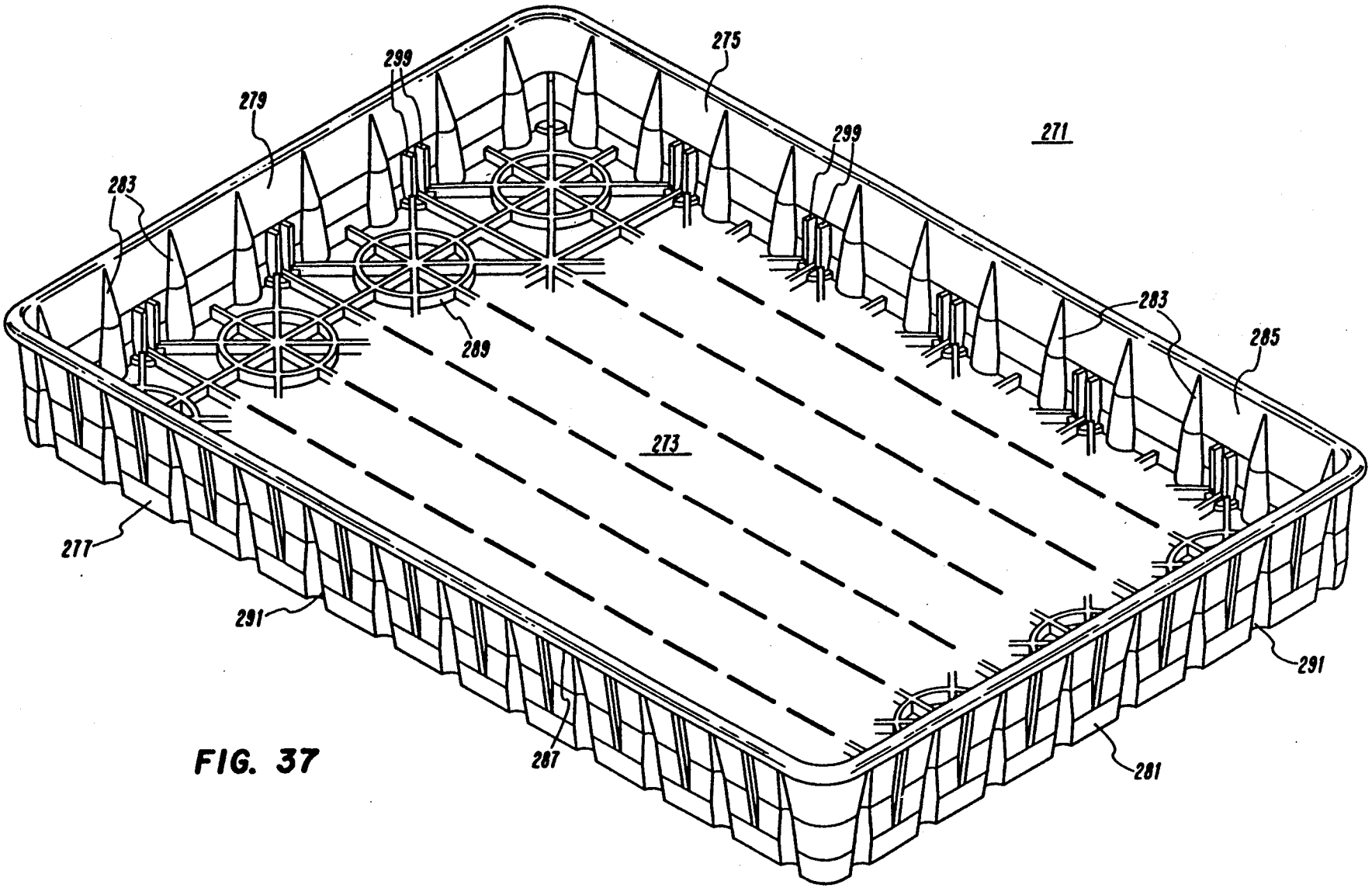
FIGS. 37–40 are respective perspective, side elevation, end elevation and top plan views of a thirteenth embodiment of the tray according to the present invention.

As best seen in FIG. 37, a plurality of stiffeners 301 are disposed on respective outer surfaces of the tray walls to enhance the structural strength and integrity of tray 271. Stiffeners 301 have a substantially rectangular shape and are tapered slightly downward from the intersection of each stiffener 301 with the corresponding tray wall to the corresponding outer end thereof in much the same manner as posts 299. Stiffeners 301 extend vertically along the corresponding outer surfaces of tray 271 from rim member 287 to a horizontal line passing through the intersection of lower portion 293 with central portion 295 on the corresponding walls.

Figure 42:
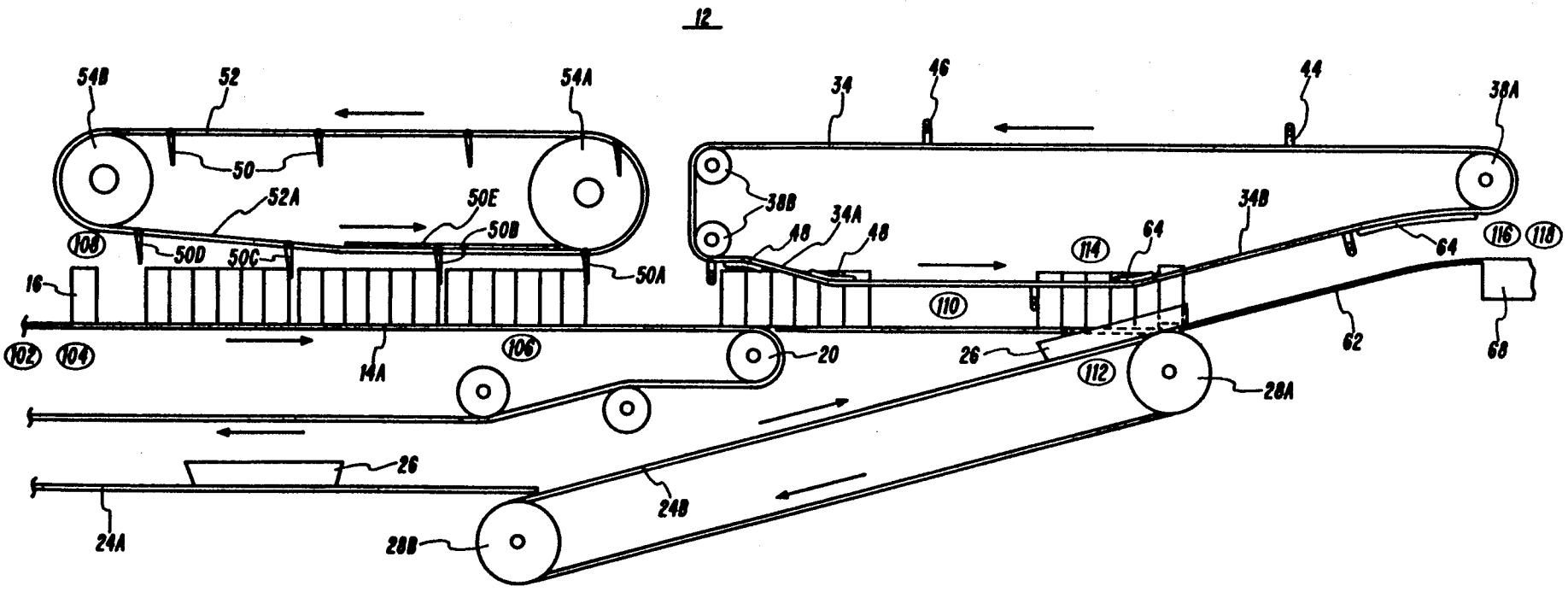
FIGS. 42 and 43 are side elevation views of the tray packing system according to the present invention.
Figure 43:
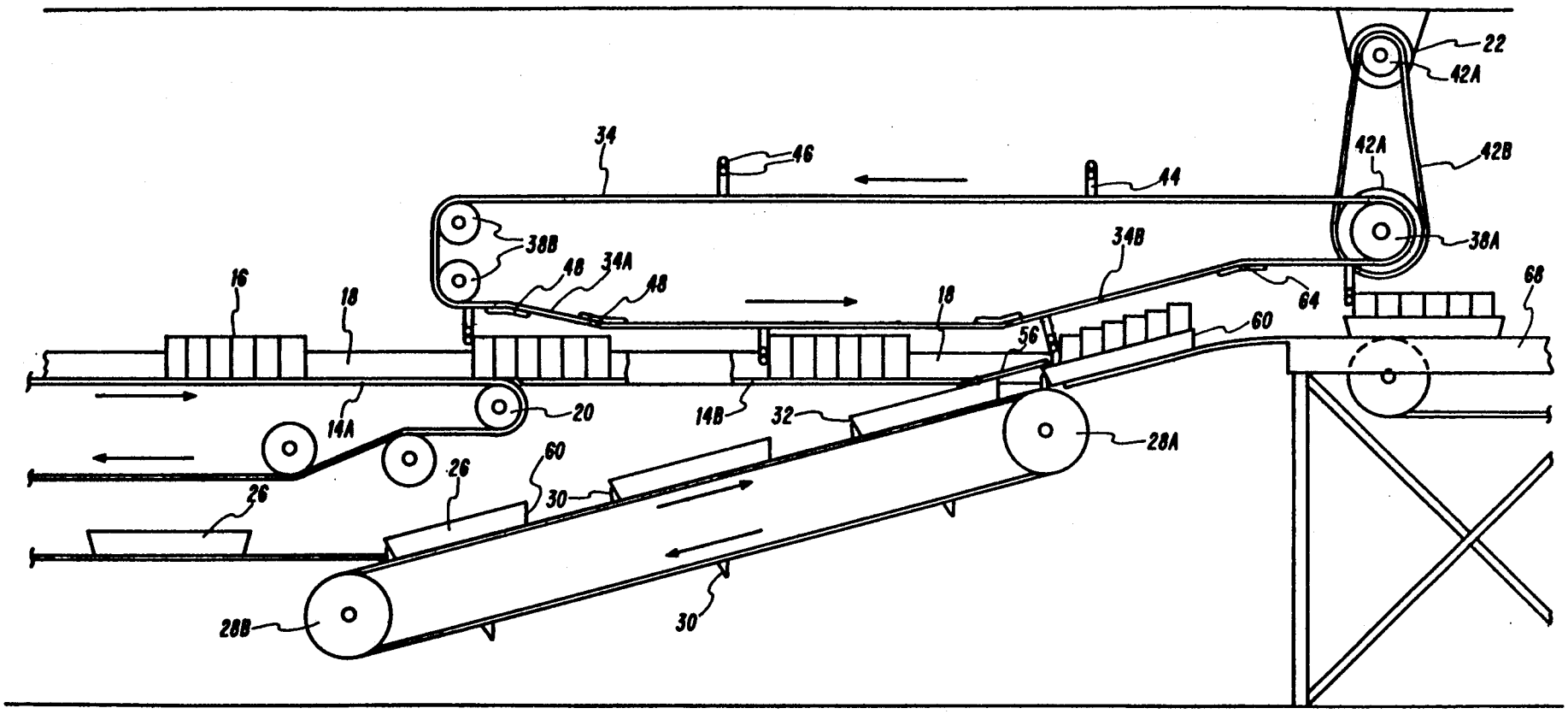

Referring to FIGS. 42 and 43, an automated system for packing beverage containers, such as soft drink cans, into transport trays according to the present invention is depicted. Packing system 12 includes a first conveyor track 14 on which individual beverage containers 16 are transported. Containers 16 may be pre-packaged into six-packs, eight-packs or twelve-packs or, alteratively, individual containers 16 may be transported in a loose state on first conveyor track 14. First conveyor track 14 includes a movable portion 14A, which is preferably comprised of a portion of a first sprocket-driven chain member, and a stationary portion 14B, which may be comprised of one or more chain members, downstream of movable portion 14A. First conveyor track 14 has side walls 18 along substantially the entire length thereof to keep containers 16 on first track 14. End sprocket 20 is preferably driven by an electric motor (not shown) to drive the first chain member comprising movable track 14A in a continuous loop in the direction indicated by the two arrows.

A second conveyor track 24 for transporting individual trays 26 into which containers 16 are to be loaded is comprised of a substantially horizontal portion 24A and a substantially inclined portion 248, which is downstream of horizontal portion 24A. Inclined portion 24B is preferably comprised of a conveyor belt, which is wound around two opposed drive drums or pulleys 28A and 28B to form a continuous loop. An electric motor (not shown) or other suitable drive mechanism is preferably connected to drive drum 28A for driving inclined track 24B in the direction indicated by the appropriate arrows. Inclined track 24B further includes a plurality of support projections 30 arranged at predetermined intervals therealong for engaging the respective trailing edges 32 of trays 26 to push each tray 26 upwardly along inclined track 24B.

Figure 44:
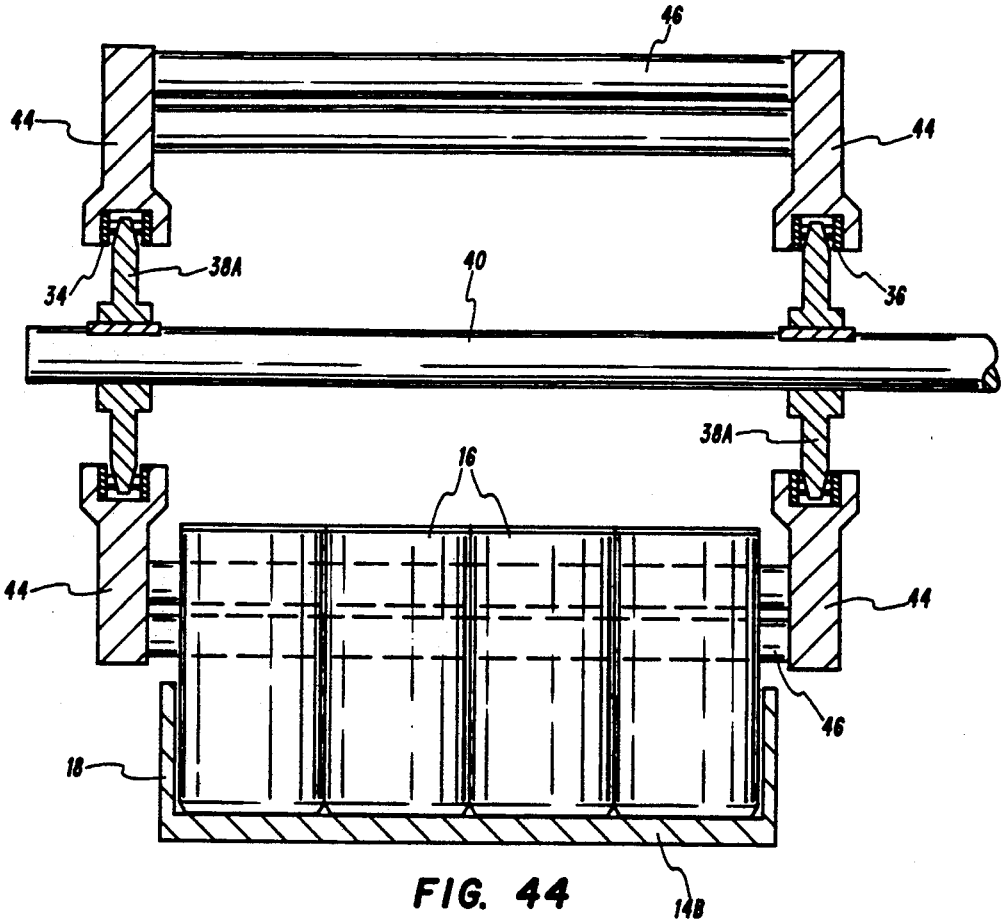
FIG. 44 is an end elevation view of the tray packing system shown in FIGS. 42 and 43, looking from the downstream side toward the upstream side.

Referring also to FIG. 44, containers 16 are transported along stationary track 14B by means of a chain and sprocket arrangement comprising second and third chain members 34 and 36 wound around respective sprocket members 38A and 38B to form respective continuous vertical loops in substantially parallel orientation with respect to one another, as best seen in FIG. 44. Each sprocket member 38A and 38B associated with second chain member 34 is coupled to the corresponding sprocket member 38A and 38B, respectively, associated with third chain member 36 by means of a common shaft 40, which fits within a complementary keyway in the corresponding sprocket member 38A and 38B, thereby allowing second and third chain members 34 and 36 to be driven together in respective continuous vertical loops. A drive motor 22, which is preferably a variable speed AC motor, is coupled to sprocket member 38A on second chain member 34 via pulleys 42A and belt 42B to impart rotational motion to sprocket member 38A and drive second chain member 34. Shaft members 40 connecting corresponding sprocket members 38A and 38B on the respective second and third chain members 34 and 36 transfer the drive force to third chain member 36 to drive third chain member 36 in conjunction with second chain member 34.

Second and third chain members 34 and 36 each have a plurality of flight bars 44 extending outwardly therefrom at predetermined intervals therealong. Each flight bar 44 on second chain member 34 is connected to the corresponding flight bar 44 on third chain member 36 by means of a series of rollers 46, which span the gap between the corresponding pairs of flight bars 44. Rollers 46 contact the trailing row in each group of containers 16 across substantially the entire width thereof, as best shown in FIG. 44, to move each group of containers 16 along stationary track 14B.

Second and third chain members 34 and 36 preferably include respective portions which extend downward at a gradual angle (for example, 5 °) with respect to the horizontal, as indicated at 34A by means of shoe plates 48. As flight bars 44 travel along a slightly descending path, they will contact the trailing row in each group of containers 16 at a lower point on each container than if fight bars 44 were moving horizontally. Therefore, containers 16 are less susceptible to being tipped over by the force exerted upon them by flight bars 44. Furthermore, the flight bars can be made of short length because inclined portions 34A allow the corresponding flight bars 44 to contact containers 16 at respective lower positions thereon. One skilled in the art will appreciate, however, that inclined portions 34A can be eliminated and second and third chain members 34 and 36 driven substantially horizontally, but that longer flight bars would have to be used to insure that contact is made low enough on the respective surfaces of containers 16 to prevent containers 16 from tipping over as a result of the force imparted thereto by flight bars 44.

Figure 45:
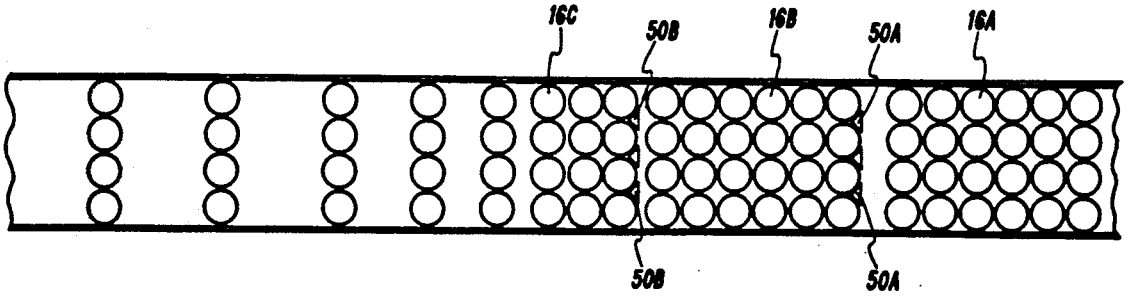
FIG. 45 is a top plan view illustrating the separation of individual beverage containers into discrete groups.

Referring to FIGS. 42 and 45, individual ones of containers 16 are separated into groups of twenty-four containers 16 in each group, corresponding to a standard case of containers. Finger-like dividers 50 are disposed at predetermined intervals along a plurality of mounting bars (not shown), which extend laterally between fourth and fifth sprocket-driven chain members 52 (only one of which is show in FIG. 42). Each chain member 52 is wound around a pair of sprockets 54A and 54B to form respective continuous vertical loops. Fourth and fifth chain members 52 are disposed in parallel relationship with respect to one another and driven together in much the same manner as second and third chain members 34 and 36 are driven together, as described above. Dividers 50 are preferably pivotally attached to their respective bars and hang vertically downward therefrom. A retaining bar 56 holds dividers 50A and 50B in a substantially rigid position when dividers 50A and 50B are interposed between containers 16. In an alternate embodiment, dividers 50 are held in a rigid position at all times and are therefore not able to swing freely with respect to their corresponding mounting bars.

Dividers 50 are interposed between selected rows of containers 16 on movable track 14A and dividers 50 are moved by fourth and fifth chain members 52 in the direction of movement of movable track 14A, but at a somewhat slower speed than movable track 14A so that a relative speed differential is maintained between those containers 16 on the downstream side of dividers 50A and those containers 16 on the upstream side thereof, as best illustrated in FIG. 45. If containers 16 are arranged as shown in FIG. 42, with six rows, each containing four containers 16 extending laterally across movable track 14A, each lateral mounting bar will have three dividers 50 extending therefrom so that one divider 50 is interposed between adjacent containers 16 in the leading row of each group of containers 16. Each set of dividers 50 on a particular mounting bar is separated from the next adjacent set by approximately the length of each group of containers 16, as measured longitudinally along movable track 14A. One skilled in the art will appreciate that containers 16 can also be arranged in groups of twenty-four containers 16 each, with four rows, each containing six containers 16. In that event, each lateral mounting bar will have five dividers 50 extending therefrom.

Respective portions 52A of fourth and fifth chain members 52 extend downwardly at a gradual angle (for example, 5o) with respect to a horizontal axis, to allow dividers 50 to move gradually downward over the tops of containers 16 into position between containers 16, as best illustrated by dividers 50C and 50D in FIG. 42. The operation of dividers 50 is timed so that a case consisting of twenty-four individual containers 16 will be grouped together between adjacent sets of dividers 50.

FIG. 45 illustrates three different cases of containers 16, each consisting of twenty-four individual containers 16, in the process of being formed on movable track 14A. Case 16A is moving downstream along movable track 14A at a relative speed differential with respect to case 16B because case 16A is no longer being held back by dividers 50. Thus, case 16A moves at the speed of movable track 14A, while case 16B is confined by first set of dividers 50A, which is in contact with the leading row of case 16B, thereby limiting the speed of movement of case 16B to the speed of movement of dividers 50A. Upstream of second set of dividers 50B, a third case 16C is being formed or has been formed as the individual containers 16 stack up on the upstream side of dividers 50B. As fourth and fifth chain members 52 continue their movement, dividers 50A will move upwardly and away from the leading row of case 16B to allow case 16B to move downstream at the speed of movable track 14A. The net result of the abovedescribed operation is that individual containers 16 will be grouped into cases consisting of twenty-four containers 16. Each case will be spaced apart sufficiently to allow the corresponding flight bars 44 to make contact with the trailing row of containers 16 in each case, as best seen in FIG. 42. One skilled in the art will appreciate that fourth and fifth chain members 52 may be positioned beneath movable track 14A in an alternate embodiment so that dividers 50 are interposed between containers 16 from underneath.

Referring to FIGS. 43 and 46A–46I, a ramp 56 is pivotally attached at the downstream end of stationary track 14B. Ramp 56 is mounted so as to be rotatable in an upward direction about an axis extending laterally across stationary track 14B. Ramp 56 includes an extension portion 58 which engages the under-surface of stationary track 14B to act as a stop and prevent ramp 56 from being rotated below a substantially horizontal position at the level of stationary track 14B. Each case of containers 16 is pushed off ramp 56 by the corresponding flight bar 44 into the corresponding tray 26. As each tray 26 moves up inclined track 24B, trailing edge 32 of the corresponding tray 26 that is being filled will contact ramp 56, causing ramp 56 to pivot upwardly to allow tray 26 to continue its upward movement along inclined track 24B.

Figure 46A:
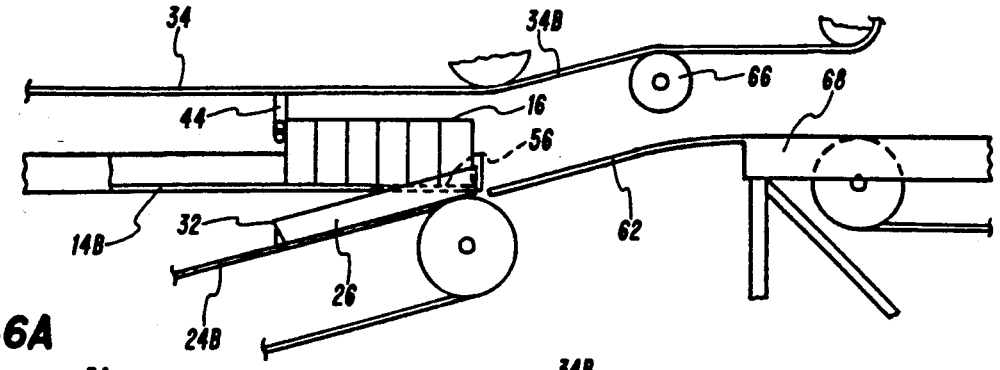
FIGS. 46A–46I are side elevation views of a portion of the tray packing system of FIGS. 42 and 43, showing the successive steps in which containers are loaded into the trays.
Figure 46B:
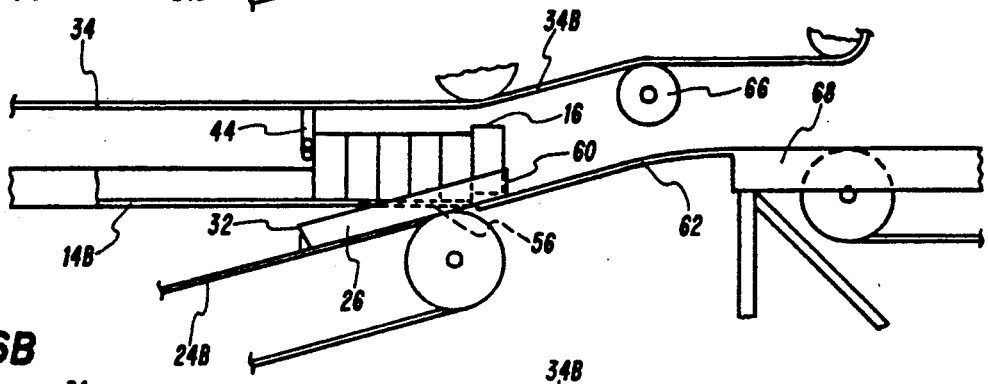
Figure 46C:
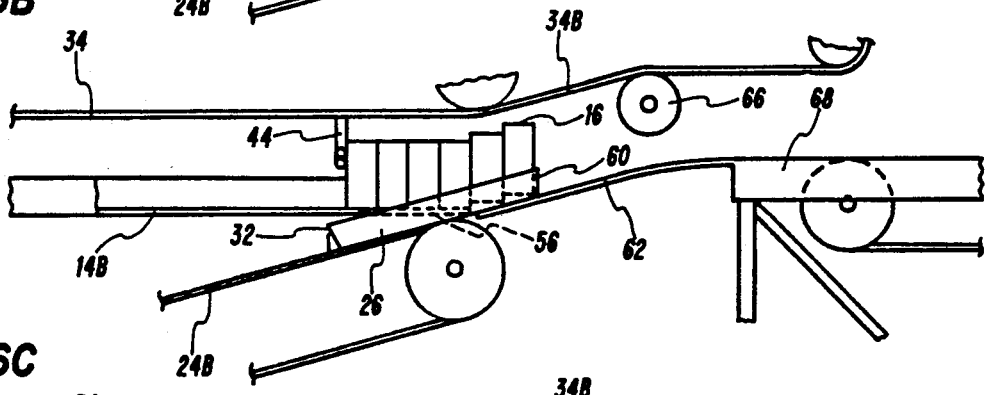
Figure 46D:
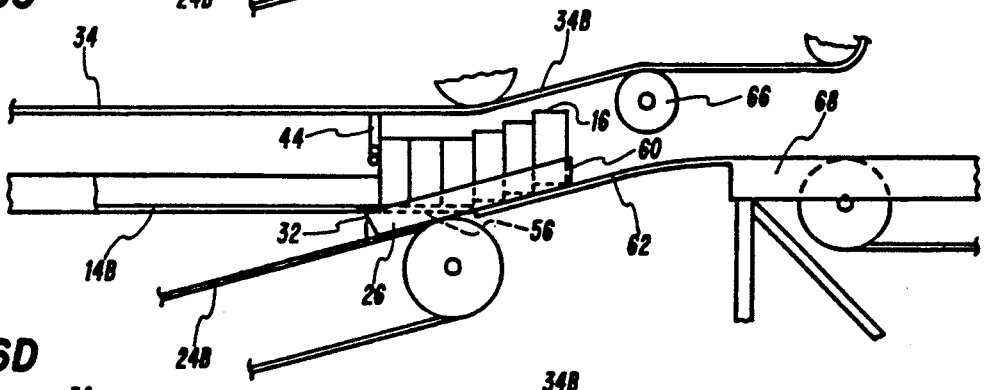

Referring specifically to FIGS. 46A and 46B, when the downstream end of ramp 56 clears leading edge 60 of each tray 26, ramp 56 will return to a substantially horizontal position. At this point, the leading row of containers 16 has reached the upstream edge of extension portion 58 of ramp 56. A corresponding flight bar 44 continues to push each case of containers 16 downstream and tray 26 continues to move upwardly along inclined track 24B so that the leading row of containers 16 is loaded into tray 26. The leading row is maintained in a substantially vertical orientation and is sandwiched between leading edge 60 of tray 26 and the second row of containers 16. The bottom surface of tray 26 is oriented at a substantially acute angle with respect to the corresponding bottom surfaces of containers 16 so that containers 16 appear to be "leaning forward" with respect to the bottom surface of tray 26. The second and third rows of containers 16 are loaded in tray 26 in substantially the same manner, as shown in FIGS. 46C and 46D, as flight bar 44 continues to push containers 16 downstream along stationary track 14B and the corresponding tray 26 continues its upward movement along inclined track 24B.

Figure 46E:
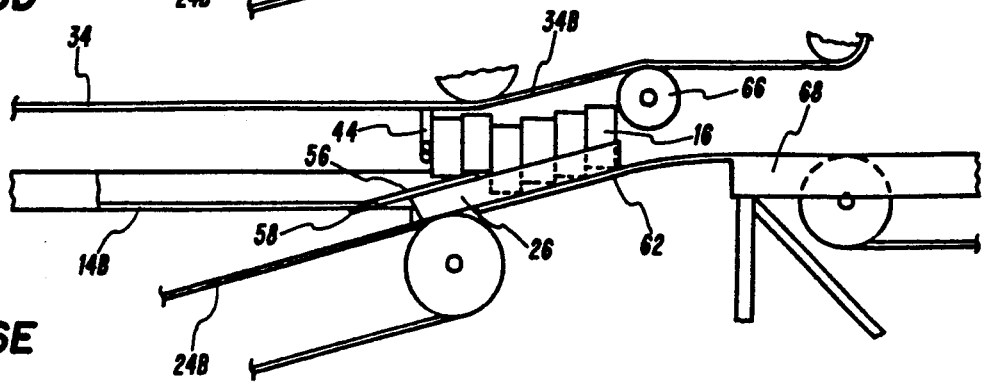
Figure 46F:
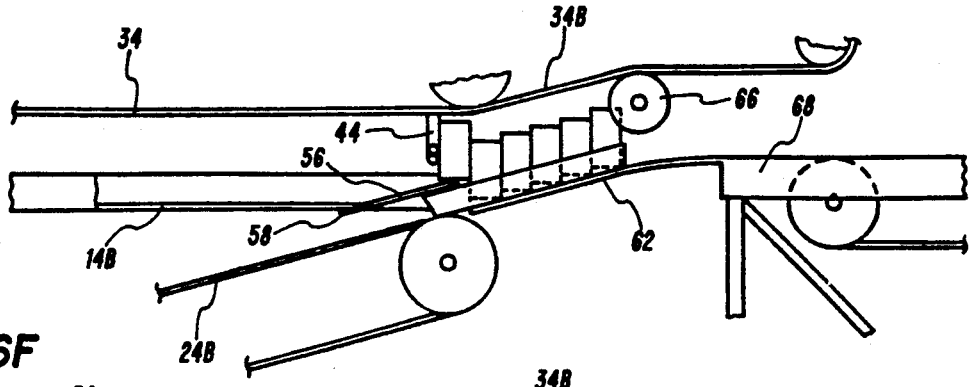
Figure 46G:
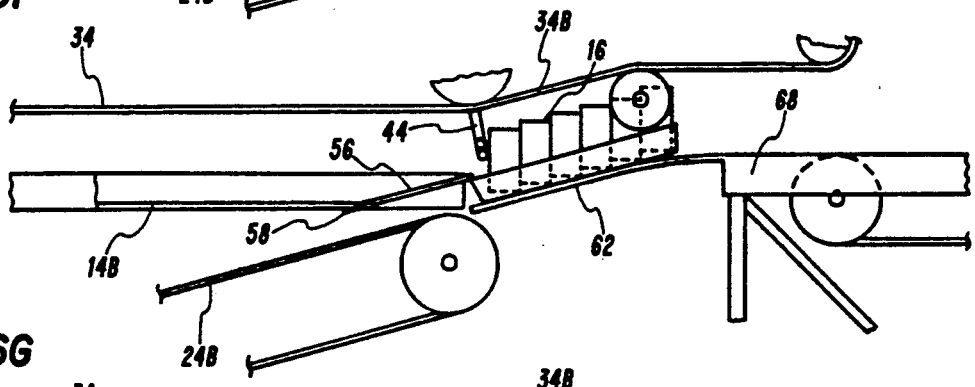

Referring specifically to FIG. 468, ramp 56 will begin to move upwardly again as it comes into contact with trailing edge 32 of tray 26. Thus, the fourth, fifth and sixth rows of containers 16 will be pushed off the front edge of ramp 56 by flight bar 44 and slide a short vertical distance downward into tray 26, as shown in FIGS. 46E, 46F and 46G. One skilled in the art will recognize that each row of containers 16 is maintained in a relatively stable vertical orientation during the packing process by the container row immediately in front and immediately behind it, except for the first container row, which is stabilized in front by leading edge 60 of the corresponding tray 26, and the sixth container row, which is stabilized from behind by flight bar 44. Side walls 48 on either side of ramp 56 stabilize containers 16 laterally as containers 16 are loaded into corresponding trays 26. After tray 26 has been filled with containers 16, each container 16 is in contact with the corresponding adjacent containers 16 in all directions and the containers on the outside of the configuration will be in contact with the corresponding adjacent walls of the tray to achieve a tightly packed configuration.

Figure 46H:
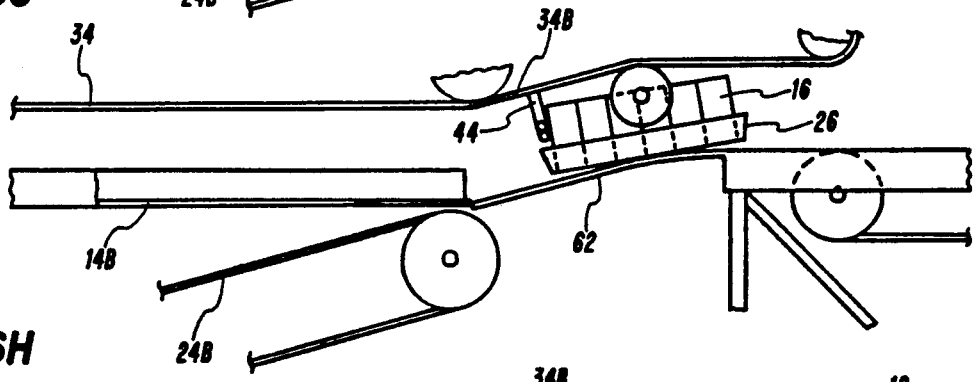

Referring to FIGS. 46G and 46H, all twenty-four containers 16 in each case are shown in the packed position within the corresponding tray 26 according to the above-described process. At this point, tray 26 is transported upwardly along a stationary inclined track 62 by the corresponding flight bar 44. Second and third chain members 34 and 36 are inclined upwardly, as shown at 34B, along substantially the same angle as inclined track 62, by means of a shoe plate 64 (FIGS. 42 and 43) or an idler sprocket 66 (FIGS. 46A–46I) so that the force imparted by the corresponding flight bar 44 will be directed substantially parallel with respect to inclined track 62.

Figure 46I:
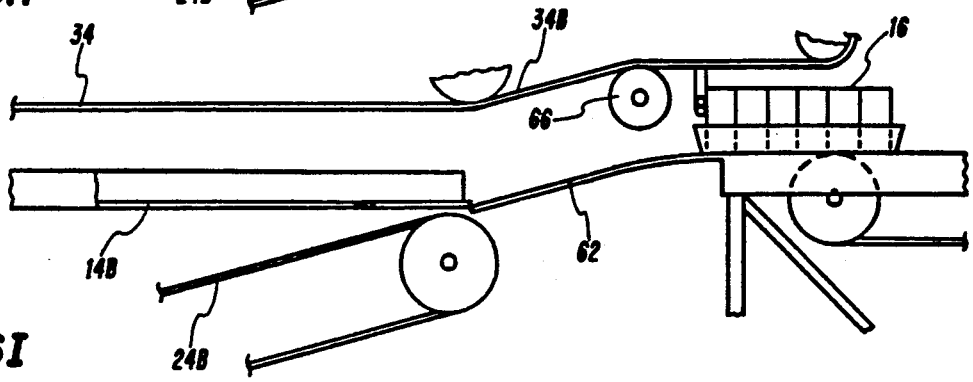

The corresponding bottom surfaces of each container 16 will remain oriented at an angle with respect to the bottom surface of tray 26 until tray 26 returns to a substantially horizontal position on a movable third conveyor track 68, as shown in FIGS. 46H and 46I. When tray 26 reaches a substantially horizontal position, containers 16 will "rock back" gently within tray 26 to achieve a stable, upright position for further transport Shortly after the loaded tray 26 is transported onto third conveyor track 68, flight bar 44 rotates upwardly around drive sprocket 38A and becomes disengaged from the trailing row of containers 16. Tray 26 is transported downstream by the drive mechanism (not shown) associated with third conveyor track 68 to the next destination.

The tray packing system according to the present invention includes separate apparatus (preferably adjustable speed AC motors) for driving first chain member 14A, second conveyor track 24 and second and third chain members 34 and 36. Fourth and fifth chain members 52 may be mechanically slaved to second and third chain members 34 and 36 so as to be driven thereby or, alternatively, fourth and fifth chain members 52 may be equipped with a separate drive apparatus, which is electrically slaved by means of a feedback loop to the drive apparatus for second and third chain members 34 and 36. In order to effect a smooth transition between movable track 14A on which containers 16 are transported and stationary portion 14B on which flight bars 44 impart the motive force to containers 16, the speed of second and third chain members 34 and 36 must be equal to or greater than the speed of fourth and fifth chain members 52. The apparatus for driving first chain member 14A, second conveyor track 24, second and third chain members 34 and 36 and fourth and fifth chain members 52 will hereinafter be referred to as Drive 1, Drive 2, Drive 3 and Drive 4, respectively.

In the embodiment described above with reference to FIGS. 46A–46I, ramp 56 is lifted up by trailing edge 32 of the tray 26 being packed and leading edge 60 of the next tray 26 in sequence. Referring to FIGS. 47 and 48, an alternate embodiment for lifting ramp 56 is depicted. A cam 70 is attached by means of a link pin 70A to each of second and third chain members 34 and 36 at predetermined locations therealong, just upstream of each flight bar 44. A push rod follower 72 is attached to extension portion 58 of ramp 56 on each side of stationary track 14B, for engaging cam 70 as cam 70 moves past push rod follower 72 along with the respective second third chain members 34 and 36.

Figure 47A:
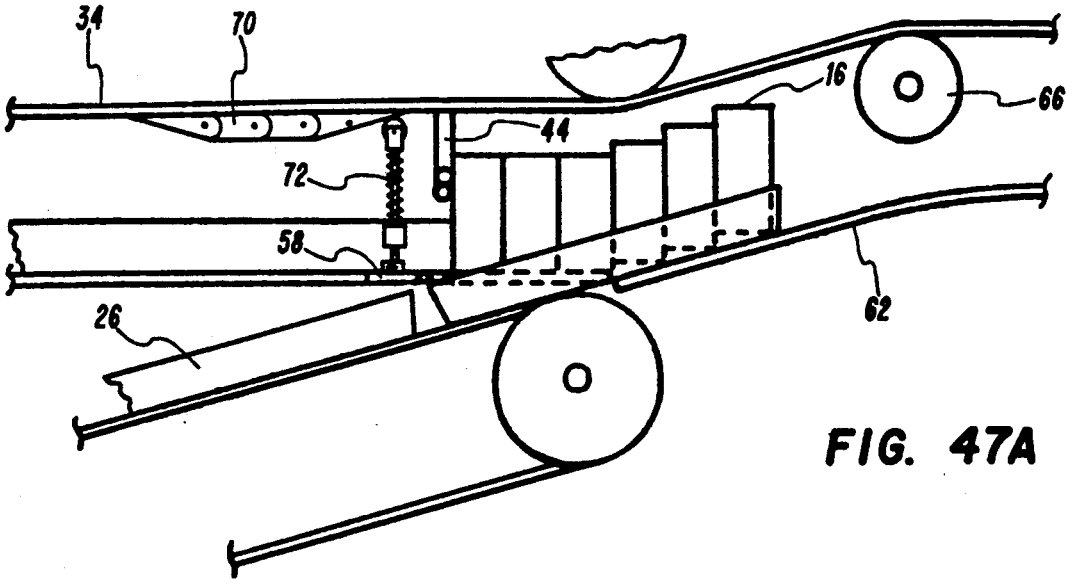
FIGS. 47A–47C are side elevation views of a portion of the tray packing system according to the present invention, showing a push rod follower mechanism for lifting the packing ramp on the container conveyor track.
Figure 48A:
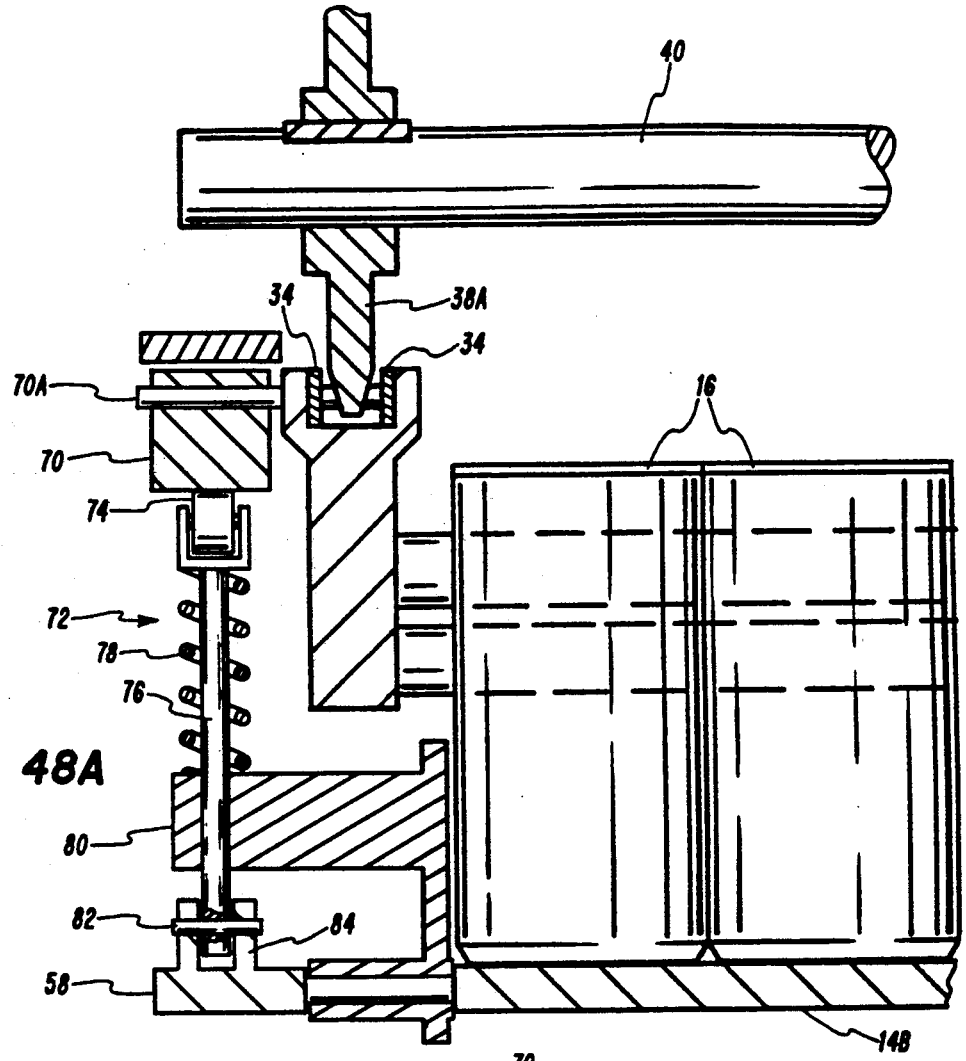
FIGS. 48A and 48B are respective sectional and side elevation views of the push rod follower mechanism shown in FIGS. 47A and 47B.
Figure 48B:
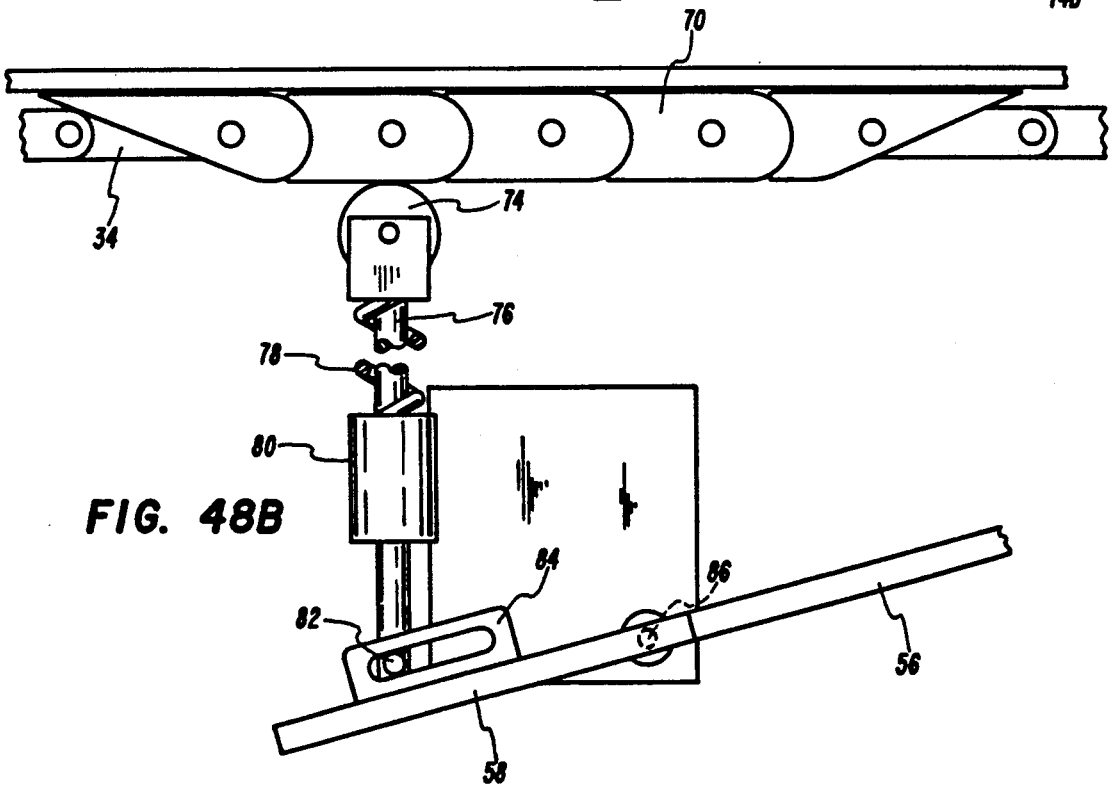

As best seen in FIGS. 48A AND 48B, push rod follower 72 is spring-biased toward the position shown in FIG. 47A, at which ramp 56 is in a substantially horizontal position as shown, push rod follower 72 includes a cam follower 74 for engaging cam 70, an elongated shaft 76 on which spring member 78 is mounted, a guide 80, which constrains shaft 76 to move in a substantially vertical direction, a pin member 82 extending perpendicularly with respect to the axis of shaft 76 and a slotted bracket 84 mounted on extension portion 58 of ramp 56.

Figure 47B:
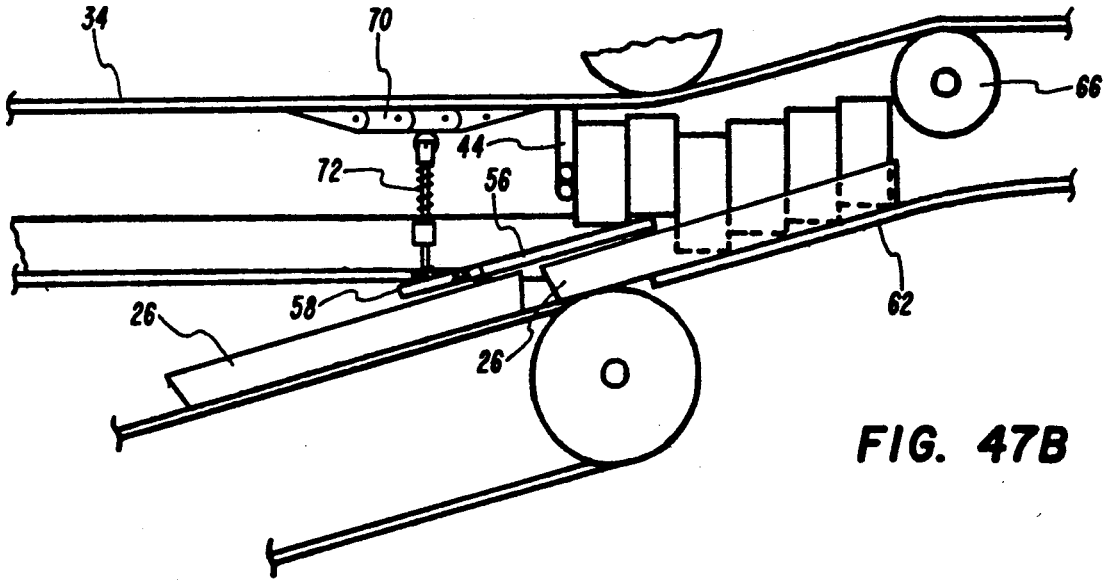
Figure 47C:
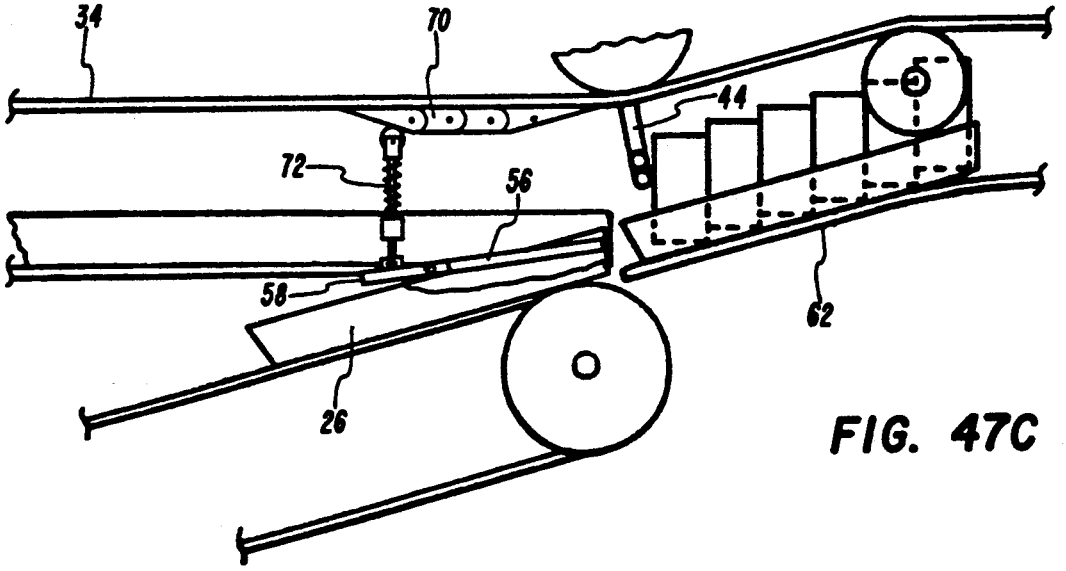

Referring specifically to FIGS. 47B, 48A and 48B, cam follower 74 is moved downwardly against the bias of spring member 78 as cam 70 passes over cam follower 74. When shaft 76 of push rod follower 72 is moved vertically downward by cam 70, it pushes down on extension portion 58, which pivots ramp 56 about pivot point 86, thereby raising ramp 56 upwardly to facilitate the passage of trays 26. Ramp 56 is lifted as required without relying on the lifting action of trailing edge 32 of the tray 26 being filled and leading edge 60 of the next tray 26 in sequence, which may cause stresses and possible damage to the edges of trays 26. Cam 70 and push rod follower 72 will cooperate to lift ramp 56 at the point where trailing edge 32 of each tray 26 contacts ramp 56, as best shown in FIG. 47A. Thus, the length of cam 70 must be greater than the longitudinal extent of containers 16 remaining on ramp 56 and not yet loaded into the corresponding tray 26. For example, in FIG. 47A, three rows of containers 16 are shown resting on ramp 56. Cams 70 are of sufficient length to hold the corresponding push rod followers 72 in a downward position to maintain ramp 56 in a raised position as shown until all of containers 16 have been loaded into the corresponding tray 26 and leading edge 60 of the next tray 26 in sequence has cleared the downstream end of ramp 56 to allow the next case of containers 16 in sequence to be loaded into the next tray 26 in sequence in the same manner as described above. Cams 70 are positioned on respective second and third chain members 34 and 36 so that the leading edge of each cam 70 will contact cam follower 74, as shown in FIG. 47A, at or just prior to when trailing edge 32 of the corresponding tray 26 would contact ramp 56 downstream of pivot point 86, as shown in FIG. 47A.

Figure 49A:
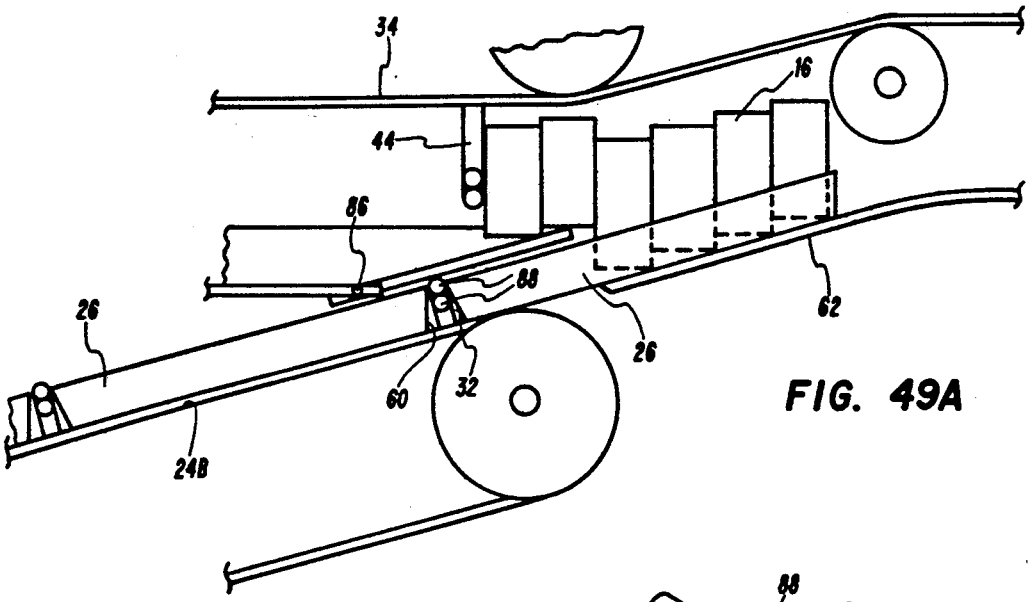
FIGS. 49A and 49B are respective side elevation and perspective views of a first roller mechanism used to lift the packing ramp according to the present invention.
Figure 49B:
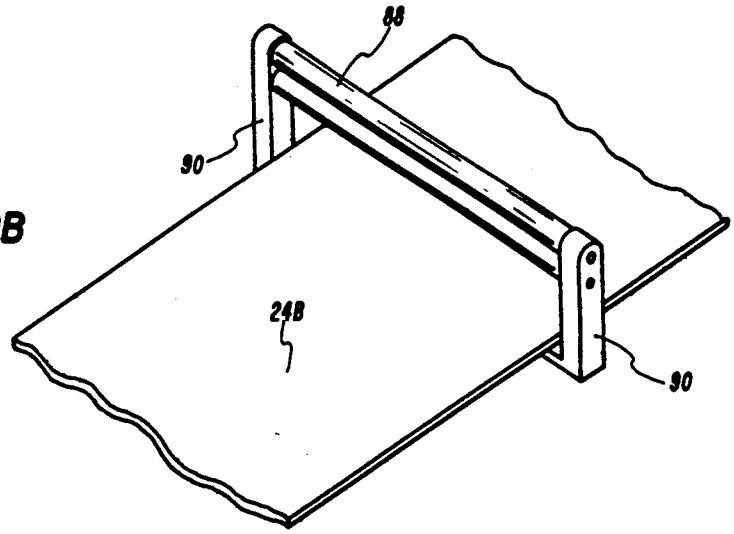

Referring to FIGS. 49A and 49B, an alternate embodiment of an apparatus for selectively lifting ramp 56 is depicted. Each tray 26 is sandwiched between a pair of rollers 88 adjacent to both leading edge 60 and trailing edge 32 of each tray 26. Rollers 88 are mounted at their respective opposite ends on support bars 90, which are positioned on opposite sides of second conveyor track 24B and are movable along with second conveyor track 24B. The upper roller 88 extends upwardly slightly higher than the upper edge of the corresponding tray 26, as best seen in FIG. 49A so that upper roller 88 engages ramp 56 and lifts it up to pave the way for tray 26 to pass beneath ramp 53 unobstructed. The corresponding rollers 88 positioned behind trailing edge 32 of each tray 26 operate in substantially the same manner to lift ramp 56 as trailing edge 32 passes underneath ramp 56, as best seen in FIG. 49A.

Figure 50:
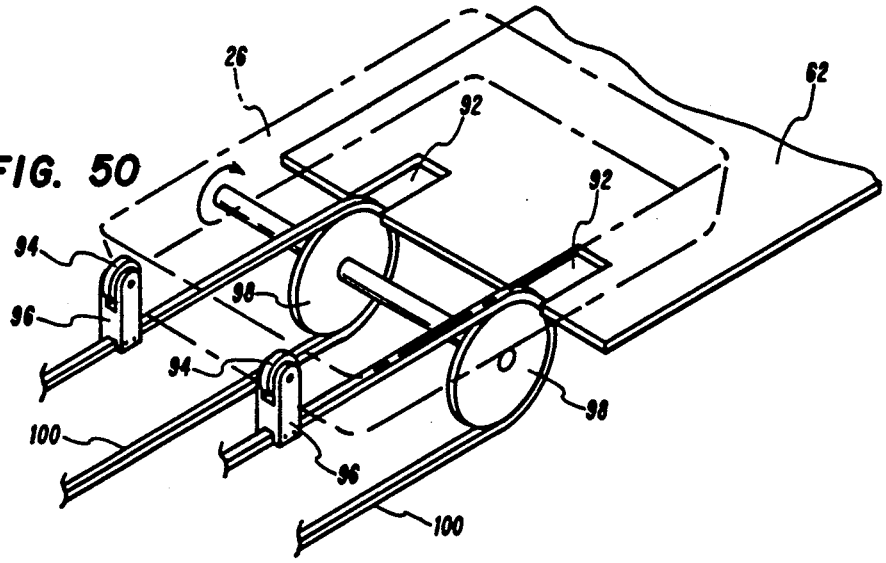
FIG. 50 is a perspective view of a second roller mechanism used to lift the packing ramp according to the present invention, illustrating the transition between movable and stationary portions of the tray conveyor track in the tray packing system according to the present invention.

Referring to FIG. 50, yet another embodiment for raising ramp 56 is depicted. The upstream edge of stationary inclined track 62 has a pair of longitudinally oriented slots 92 disposed therein for allowing a pair of rollers 94, which are mounted on respective support stands 96, to reverse directions around respective drive sprockets 98 as the respective chain members 100 reverse directions. In the embodiment shown in FIG. 50, second conveyor track 24B is comprised of parallel chain members 100 on which trays 26 are transported. Rollers 94 extend upwardly above the upper edge of each tray 26 so as to lift up ramp 56 in substantially the same manner as described above with reference to rollers 88 in FIGS. 49A and 49B. Each tray 26 is sandwiched between respective pairs of rollers 94 adjacent to leading edge 60 and trailing edge 32 of each tray 26.

Figure 51A:
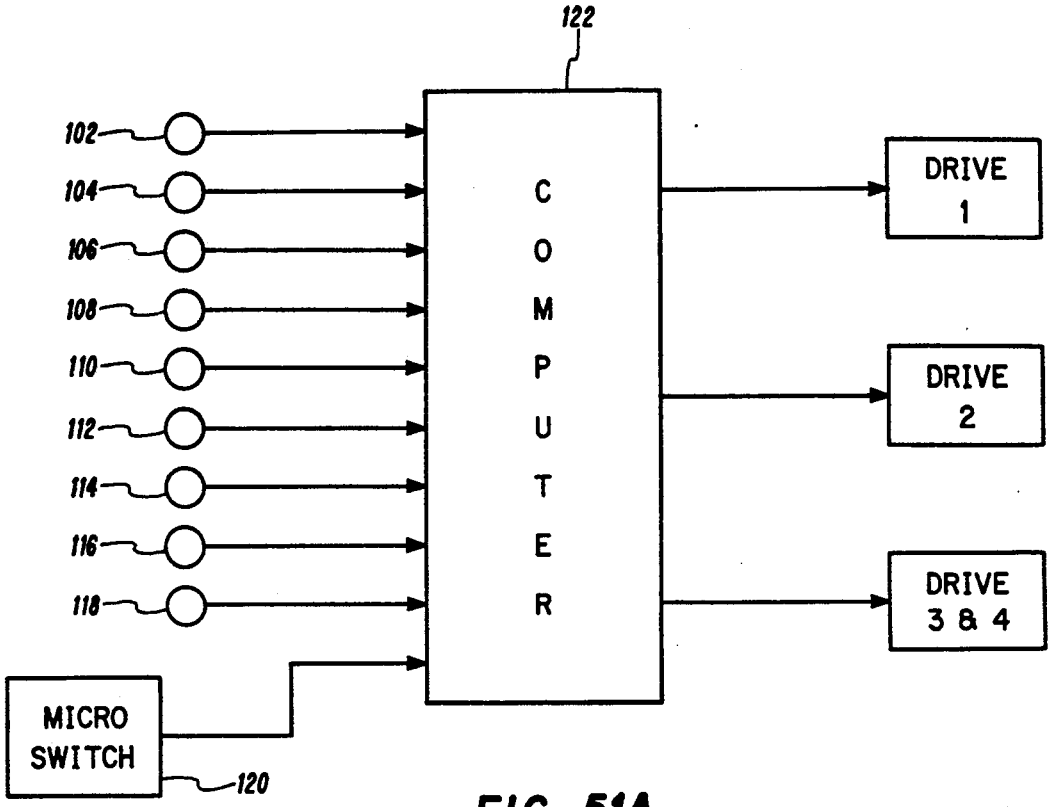
FIGS. 51A and 51B are block diagrams of the computer control apparatus for the tray packing system according to the present invention.
Figure 51B:
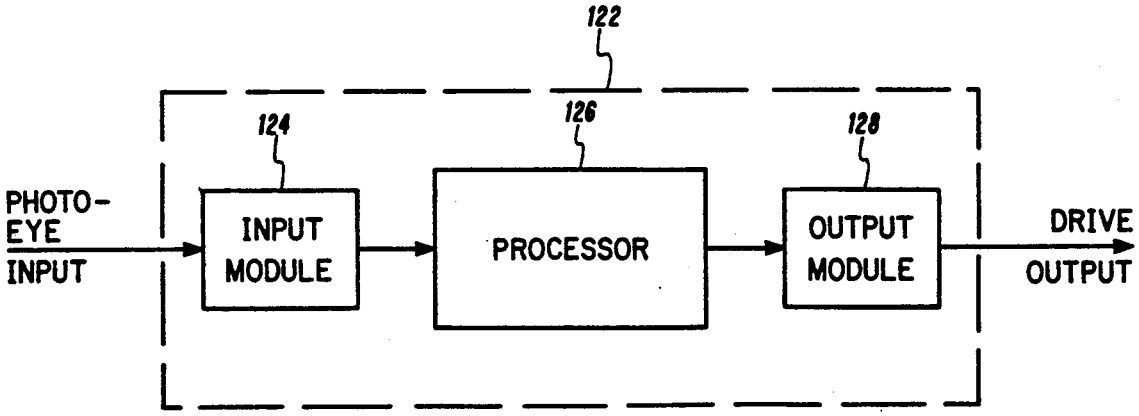

Referring again to FIG. 42 and also to FIGS. 51A and 51B, tray packing system 12 in accordance with the present invention uses a plurality of sensors to detect the presence and movement of containers 16 and trays 26 on their respective tracks. The sensors used may be photoelectric detectors (i.e., photoeyes), proximity switches, electromechanical microswitches or other suitable devices. Nine such sensors 102, 104, 106, 108, 110, 112, 114, 116, and 118 are positioned as shown in FIG. 42. The control algorithm for tray packing system 12 will be described below with reference to photoeyes as being the primary sensors. One skilled in the art will appreciate, however, that other types of sensors as mentioned above can be used to achieve substantially the same result and that the invention is not limited to the use of photoeye sensors. In addition to the nine photoeyes selectively positioned at various locations along the conveyor tracks, a microswitch 120 is used to detect the position of ramp 56 (i.e., whether ramp 56 is in the horizontal position or in the raised position). When ramp 56 is in the raised position, the microswitch is closed and an electrical signal indicative thereof is generated. On the other hand, when ramp 56 is in the horizontal or "down" position, the microswitch will remain open so that no electrical signal is generated.

Referring specifically to FIGS. 51A and 51B, the heart of the control system is a digital computer 122, which receives inputs from photoeyes 102–118 and from microswitch 120 and controls the operation of Drives 1, 2, 3 and 4. Drives 1, 2 and 3 preferably include respective variable speed AC motors for driving first chain member 14A, second conveyor track 24B, and second and third chain members 34 and 36, respectively. Drive 4, which includes fourth and fifth chain members 52 and sprocket members 54A and 54B, is preferably mechanically slaved to Drive 3 so as to be driven in conjunction therewith.

Referring to FIG. 51B, computer 122 includes an input module 124 for receiving input signals from the various photoeyes 102–118 and microswitch 120 and reducing the voltage of the input signals to a voltage suitable for information processing by processor 126. Processor 126 is responsive to the various sensor input signals for generating respective output signals to control Drives 1, 2, 3 and 4. An output module 128, which includes one or more inverters for converting DC voltage to AC voltage, increases the voltage of the output control signals from processor 126 to operate the AC motors associated with Drives 1, 2 and 3.

Referring to FIG. 42, photoeyes 102 and 104 cooperate to detect any gaps in the flow of containers 16 along movable track 14A. The distance between photoeyes 102 and 104 is preferably less than or equal to the length of each case of containers 16, as measured longitudinally along first track 14A. Both photoeyes 102 and 104 are located upstream of leading edge 130 of fourth and fifth chain members 52. Photoeye 106 is positioned to indicate the presence of a complete case of containers 16 between dividers 50A and 50B. photoeye 108 is used during system start-up to properly position dividers 50 to engage containers 16. Photoeye 110 is located at the upstream end of ramp 56 and is used to detect the presence of containers 16 on stationary track 14B in the area of ramp 56. Photoeye 112 is located adjacent to inclined track 24B for detecting the presence of trays 26 in the packing area. Photoeye 114 is located at the downstream end of ramp 56, above the level of trays 26, for detecting the presence of containers 16 on ramp 56. Sensors 116 and 118 cooperate to detect the presence of a blockage in the system downstream on third conveyor track 66.

Figure 52:
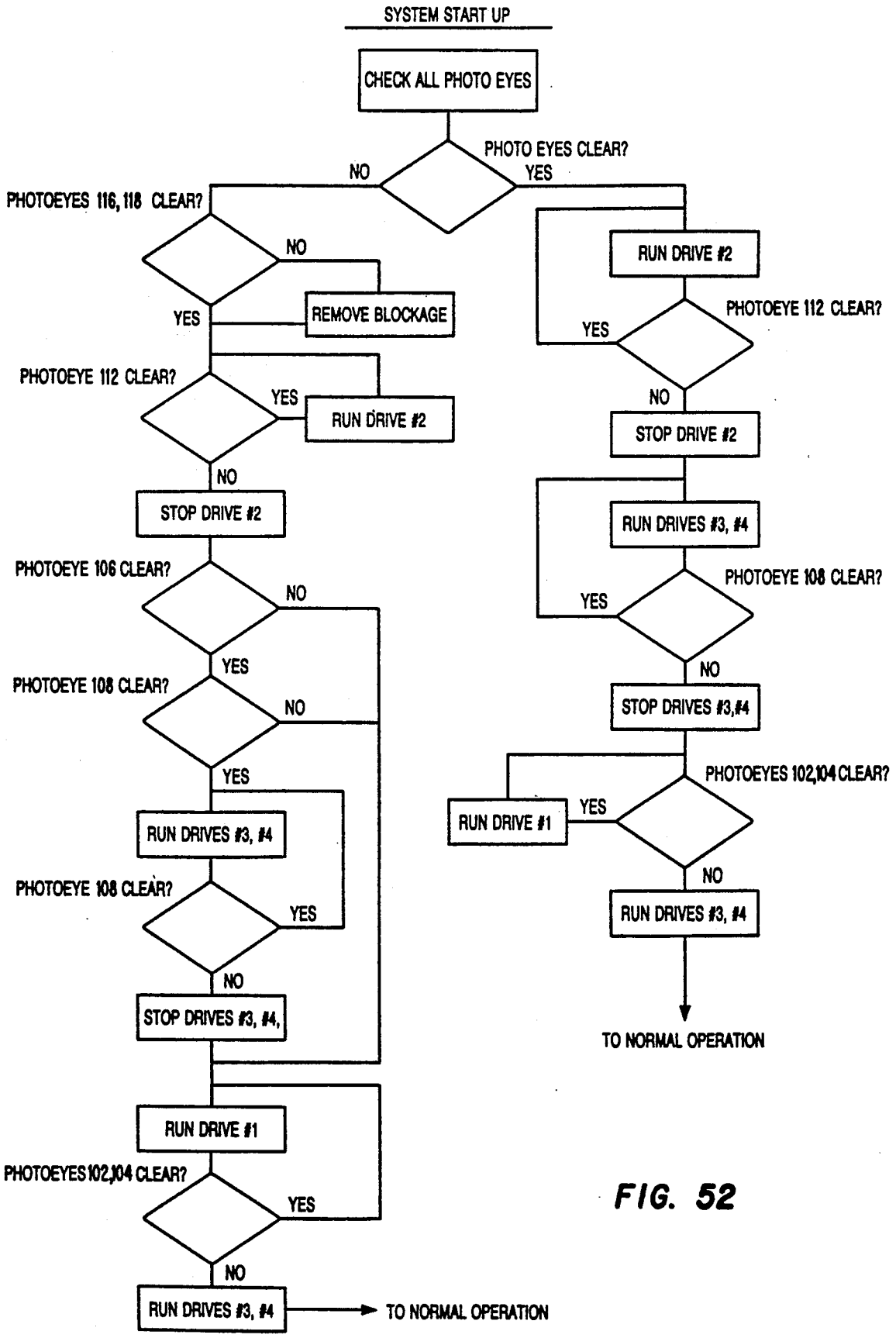
FIGS. 52-55 are flow diagrams illustrating the control algorithm for the tray packing system according to the present invention.
Figure 53:
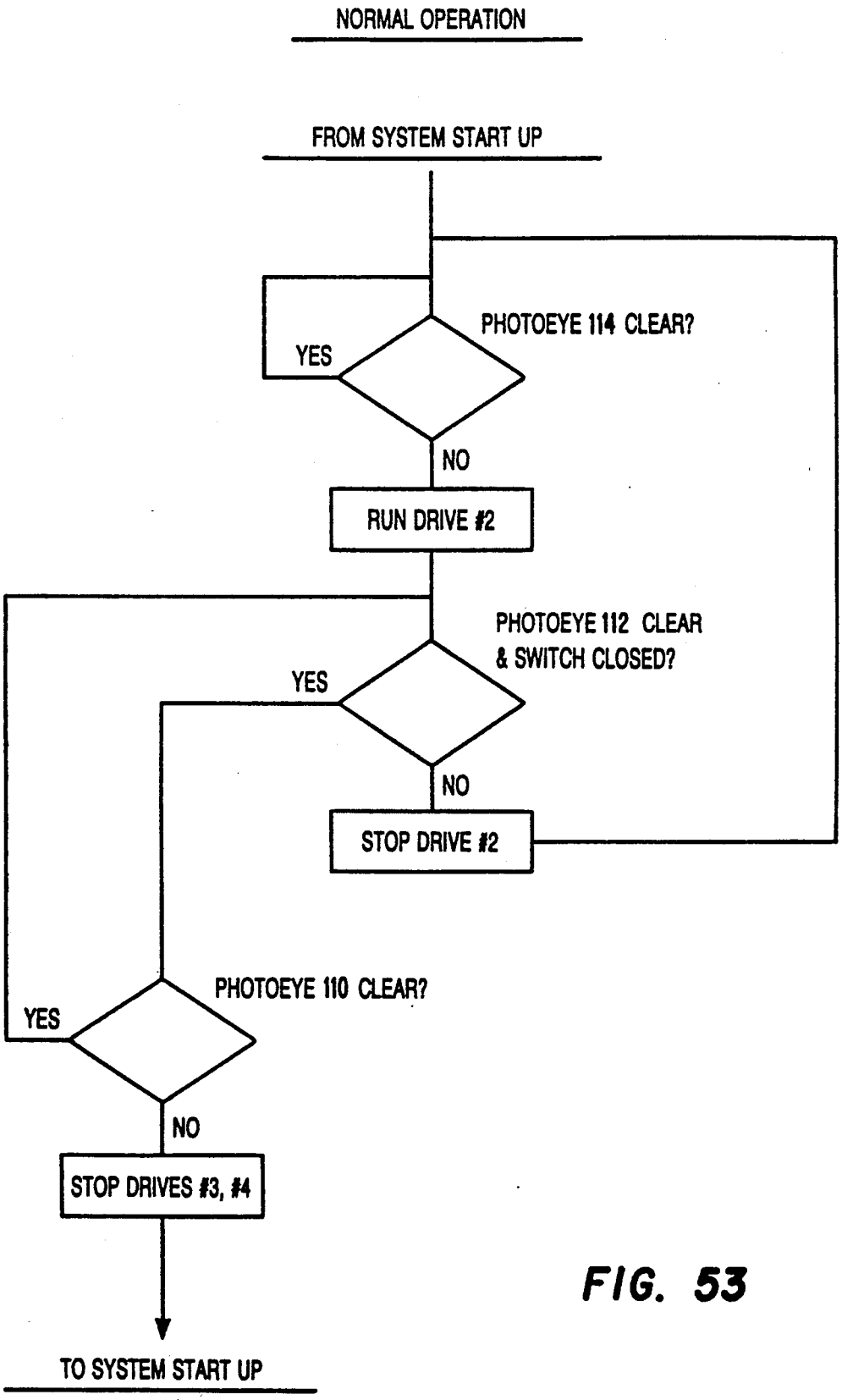

Referring to FIGS. 52–55, the control algorithm for tray packing system 12 is depicted by a series of flow diagrams. The control algorithm is preferably preprogrammed in computer 122. Referring to FIG. 52, the System Start-Up routine is depicted. If all photoeyes are "clear" (i.e., not "blocked" by an object such as container 16 or tray 26), computer 122 will operate Drive 2 until photoeye 112 is blocked, which indicates that a tray 26 is in the proper position for receiving container 16. At this point, Drive 2 is stopped and computer 122 activates Drives 3 and 4 until photoeye 108 is blocked, which indicates that dividers 50 are properly positioned to engage containers 16. Drive 1 is then started to bring containers 16 into engagement with dividers 50. When photoeyes 102 and 104 are blocked, indicating the presence of containers 16 at both positions, Drives 3 and 4 are restarted and the system enters the "Normal Operation" mode, as depicted in FIG. 53.

If, however, all of the photoeyes do not indicate "clear" at the beginning of System Start-Up, the program will branch to the sequence of steps indicated on the left side of FIG. 52. If photoeyes 116 and 118 are blocked, this indicates the presence of a downstream blockage on third conveyor track 66. This blockage must be removed so that photoeyes 116 and 118 are clear. Photoeye 112 is then checked to determine whether a tray 26 is in position at ramp 56 to receive containers 16. If photoeye 112 is clear, Drive 2 is run until Photoeye 112 is blocked, which indicates that a tray 26 is properly positioned, at which time Drive 2 is stopped.

Photoeye 106 is then checked to determine whether containers 16 are properly positioned between dividers 50. If photoeye 106 is not clear, Drive 1 is activated. When photoeyes 102 and 104 indicate the presence of containers 16, Drives 3 and 4 are also activated and the system enters the "Normal Operation" mode.

If photoeye 106 is clear, photoeye 108 will be checked to determine whether dividers 50 are properly positioned if photoeye 108 is blocked, Drive 1 will be activated to bring containers 16 into position. If photoeye 108 is clear, Drives 3 and 4 are activated until dividers 50 are in the proper position, which will occur when photoeye 108 is blocked Drives 3 and 4 will then be stopped and will be re-started when photoeyes 102 and 104 are blocked, whereupon the system enters the "Normal Operation" mode.

Referring to FIG. 53, the normal operation of tray packing system 12 is depicted. Drive 1 runs continuously, Drive 2 runs upon demand to keep trays 26 in proper position and Drives 3 and 4 run continuously until certain conditions occur or an emergency signal is sent to stop the entire system. During normal operation, photoeye 114 is continually checked to insure that containers 16 are in the packing position on ramp 56. Drive 2 is not activated to move trays 26 until photoeye 114 is blocked. Drive 2 will be run until photoeye 112 is blocked by a tray 26 and microswitch 120 is open (i.e., ramp 56 is horizontal). If tray 26 is not properly positioned, as indicated by photoeye 112 being clear or by microswitch 120 being closed, photoeye 110 will be checked to determine whether containers 16 are getting ready to enter the packing position on ramp 56. If photoeye 110 is blocked, Drives 2 and 4 will be stopped and the System Start-Up routine, as indicated in FIG. 52, will be used to begin operation of the system anew. If, on the other hand, photoeye 110 is clear, photoeye 112 and microswitch 120 will be checked again and Drive 2 will be stopped if a tray 26 is in the proper position to receive containers 16 (i.e., photoeye 112 is blocked and microswitch 120 is open).

Figure 54:
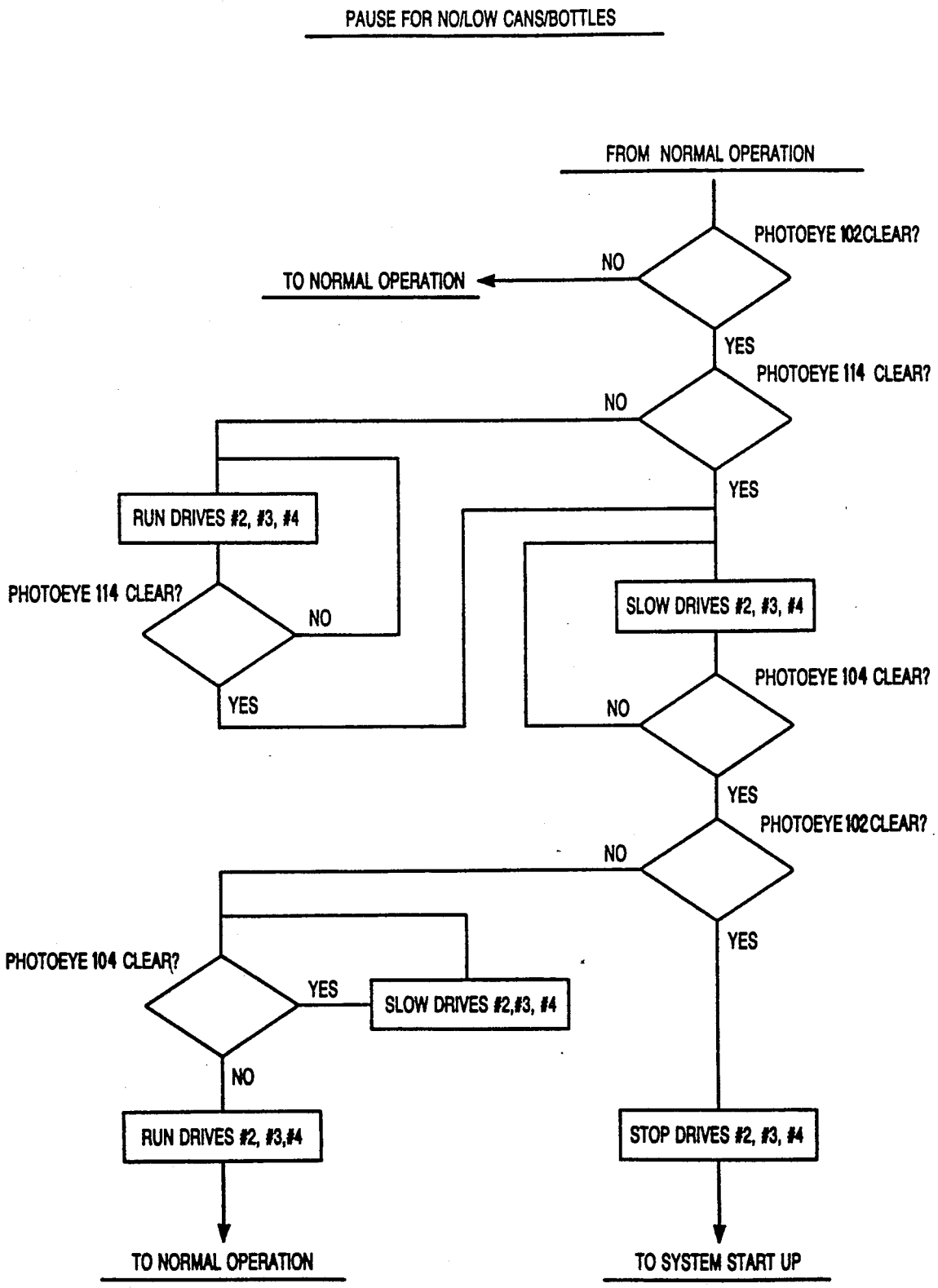

Referring to FIG. 54, an absence or an insufficient number of containers 16 on first conveyor track 14A may cause temporary pauses in the operation of tray packing system 12. If photoeye 102 is clear, photoeye 114 will be checked to see if containers 16 are in the packing position on ramp 56. If photoeye 114 is clear, Drives 2, 3 and 4 will be slowed to approximately one-half their normal rates. If photoeye 114 is blocked, Drives 2, 3 and 4 will continue to run at normal speed to allow those containers 16 on ramp 56 to be loaded into the corresponding tray 26. If, after those containers 16 have been loaded, photoeye 114 indicates clear, Drives 2, 3 and 4 will be slowed. Photoeye 104 acts as a secondary indicator of a no/low container condition. If photoeye 104 is clear at the same time that photoeye 102 is clear, Drives 2, 3 and 4 will be stopped. If photoeye 102 is blocked, photoeye 104 will be checked and if it is also blocked, Drives 2, 3 and 4 will be run at full speed. If photoeye 102 is blocked and photoeye 104 is clear, Drives 2, 3 and 4 will run at slow speeds until both photoeyes 102 and 104 are blocked, which indicates sufficient containers 16 on movable track 14A for normal system operation. If Drives 2, 3 and 4 are stopped, which occurs when both photoeyes 102 and 104 are clear at substantially the same time, the System Start-Up routine will be used to continue operation of the system.

Figure 55:
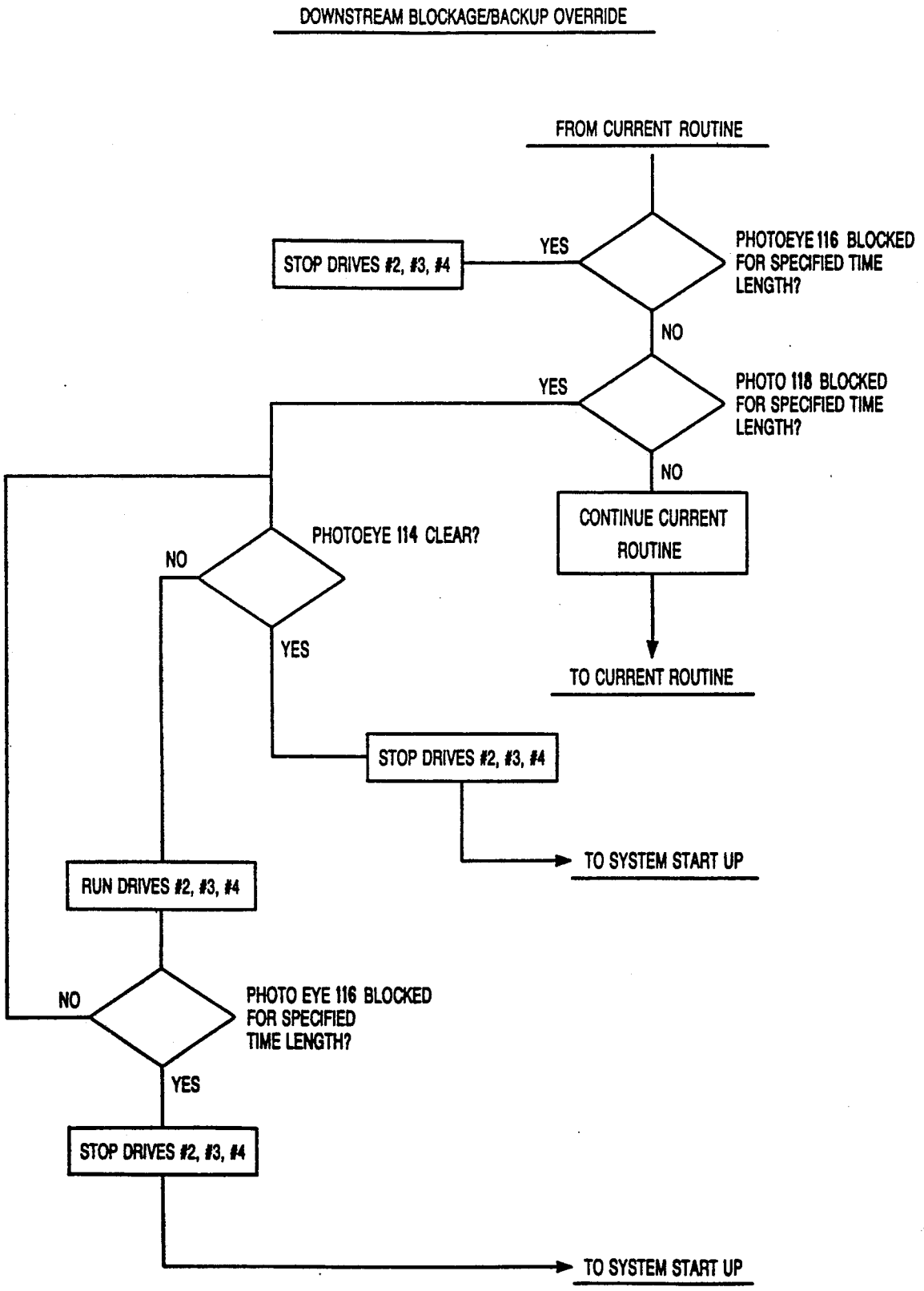

Referring to FIG. 55, the control algorithm includes a sub-routine for detecting downstream blockage on third conveyor track 66. This sub-routine is run prior to all decision points in the System Start-Up, Normal Operation and Pause for No/Low Containers modes, as described with reference to FIGS. 52, 53 and 54. If photoeye 116 is blocked for a specified length of time (i.e., the normal length of time for a case of containers 16 to pass photoeye 116 plus a certain percentage of that time) Drives 2, 3 and 4 are stopped. If photoeye 116 is not blocked, but photoeye 118 is blocked for the aforementioned specified length of time, photoeye 114 will be checked to determine if containers 16 are in the packing position on ramp 56. If photoeye 114 is blocked, Drives 2, 3 and 4 will be run until either photoeye 116 is blocked for the specified length of time or until photoeye 114 is clear, indicating that there are no containers 16 in the packing position on ramp 56. When Drives 2, 3 and 4 are stopped, the program will branch to the System Start-Up mode, as depicted in FIG. 52.

Figure 56A:
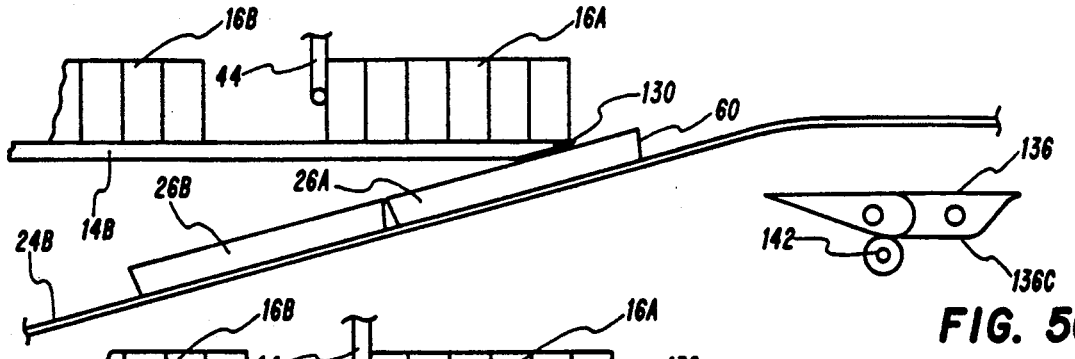
FIGS. 56A-56F illustrate the sequence of steps in the packing operation in which reciprocating support members are used in lieu of the packing ramp.
Figure 56B:
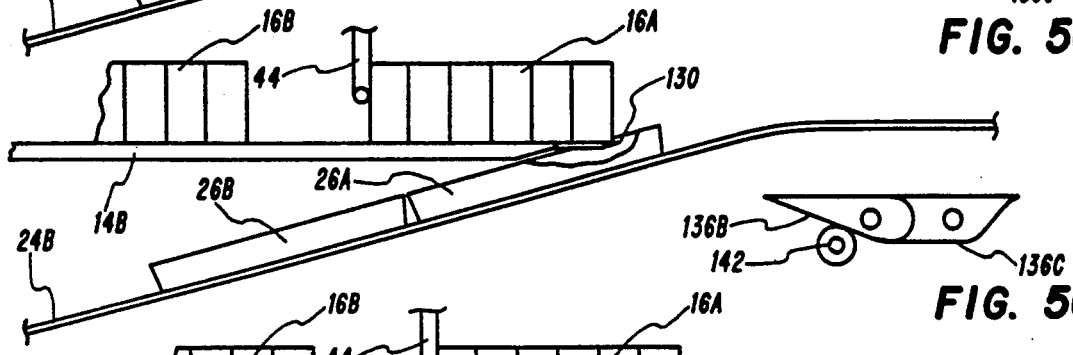
Figure 56C:
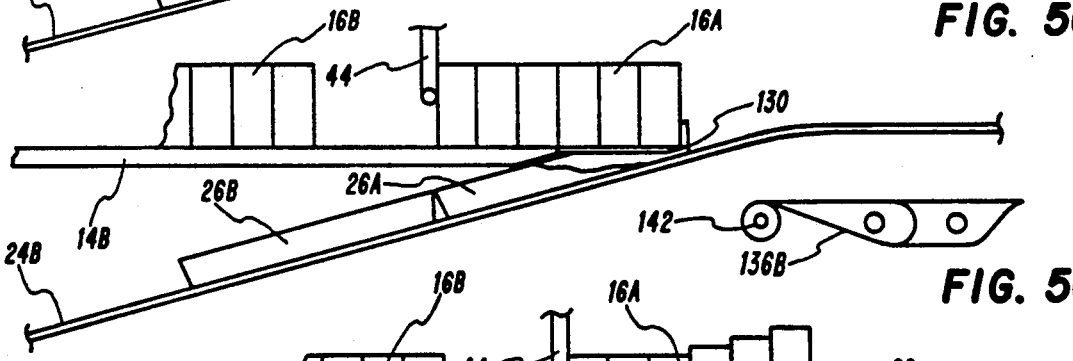
Figure 56D:
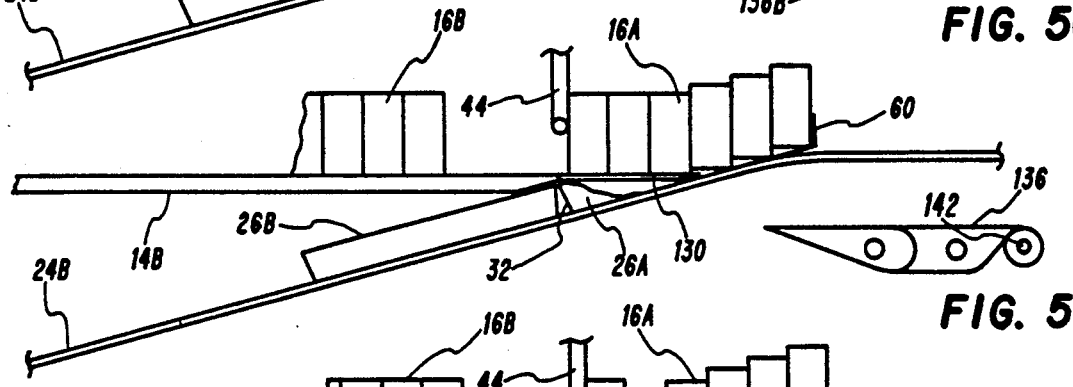
Figure 56E:
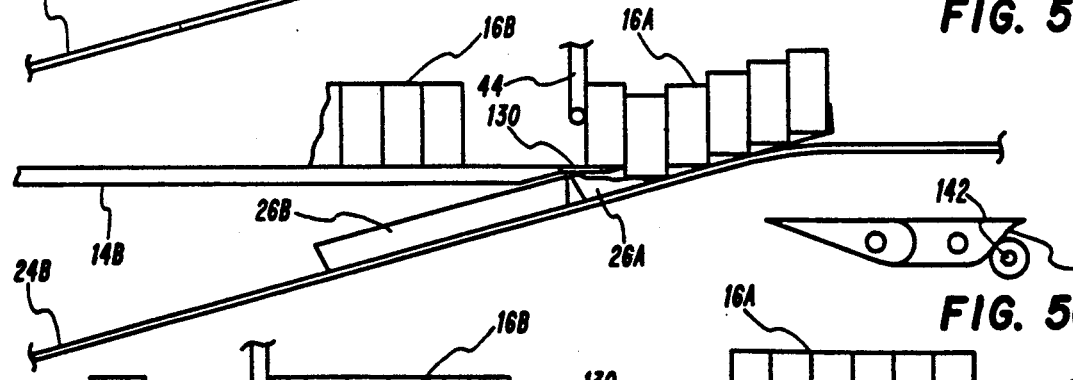
Figure 56F:
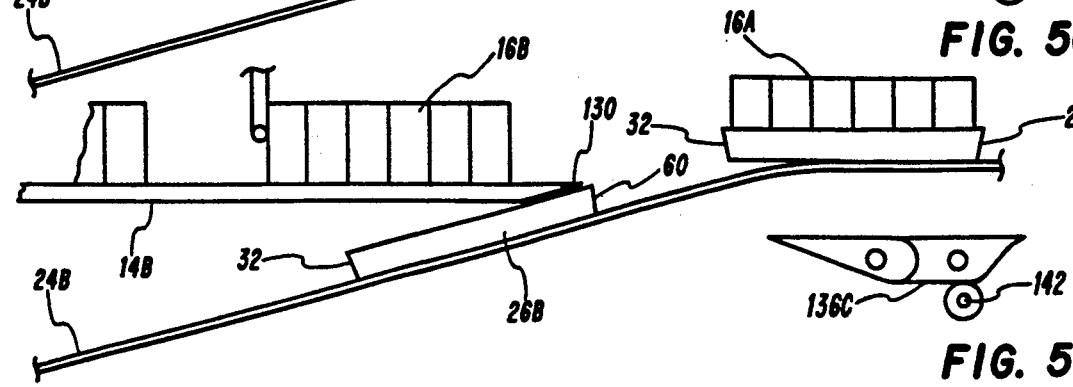
Figure 57:
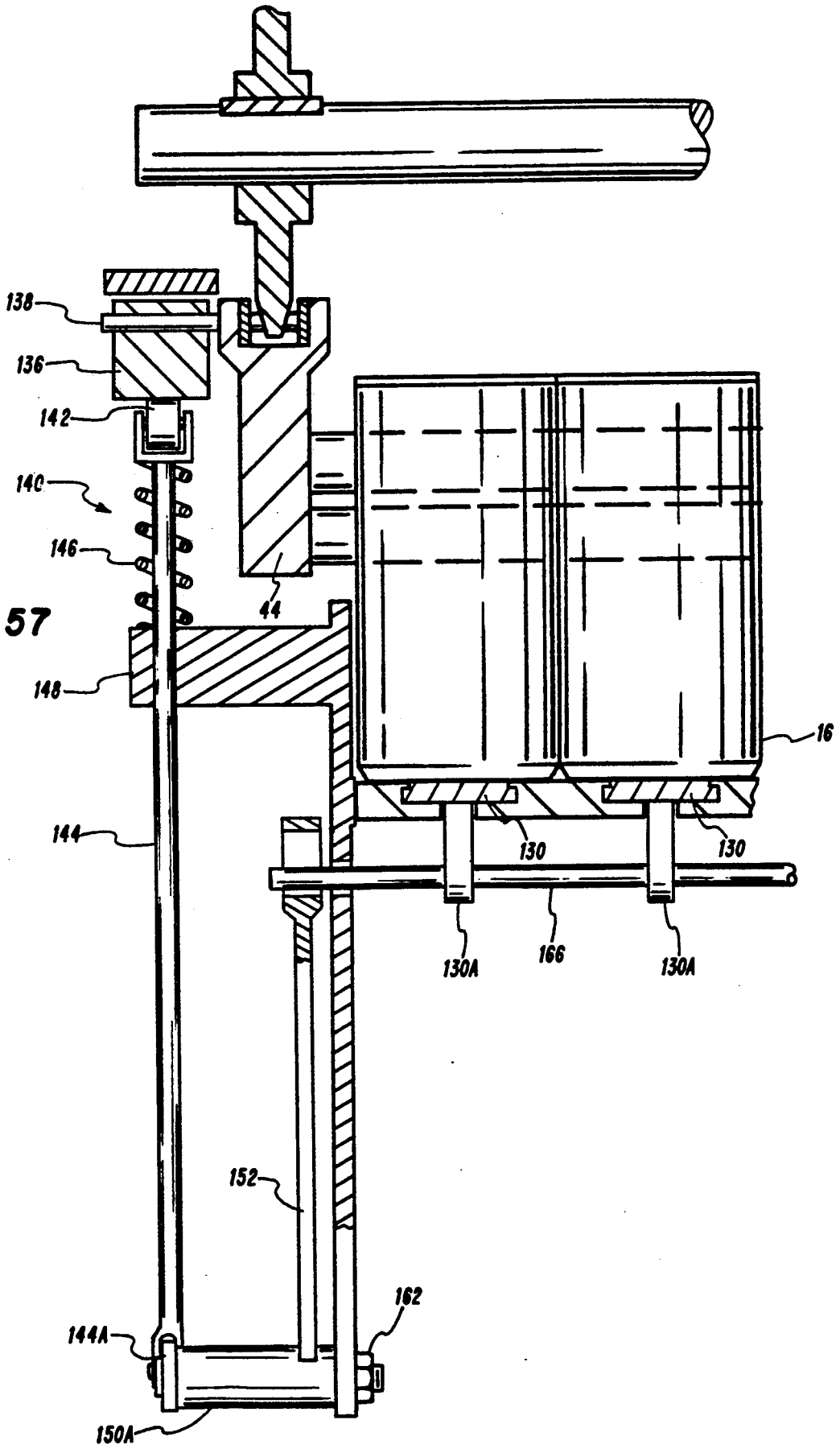
FIG. 57 is an end elevation view of the push rod follower mechanism used to operate the support members shown in FIGS. 56A-56F.
Figure 58:
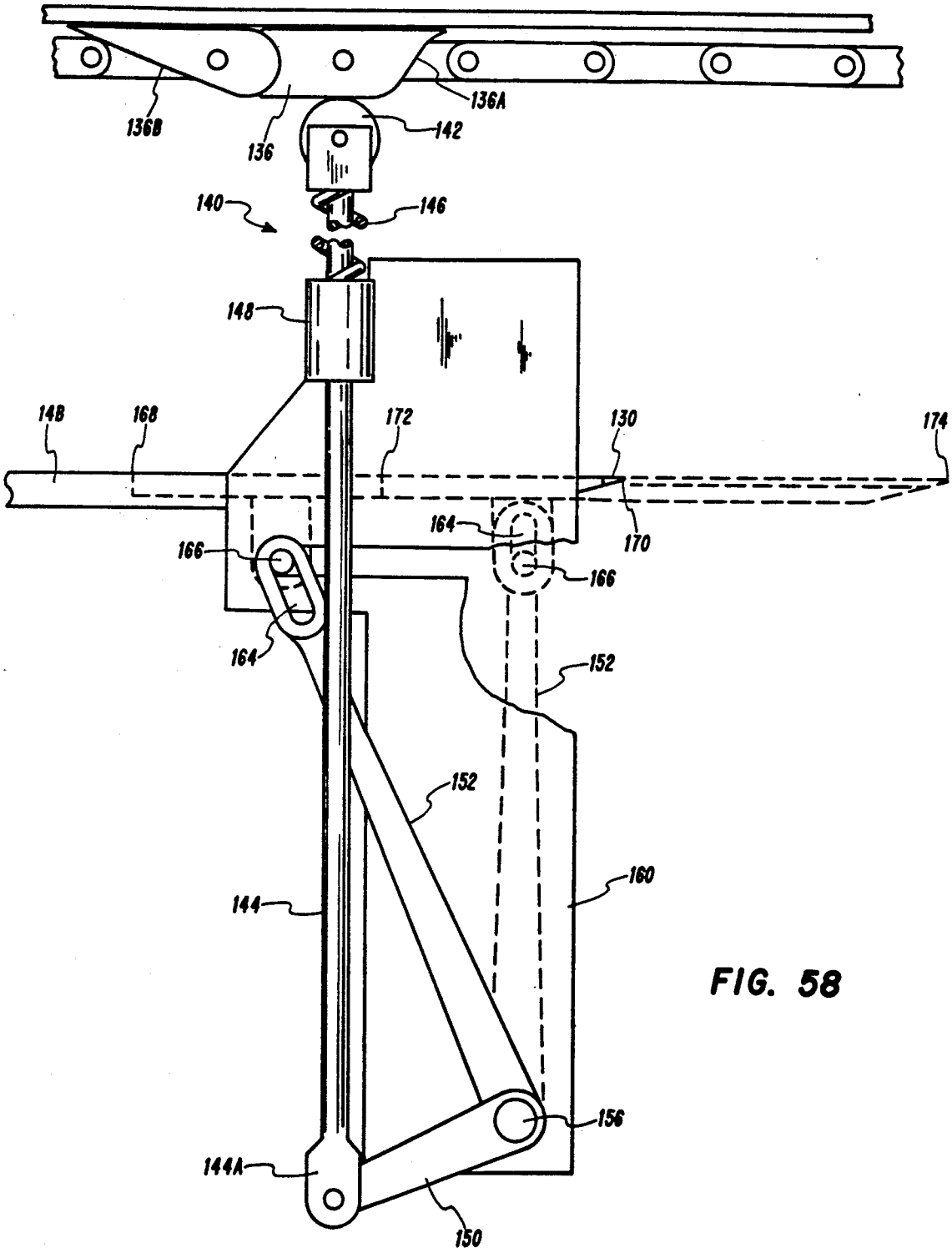
FIG. 58 is a side elevation view of the push rod follower mechanism shown in FIG. 57.
Figure 59:
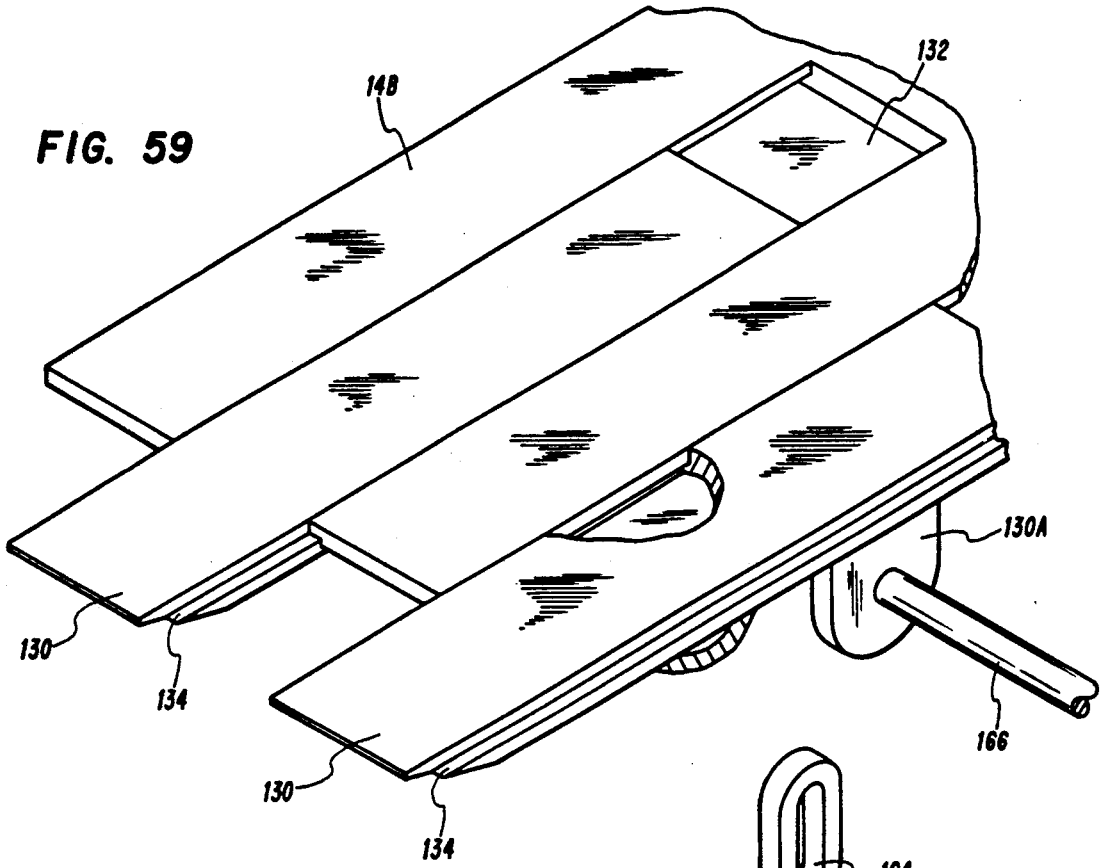
FIG. 59 is a perspective view of tbe reciprocating support members.

Referring to FIGS. 56–60, an alternate embodiment of the tray packing system according to the present invention is depicted. Instead of pivotally attaching a ramp member at the downstream end of stationary track 14B, a plurality of reciprocally moveable support members 130 are disposed at the downstream end of stationary track 14B, adjacent to the intersection of inclined track 24B with stationary track 14B. As best seen in FIGS. 57 and 59, each support member 130 is received within a corresponding elongated opening 132 in stationary track 14B. Each support member 130 is preferably comprised of a relatively flat, elongated member, having respective projecting portions 134 extending longitudinally on opposite sides thereof. Projecting portions 134 engage respective facing surfaces of stationary track 148 to constrain the corresponding support member 130 from moving along a vertical axis which is normal with respect to the major surface of stationary track 14B.

As each group of containers 16 is moved into position for being packed into the corresponding tray 26, each column of containers 16 (in which individual containers 16 are oriented longitudinally with respect to stationary track 14B) of the corresponding group will be journally supported from below by a corresponding one of support members 130. Thus, the number of support members 130 will be the same as the number of columns in the corresponding group of containers 16. For example, if a group consists of a standard case of twenty-four containers 16, the group may be arranged so that each row has four containers and each column has six containers. In that event, the number of columns and the number of support members 130 are each equal to four. Only two columns and two corresponding support members 130 are depicted in FIG. 57.

Reciprocating motion is imparted to support members 130 as follows. A plurality of cams 136 are attached by means of respective link pins 138 to each of second and third chain members 34 and 36 at predetermined locations therealong. A push rod follower mechanism 140 is mounted on each side of stationary track 14B for engaging each cam 136 as each cam 136 moves past push rod followers 140 along with the respective second and third chain members 34 and 36.

Each push rod follower 140 includes a cam follower 142 for engaging cams 136, an elongated shaft 144 on which spring member 146 is mounted, a guide 148, which constrains shaft 144 to move in a substantially vertical direction, an L-shaped member 150 and an elongated arm member 152. Shaft 144 includes a forked portion 144A at one end thereof for being attached to a first end of L-shaped member 150 by means of a pin member 154, as best seen in FIG. 55. Arm member 152 is attached at one end thereof to a second end of L-shaped member 150 so that arm member 152 will rotate together with L-shaped member 150. Shaft 144 is attached to L-shaped member 150 in such a manner that the vertical motion of shaft !44 will impart rotary motion to L-shaped member 150 and arm member 152. L-shaped member 150 includes a sleeve portion 150A having a central bore for receiving a shoulder bolt 156 therethrough. Shoulder bolt 156 extends through the central bore in sleeve portion 150A and through opening 158 in a mounting plate 160, which is attached to stationary track 14B. An hexagonal nut 162 engages the end of shoulder bolt 156, which penetrates through opening 158 to attach push rod follower mechanism 140 to stationary track 14B.

As best seen in FIG. 58, the vertical motion of shaft 144 is converted to rotary motion of L-shaped member 150 and arm member 152, which in turn imparts reciprocating motion to support members 130. At the opposite end of arm member 152 from the end which is secured to sleeve portion 150A is an elongated slot 164 in which an end portion of a connecting rod 166 is received. When cam followers 142 are in engagement with respective cams 136, as shown in FIG. 58, the spring bias of spring member 146 will be overcome, thereby moving shaft 144 downwardly and causing L-shaped member 150 and arm member 152 to rotate in a counterclockwise direction when viewed from the perspective of FIG. 60. This motion causes the end of arm member 152 at which elongated slot 164 is disposed to move upstream along stationary track 14B. This upstream motion is transmitted to support members 130 by means of connecting rod 166, which is attached to the respective tongue portions 130A of support members 130, to move support members 130 to their retracted positions. When support members 130 are fully retracted, their respective upstream ends are approximately at the position indicated at 168 and their respective downstream ends are approximately at the position indicated at 170. The respective downstream ends of support members 130 and stationary track 14B are beveled to facilitate the passage of trays 26 as trays 26 move upwardly along inclined track 24B.

Figure 60:
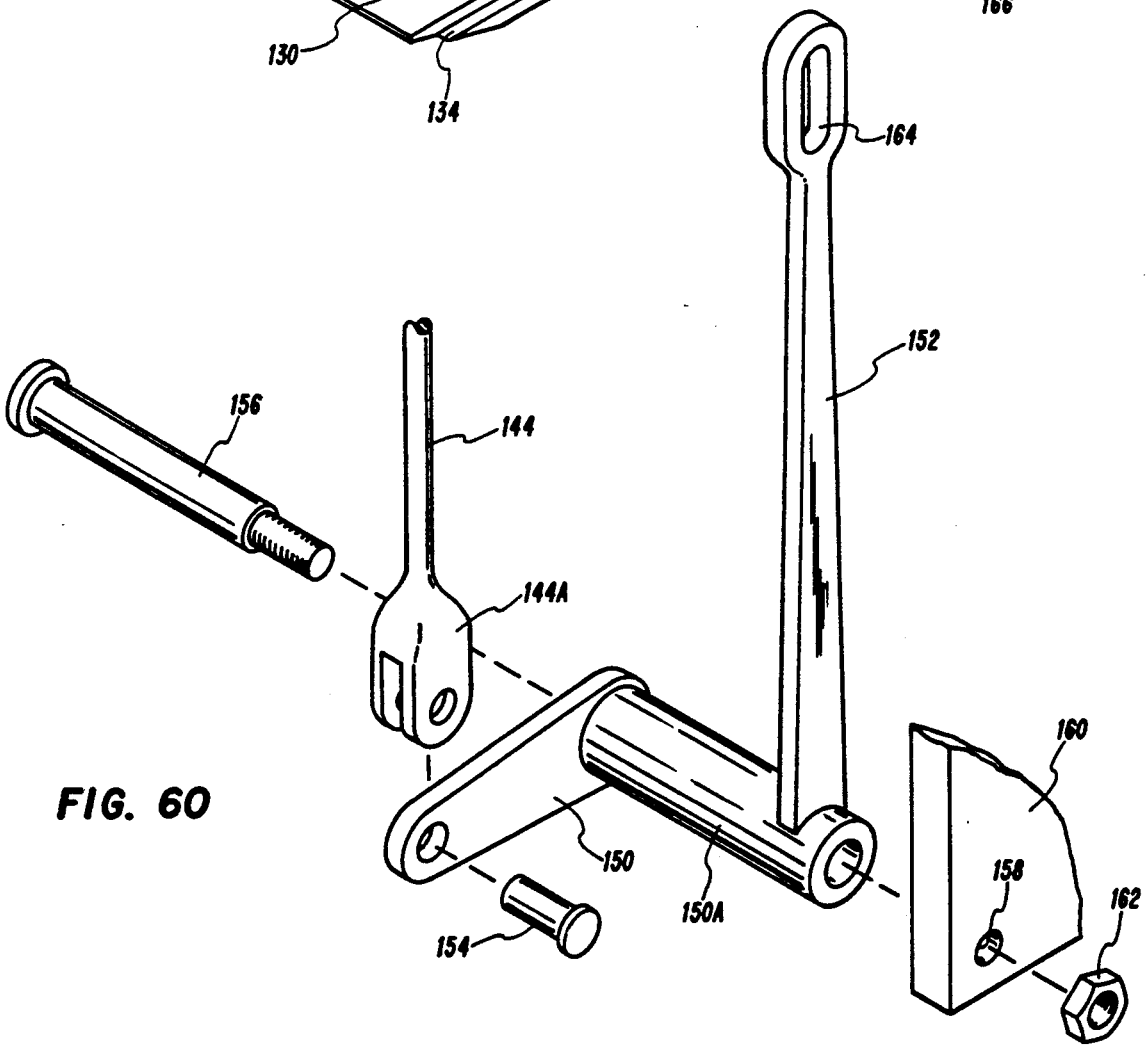
FIG. 60 is a perspective view of the major components of the push rod follower mechanism.

Conversely, when cam followers 142 are not in engagement with respective cams 136, the spring bias of spring member 146 will move shaft 144 upwardly, which will impart rotary motion to L-shaped member 150 and arm member 152 in a clockwise direction when viewed from the perspective of FIG. 60. This rotary motion in turn causes the end of arm member 152 at which elongated slot 164 is disposed to move downstream. This downstream motion will be imparted to support members 130 by means of connecting rod 166 so that support members 130 will be moved to their fully extended position. When support members 130 are in the fully extended position, their respective upstream ends are approximately at the position indicated at 172 and their respective downstream ends are approximately at the position indicated at 174. When support members 130 are in their fully extended position, arm member 152 will be oriented substantially vertically, as indicated by the dashed lines in FIG. 58. Leading surface 136A of each cam 136 is sloped more than trailing surface 136B so that support members 130 will be moved from the fully extended position to the fully retracted position faster than they will be moved from the fully retracted position to the fully extended position to ensure that sufficient clearance is available for the passage of trays 26.

FIGS. 56A-56F illustrate the sequence of packing a group of containers 16A into a tray 26A. The relative positions of cam followers 142 and the corresponding cams 136 at the respective positions in the packing sequence are illustrated alongside the corresponding positions. As shown in FIG. 56A, support members 130 are fully retracted when cam followers 142 engage the relatively flat central portions 136C of the corresponding cams 136. At this point, leading edge 60 of tray 26A has cleared the downstream end of track 14B and the leading row of containers of group 16A is at the downstream end of track 14B. In FIG. 56B, cam followers 142 engage the corresponding trailing surfaces 136B, the slope of which allows support members 130 to gradually return to their fully extended position, as shown in FIG. 56C. In FIG. 56C, support members 130 are fully extended and are received within the mouth of tray 26A. The leading three rows of containers 16 in container group 16A are being journally supported by support members 130. Cam followers 142 are disengaged from the corresponding cams 136.

FIGS. 56D and 56E illustrate the packing of container group 16A into tray 26A in sequence from leading edge 60 to trailing edge 32. The leading rows slide smoothly off support members 130 into tray 26A as flight bars 44 continue to push containers 16 off the downstream ends of support members 130 and tray 26A continues to move upwardly along track 24B. Support members 130 will remain fully extended until cam followers 142 engage the respective leading surfaces 136A of the next set of cams 136 in sequence, as shown in FIG. 56E. Support members 130 will begin to retract and those containers 16 still on support members 130 when the retractive motion begins will travel a short vertical distance downward into tray 26A (although less than the vertical distance required when ramp member 56 is used).

In FIG. 56F, cam followers 142 are shown in engagement with the respective central portions 136C of the corresponding cams 136 and support members 130 are fully retracted. Support members 130 are retracted before trailing edge 32 of tray 26A reaches the downstream end of track 14B and will remain fully retracted until leading edge 60 of the next tray 26B in sequence clears the downstream end of track 148, as shown in FIG. 56F. Thus, the length of central portion 136C of each cam 136 along the upstream-downstream axis must be sufficient to maintain support members 130 in a substantially fully retracted position during the time interval beginning just prior to the arrival of trailing edge 32 of tray 26A at the downstream end of track 14B and ending just after the arrival of leading edge 60 of tray 268 at the downstream end of track 14B. The packing cycle can then begin anew, as shown in FIG. 56A, with respect to the next container group 16B in sequence.

One skilled in the art will appreciate that means other than the cam and push rod follower device described above can be used to impart reciprocating motion to the support members. For example, a rotary cam mechanism can also be used to impart the reciprocating motion.

The use of reciprocating support members in lieu of a pivoting ramp member increases the speed of operation of the system by closing up the gaps between successive groups of containers. Because the support members do not have to be returned to a horizontal position, as does the ramp member described above, the next group of containers in succession can be positioned on the respective support members while the support members are being moved from their retracted positions to their fully extended positions. By speeding up the packing operation, the length of the inclined track can also be reduced, which allows the trays to be returned to their stable horizontal positions substantially sooner. Another advantage of using the reciprocating support members is that the support members are retracted out of the way of the trailing edge of the oncoming tray substantially simultaneously with the packing of the last row of containers in the corresponding group, so that the tray can be returned to a substantially horizontal position substantially simultaneously, which allows the use of a substantially vertical-walled container instead of a container in which the walls have a predetermined draft angle. Therefore, substantially the same internal storage space can be provided with a smaller exterior-sized tray when a vertical-walled tray is used.

Figure 61:
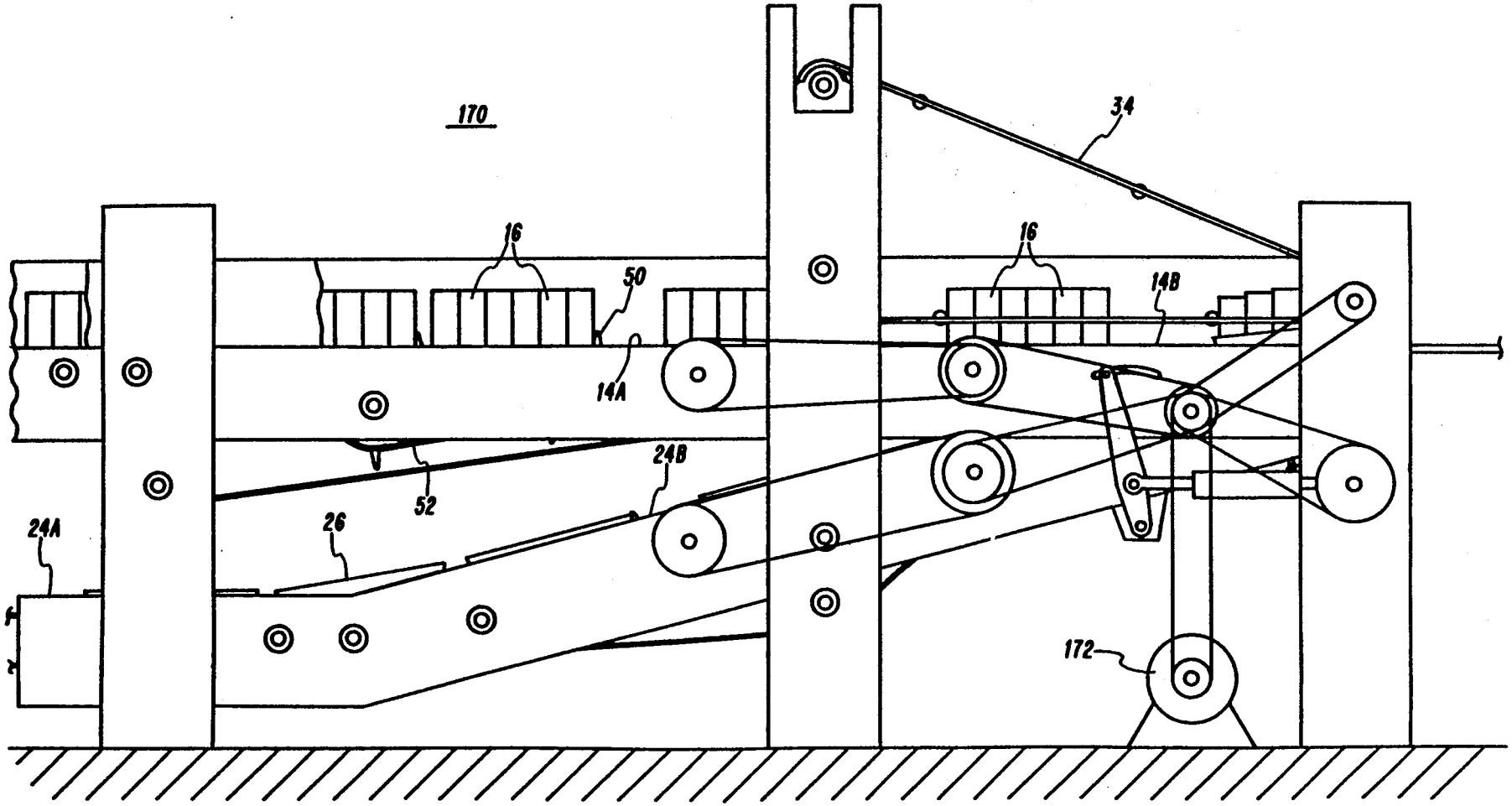
FIGS. 61 and 62 are side elevation views of an alternate embodiment of the tray packing system according to the present invention.
Figure 62:
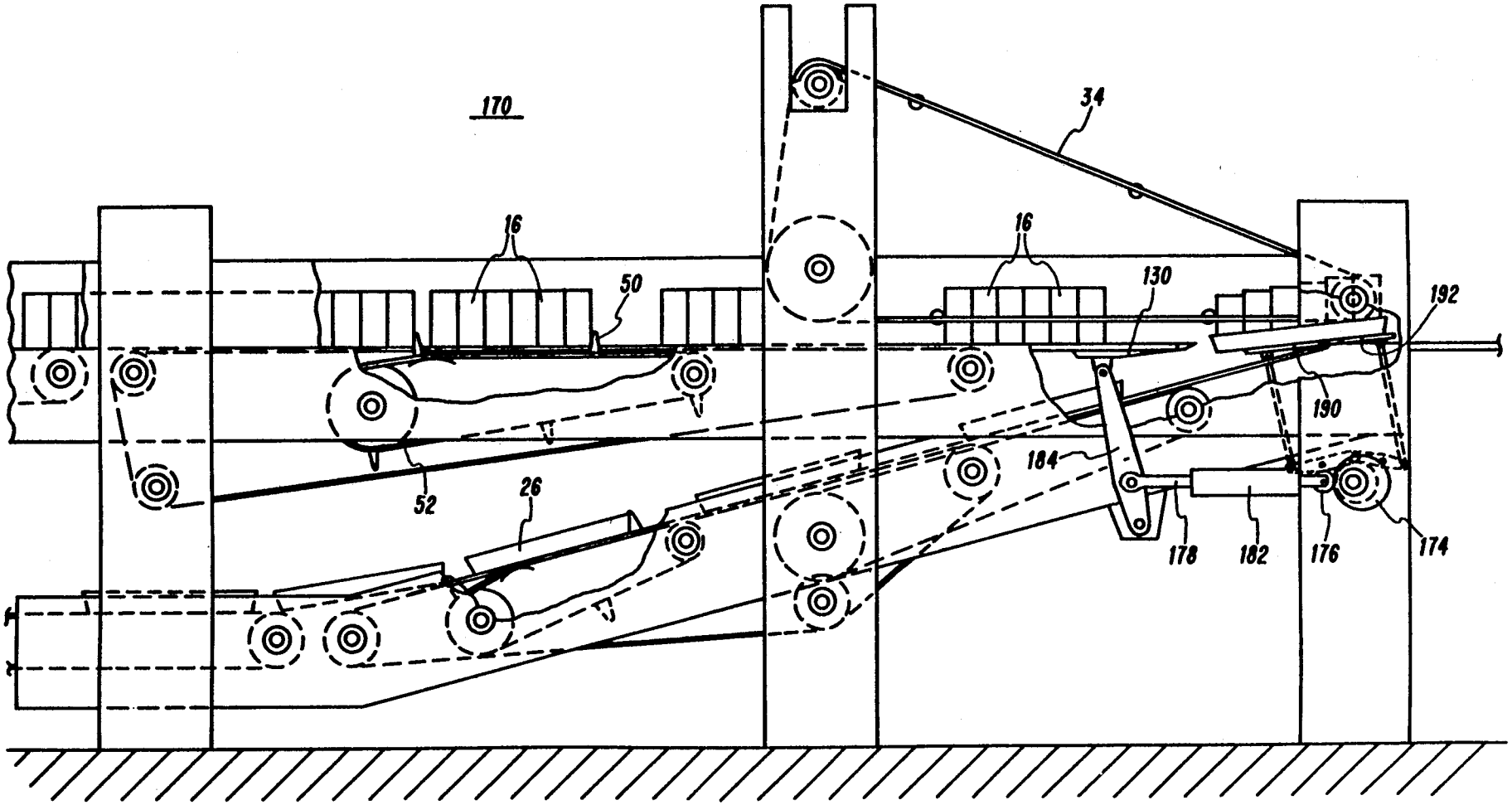

Referring to FIGS. 61–65, an alternate embodiment of tray packing system according to the present invention is depicted. Referring specifically to FIGS. 61 AND 62, tray packing system 170 is substantially the same as tray packing system 12, described above with reference to FIGS. 42 and 43, except that dividers 50 engage containers 16 from below rather than from above and the various chain members and conveyor tracks are synchronously driven by a single drive motor 172 instead of by separate drive mechanisms. By operating the various conveyor tracks and chain drives synchronously, certain ones of photoeyes 102- 118 and microswitch 120 can be eliminated to simplify the control system. Photoeyes 102, 104, 106 and 108 are used during the System Start Up to properly position dividers 50 to engage containers 16 on movable track 14A and photoeyes 116 and 118 are used to detect a downstream blockage on third conveyor track 66, as previously described. However, photoeyes 110, 112 and 114, and microswitch 120, which were used in packing system 12 described above to control the operation of second and third chain members 34 and 36 and second conveyor track 24, are not required in packing system 170.

Reciprocally movable support members 130 are disposed at the downstream end of stationary track 14B, adjacent to the confluence of inclined track 24B with stationary track 14B, as described in detail above with reference to FIGS. 56–60. However, in tray packing system 170 reciprocal motion is not imparted to support members 130 by means of a plurality of cams 136 and a push rod follower mechanism 140, as described above with reference to FIGS. 57–60. Instead, a rotary cam mechanism is used to impart reciprocal motion to support members 130 as best seen in FIGS. 63 and 64.

Figure 63:
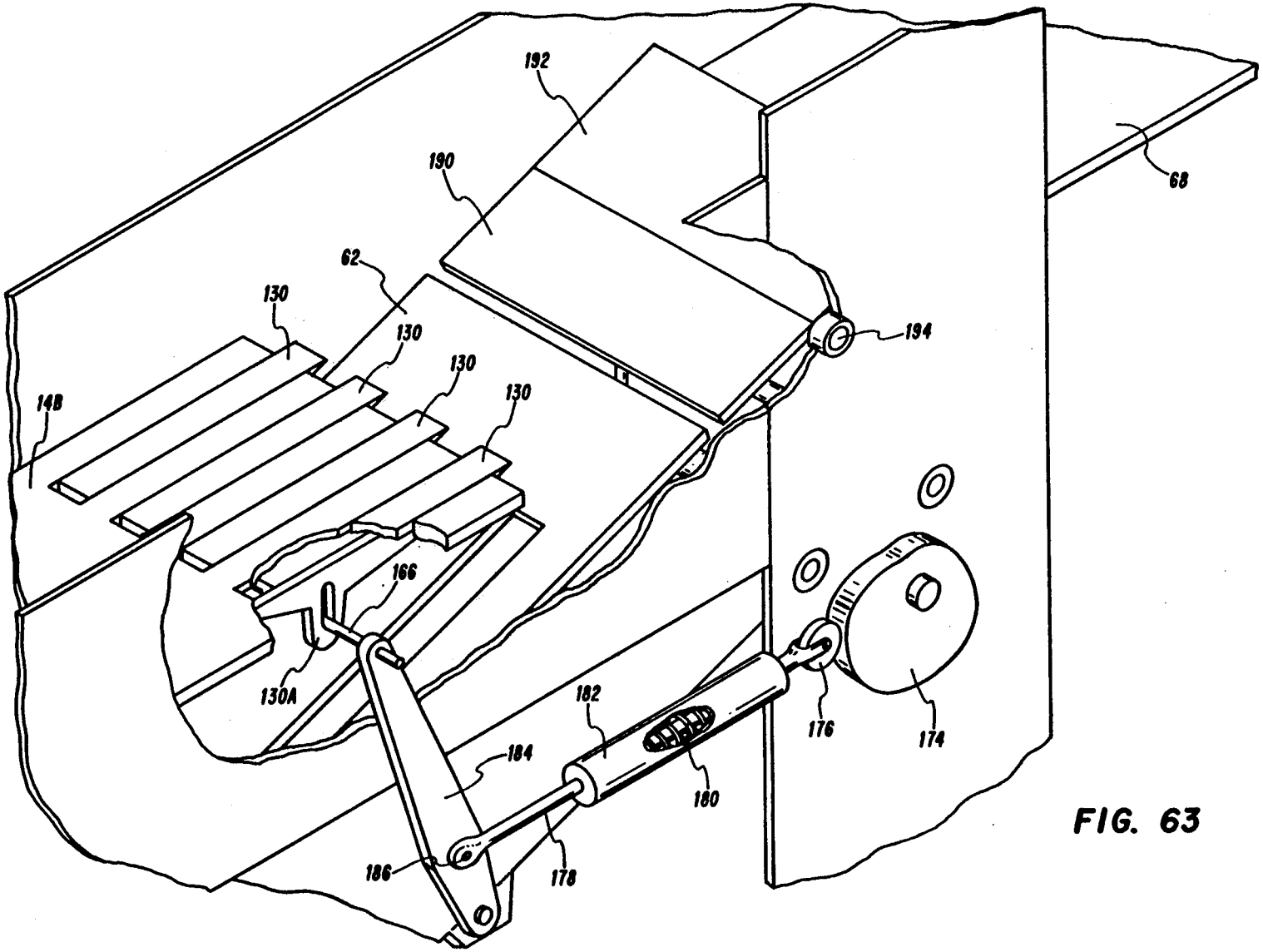
FIGS. 63 and 64 are partial cutaway perspective views of a portion of a tray packing system depicted in FIGS. 61 and 62.
Figure 64:
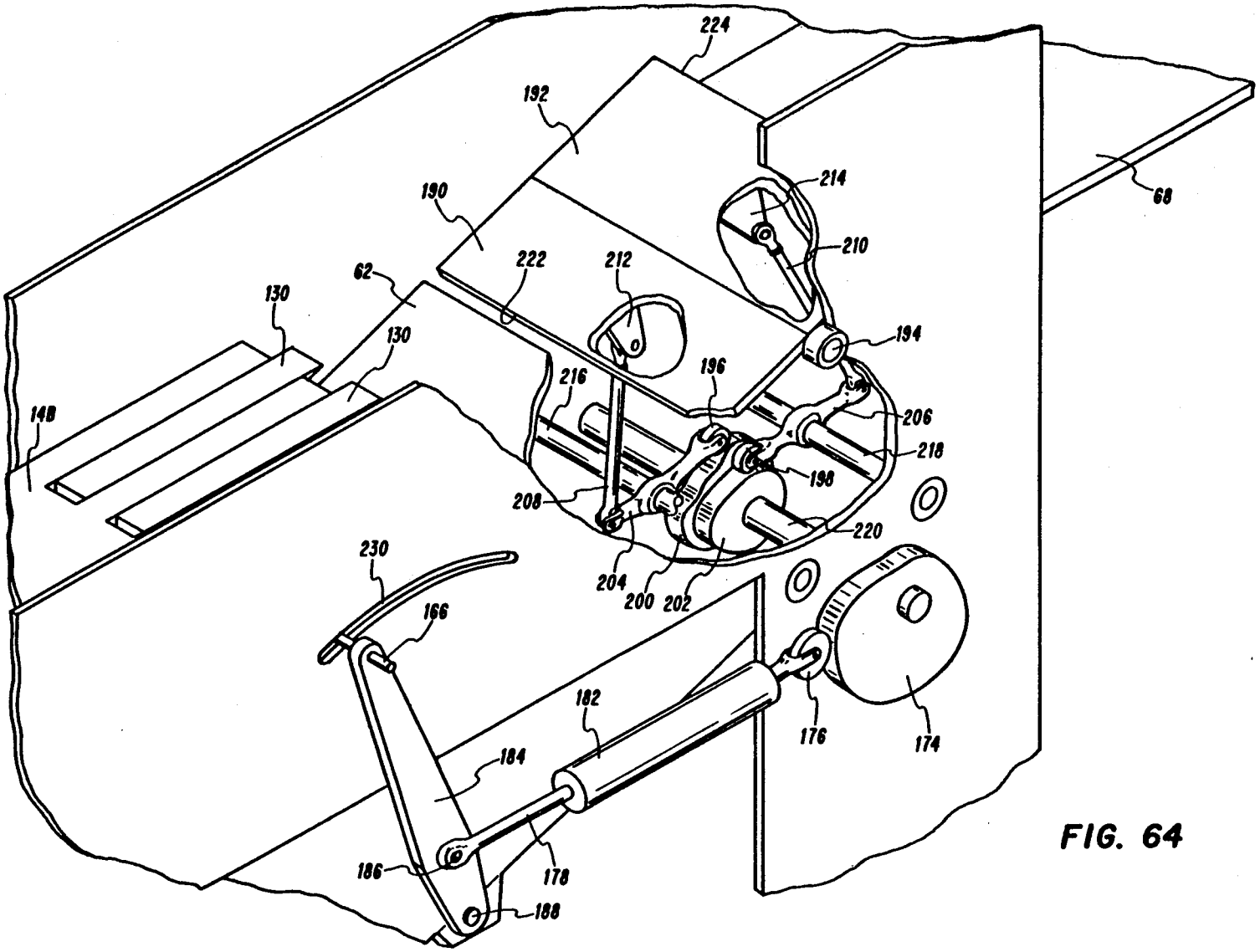

Referring to FIGS. 63 and 64, the rotary cam mechanism is comprised of an eccentric cam 174 and push rod follower mechanism. Push rod follower mechanism includes a cam follower 176 for engaging cam 174, an elongated shaft 178 on which spring member 180 is mounted, a guide 182 for constraining shaft 178 to move in a substantially horizontal direction and a pivot arm 184. Shaft 178 is attached to pivot arm 184 at 186 and pivot arm 184 is pivotable in either direction about pivot point 188. Pivot arm 184 has an opening at one end thereof opposite from pivot point 188 for engaging connecting rod 166, which is attached to the respective tongue portions 130A of support members 130, so that the rotary motion of pivot arm 184 is translated into reciprocating motion imparted to support members 130. Connecting rod 166 is constrained to move within curved slot 230. A second rotary cam mechanism as described above is positioned on the opposite side of track 14B to balance the reciprocating force applied to support members 130.

Cam 174 is also driven by motor 172. As cam 174 rotates in a clockwise direction (as viewed in FIGS. 63 and 64) the eccentric portion of cam 174 will move shaft 178 in an upstream direction, thereby pivoting arm 184 counterclockwise (as viewed in FIGS. 63 and 64) and retracting support members !30. On the other hand, when cam follower 176 is in contact with the non-eccentric or "base circle" portion of cam 174, the spring bias of spring member 180 will return support members 130 to their fully extended positions.

Stationary inclined track 62 includes first and second flap members 190 and 192, which are pivotally attached to a common shaft 194. First and second flap members 190 and 192 are independently pivoted on shaft 194 by respective first and second rocker arm assemblies. The first and second rocker arm assemblies include respective cam followers 196 and 198, which contact respective eccentric cams 200 and 202, respective pivot arms 204 and 206 and respective connecting rods 208 and 210, which are coupled to respective tongue members 212 and 214 attached to the undersides of respective first and second flap members 190 and 192. Pivot arms 204 and 206 are mounted for being pivoted around respective fixed shafts 216 and 218.

Eccentric cams 200 and 202 are mounted on a common shaft 220 with eccentric cam 174. Shaft 220 is rotated by drive motor 172 to impart rotational motion to cams 174, 200 and 202 in a clockwise direction as viewed from the perspective of FIGS. 63 and 64.

Cam 200 is shaped so that cam follower 196 is in contact with the eccentric portion of the cam for all but approximately 30 degrees of each rotation of cam 200. When cam follower 196 is in contact with the eccentric portion of cam 200, the corresponding pivot arm 204 pivots counterclockwise to maintain the upstream edge 222 of first flap member 190 tilted downward, so that first flap member 190 is inclined upwardly in the downstream direction. On the other hand, when cam follower 196 is in contact with the non-eccentric portion of cam 200, pivot arm 204 rotates clockwise to move first flap member 190 upwardly to an approximate horizontal position.

Cam 202 is shaped so that cam follower 198 is in contact with the non-eccentric portion of cam 202 for all but approximately 60 degrees of each rotation of cam 202. When cam follower 198 is in contact with the non-eccentric portion of cam 202, the corresponding pivot arm 206 is pivoted counterclockwise to tilt downstream edge 224 of second flap member 192 upwardly, such that second flap member 192 is inclined upwardly in the downstream direction. On the other hand, when cam follower 198 is in contact with the eccentric portion of cam 202, pivot arm 206 is rotated clockwise to move second flap member 192 downwardly to an approximate horizontal position.

Figure 65A:
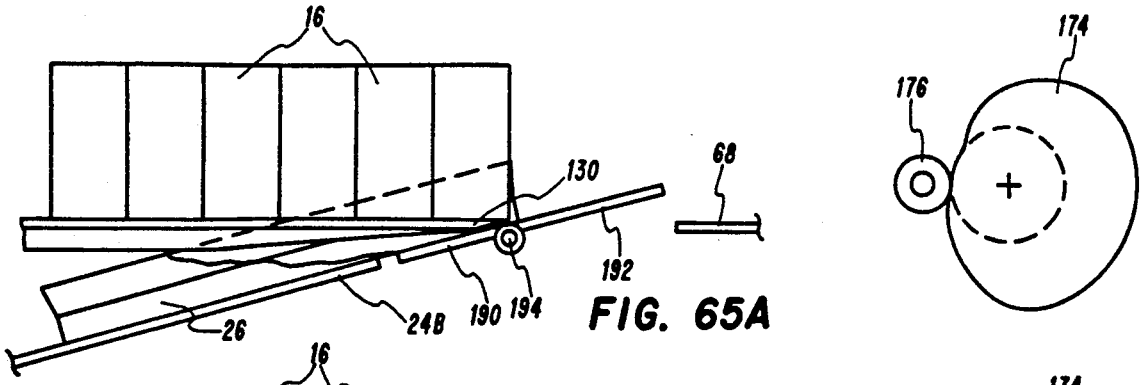
FIGS. 65A-65J illustrate the sequence of steps in the packing operation in the alternate embodiment of the tray packing system.

Referring to FIGS. 65A–65J, the tray packing sequence is depicted in detail. In FIG. 65A, cam follower 176 is in contact with the non-eccentric portion of cam 174 so that support members 130 are spring-biased to their fully extended positions and the leading row of containers 16 is at the downstream edges of support members 130. First and second flap members 190 and 192 are aligned with inclined track 24B and a tray 26 is in position for receiving a group of containers 16.

Figure 65B:
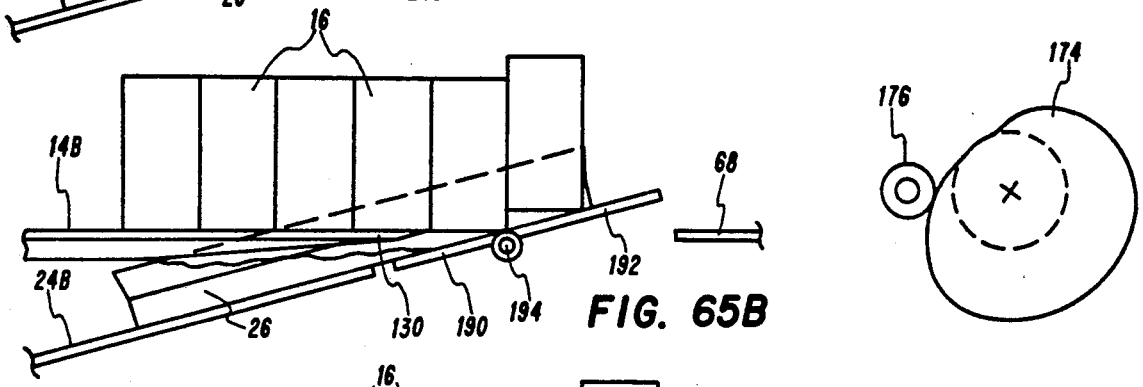
Figure 65C:
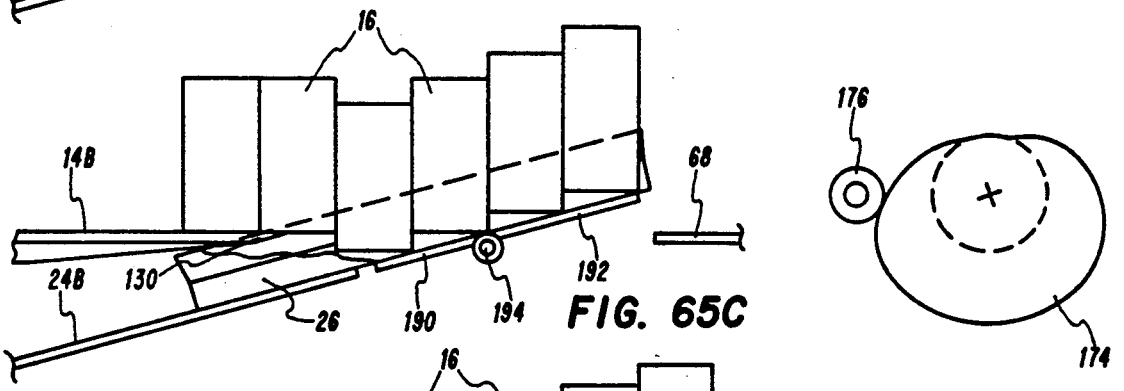
Figure 65D:
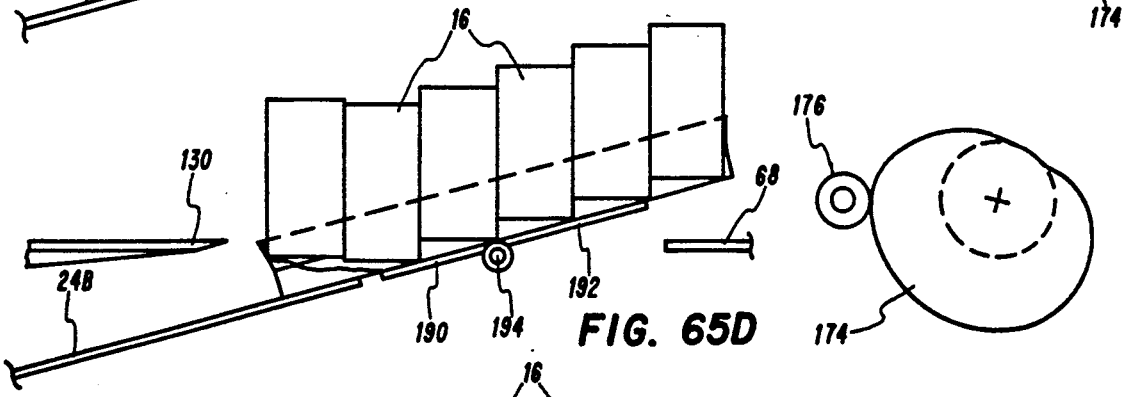

As cam 174 continues to rotate clockwise, as viewed from the perspective of FIGS. 65A–65J, cam follower 176 will come into contact with the eccentric portion of cam 174, as depicted in FIGS. 65B–65D. Support members 130 will be retracted from their fully extended positions, allowing each row of containers 16 to move off support members 130 and into tray 26 in sequence from the leading row to the trailing row of containers 16. Tray 26 is maintained in an inclined position during the packing operation.

Figure 65E:
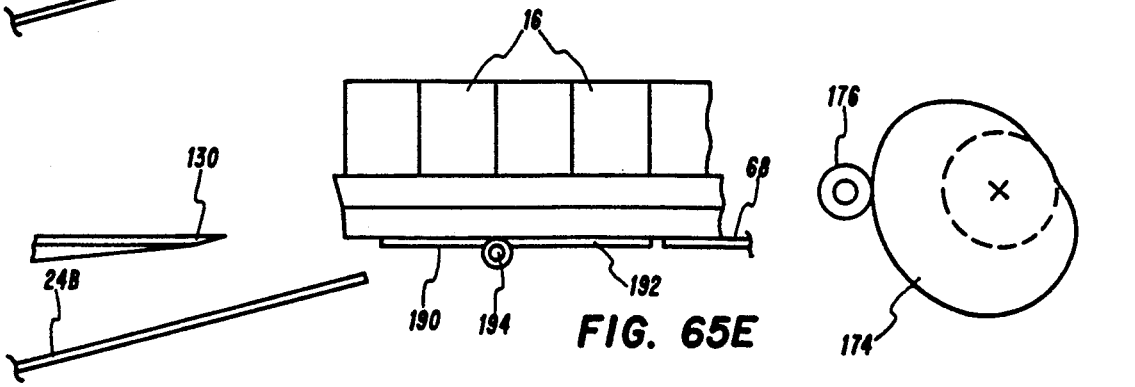
Figure 65F:
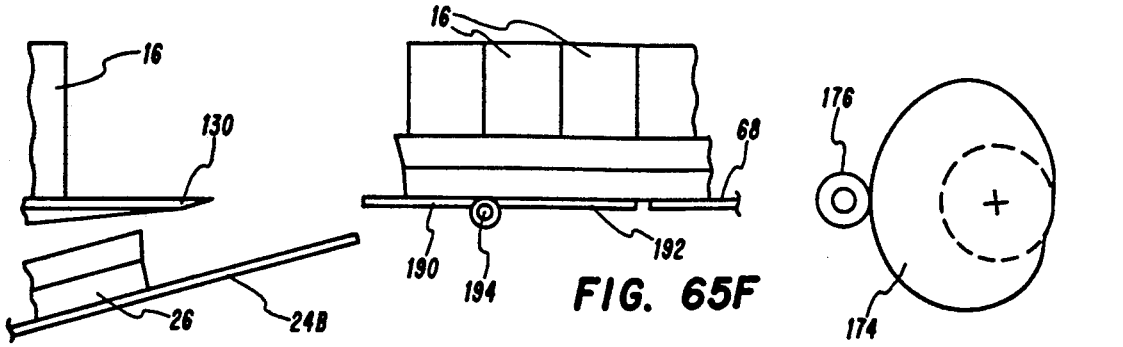

When all containers 16 in that particular group have been packed into the corresponding tray 26, the packed container 26 is moved to a horizontal position by tilting first flap member 190 upwardly and second flap member 192 downwardly, as shown in FIG. 65E. Referring again to FIG. 64, the respective positions of cams 174, 200 and 202 correspond to the position in the packing sequence depicted in FIG. 65D. When support members 130 have just reached their fully retracted positions, cam follower 196 is about to come in contact with the non-eccentric portion of cam 200 and cam follower 198 is about to come in contact with the eccentric portion of cam 202. As cams 174, 200 and 202 continue to rotate, first flap member 190 will be tilted upward and second flap member 192 will be tilted downward to move both flap members 190 and 192 to a substantially horizontal position, as depicted in FIG. 65E. Moving flap members 190 and 192 to a substantially horizontal position also moves packed tray 26 to a substantially horizontal position, thereby facilitating the transition of packed tray 26 to third conveyor track 66.

Figure 65G:
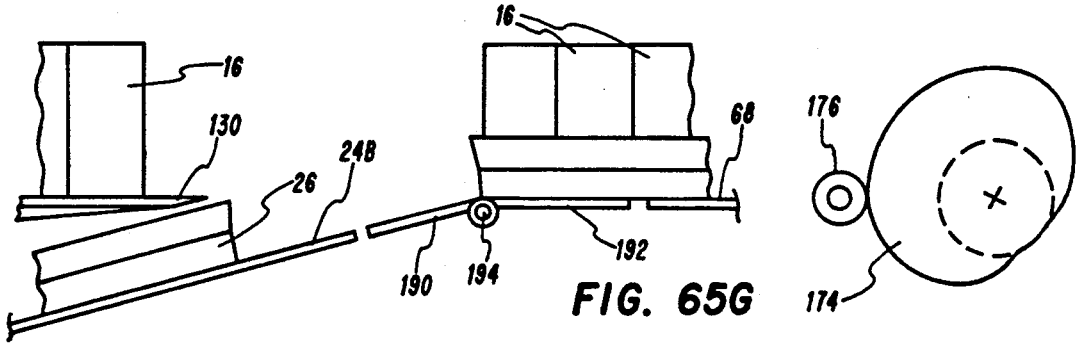

Referring to FIG. 65G, cam follower 196 will again contact the eccentric portion of cam 200 as trailing edge 32 of packed tray 26 passes by shaft 194 in the downstream direction. At this juncture, first flap member 190 will be tilted downward in anticipation of the arrival of the next tray 26 in sequence. Second flap member 192 will remain horizontal until trailing edge 32 of packed tray 26 has passed downstream edge 224 of second flap member 192.

Figure 65H:
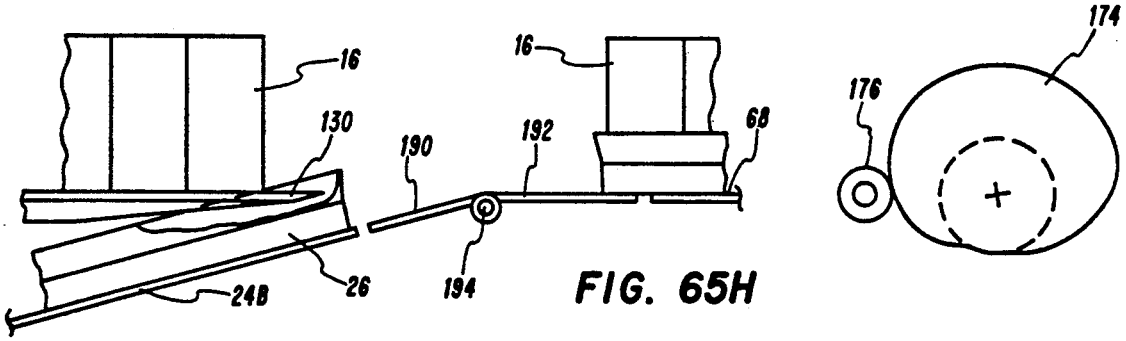
Figure 65I:
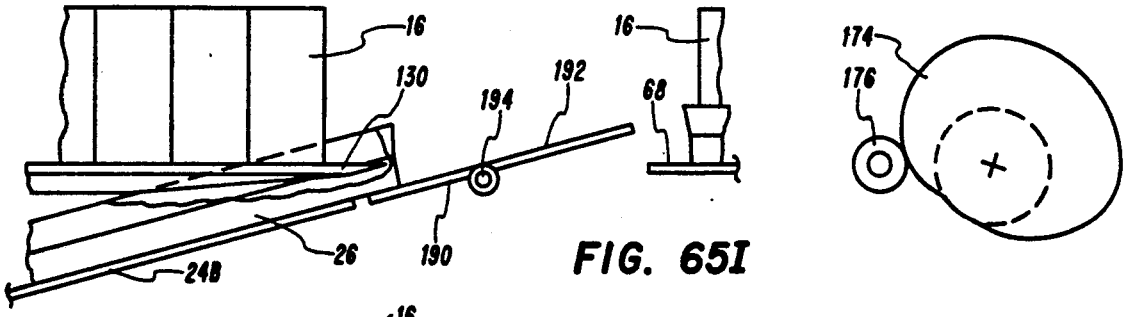
Figure 65J:
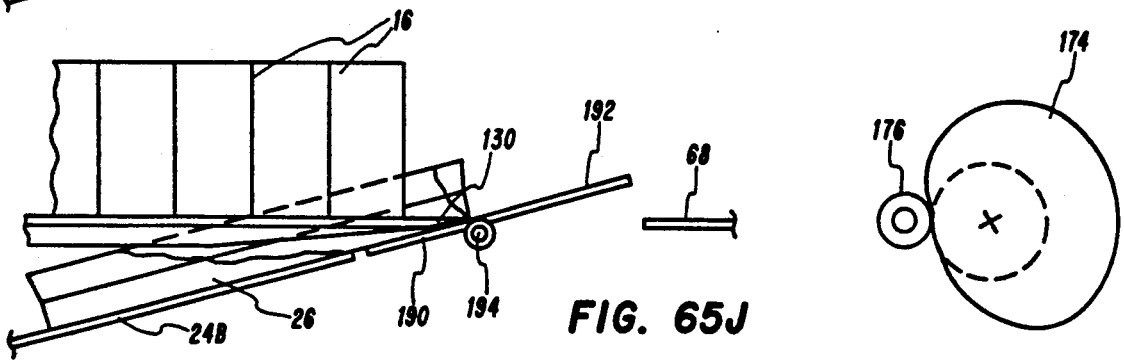

As cam 174 continues to rotate, the spring bias exerted by spring member 180 will begin to move support members 130 from their fully retracted positions outwardly, as shown in FIGS. 65H–65J. When cam follower 198 comes into contact with the non-eccentric portion of can 202, second flap member 192 will be tilted upwardly again, as shown in FIG. 651. In FIG. 65J, cam follower 176 is in contact with the non-eccentric portion of cam 174, so that support members 130 are fully extended, and the downstream edges of support members 126 are in contact with the bottom of tray 126 adjacent to the inside surface of leading edge 60 of tray 26. The packing cycle described above then begins anew for the next tray 26 in sequence.

The system and method according to the present invention is suitable for use in connection with returnable or non-returnable low depth trays, such as those described above with reference to FIGS. 1–41, and is able to pack containers either in pre-formed six-packs, eight-packs and twelve-packs or in a loose state into transport trays in a continuous motion without having to unnecessarily slow down or interrupt the movement of the containers and trays. The system and method of the present invention further provide substantial cost savings by providing a tray packed which is able to pack 70–80 cases per minute using a simpler, less expensive technique. The approximate cost of the automated system according to the present invention is on the order of $40,000–$70,000. The fact that the system can be used in conjunction with certain returnable trays offers an additional substantial cost advantage over prior art systems, such as the tray former loader, which require new trays to be used during each operation. The automated system according to the present invention also has substantial advantages over such prior art systems as the vertical drop packer and the ski packer by providing substantially faster operation and tray packing speeds without unnecessary slowdowns or interruptions in operation.

Various embodiments of the invention have now been described in detail. Since it is obvious that changes in and modifications to the above-described preferred embodiment may be made without departing from the nature, spirit and scope of the present invention, the invention is not to be limited to said details, except as set forth in the appended claims.

What is claimed:

1. A tray for storing a plurality of substantially cylindrically-shaped articles, each of said articles having a substantially circular lateral cross-section, said tray comprising a bottom member and four walls interconnected to provide an enclosure for receiving said articles, each of said four walls having cooperating pairs of structural members extending inwardly therefrom to define respective recessed regions therebetween, each of said cooperating pairs for contacting a corresponding one of the said articles at respective positions on the curved surfaces thereof, a predetermined portions of each article being received within a corresponding recessed region and at least a portion of the curved surface of the article being in contact with the corresponding wall within the corresponding recessed region, thereby retaining the articles in a substantially upright position within the tray.

2. The tray according to claim 1 wherein at least a portion of each of said walls is angled outwardly on both interior and exterior surfaces thereof, with respect to a vertical axis which is perpendicular to said bottom member, so that the walls of the tray have a predetermined draft angle to allow the bottom member and substantial portions of the walls of a first tray to be received within the enclosure of a second tray, whereby a plurality of trays can be nested together.

3. The tray according to claim 1 wherein each of said four walls is comprised of a plurality of recessed regions separated by corresponding ones of a plurality of inwardly extending surfaces to provide a substantially scalloped appearance, the wall surface within each region being curved to conform to the curved surface of the corresponding article so that substantially the entire curved surface of the portion of the article which is disposed within the corresponding recessed region is in contact with the wall surface within each region.

4. The tray according to claim 3 wherein the bottom member has a plurality of receptacles disposed therein, each of said receptacles for receiving a predetermined lower portion of a corresponding one of said articles when said articles are disposed within said tray in an upright position.

5. The tray according to claim 4 wherein each of said receptacles has a substantially circular shape to conform to the cylindrical shape of said articles, the portion of said bottom member surrounding each of said receptacles being beveled to substantially conform to the chine portion of the corresponding article received within the receptacle.

6. The tray according to claim 1 wherein said tray has a substantially rectangular shape and said four walls are comprised of a pair of oppositely positioned first and second side walls extending longitudinally along said tray and a pair of oppositely positioned first and second end walls extending transversely across said tray, each of said first and second end walls being comprised of a plurality of first recessed regions separated by corresponding ones of a plurality of inwardly extending surfaces to provide a substantially scalloped appearance on said end walls, the end wall surface within each region being curved to conform to the curved surface of the corresponding article so that substantially the entire curved surface of the portion of the article which is disposed within the recessed region is in contact with the end wall surface within each region, said first and second side walls having respective first and second sets of rib members extending vertically along at least a portion of the height of the respective side walls and partially inwardly along said bottom member, selected ones of said first and second sets of rib members being arranged in cooperating pairs to define respective second recessed regions therebetween.

7. The tray according to claim 6 wherein said bottom member has a plurality of receptacles disposed therein, each of said receptacles for receiving a predetermined lower portion of a corresponding one of said articles when said articles are disposed within said tray in an upright position.

8. The tray according to claim 7 wherein each of said receptacles has a substantially circular shape to conform to the cylindrical shape of said articles, a portion of said bottom member surrounding each of said receptacles being beveled to substantially conform to the shape of the chine portion of the corresponding article received within the receptacle, the rib members in each cooperating pair diverging away from one another along the bottom member so that at least a portion of the corresponding receptacle is received within the corresponding second recessed region defined by each cooperating pair of rib members, the rib members in each cooperating pair converging toward the respective adjacent rib members on opposite sides of the corresponding recessed region so that the rib members in each cooperating pair intersect with respective adjacent rib members substantially between respective adjacent receptacles.

9. The tray according to claim 1 wherein said tray has a substantially rectangular shape and said four walls are comprised of a pair of oppositely positioned first and second side walls extending longitudinally along said tray and a pair of oppositely positioned first and second end walls extending transversely across said tray and said structural members are comprised of a first set of rib members extending vertically at least partially along the height of said first side wall, transversely across said bottom member and vertically at least partially along the height of the second side wall, and second and third sets of rib members extending vertically at least partially along the heights of the respective first and second end walls and partially inwardly along said bottom member and terminating at respective intersections on said bottom member with respective ones of said first set of rib members which are closest to the respective first and second end walls.

10. The tray according to claim 9 wherein said first, second and third sets of rib members are arranged in respective cooperating pairs at predetermined locations on said tray, each of said cooperating pairs defining a corresponding one of said recessed regions therebetween, the spacing between the rib members in each cooperating pair being sufficient to allow the curved surface of the corresponding article which is received within the corresponding recessed region to contact the corresponding pair of rib members at respective first and second points of tangency and to contact the corresponding wall of the tray within the corresponding recessed region at a third point of tangency.

11. The tray according to claim 9 wherein said first, second and third rib members are disposed on respective inner surfaces of said tray and define corresponding grooves in respective outer surfaces thereof 12. The tray according to claim 9 wherein said first, second and third rib members are disposed on respective inner surfaces of said tray and the respective outer surfaces of said tray are substantially smooth to enhance the structural integrity thereof

13. The tray according to claim 1 wherein said tray has a substantially rectangular shape and said four walls are comprised of a pair of oppositely positioned first and second side walls extending longitudinally along said tray and a pair of oppositely positioned first and second end walls extending transversely across said tray and said structural members are comprised of a first set of rib members extending vertically at least partially along the height of the first end wall, longitudinally along said bottom member and vertically at least partially along the height of the second end wall, and second and third sets of rib members extending vertically at least partially along the heights of the respective first and second side walls and partially inwardly across said bottom member and terminating at respective intersections on said bottom member with respective ones of said first set of rib members which are closest to the respective first and second side walls.

14. The tray according to claim 13 wherein said first, second and third sets of rib members are arranged in respective cooperating pairs at predetermined locations on said tray, each of said cooperating pairs of rib members defining a corresponding one of said recessed regions therebetween, the spacing between rib members in each cooperating pair being sufficient to allow the curved surface of the corresponding article which is received within the corresponding recessed region to contact the corresponding cooperating pair of rib members at respective first and second points of tangency and to contact the corresponding wall of the tray within the corresponding recessed region at a third point of tangency.

15. The tray according to claim 13 wherein said first, second and third rib members are disposed on respective inner surfaces of said tray and define corresponding grooves in respective outer surfaces thereof.

16. The tray according to claim 13 wherein said first, second and third rib members are disposed on respective inner surfaces of said tray and the respective outer surfaces of said tray are substantially smooth to enhance the structural integrity thereof.

17. The tray according to claim 1 further including a rim member extending inwardly from each of said walls around the perimeter of said tray.

18. The tray according to claim 1 wherein said tray has a substantially rectangular shape and said four walls are comprised of a pair of oppositely positioned first and second side walls extending longitudinally along said tray and a pair of oppositely positioned first and second end walls extending transversely across said tray and said structural members are comprised of first and second sets or rib members extending vertically at least partially along the heights of the respective first and second side walls and partially inwardly across said bottom member on respective inner surfaces thereof and third and fourth sets of rib members extending vertically at least partially along the heights of the respective first and second end walls and partially inwardly along said bottom member on respective inner surfaces thereof, selected ones of said first and second sets of rib members being arranged in respective cooperating pairs to define a plurality of first recessed regions therebetween and selected ones of said third and fourth sets of rib members being arranged in respective cooperating pairs to define a plurality of second recessed regions therebetween, said bottom member having a plurality of receptacles disposed thereon for receiving predetermined lower portions of corresponding ones of said articles when said articles are disposed within said tray in a substantially upright position.

19. The tray according to claim 18 wherein each of said receptacles has a substantially circular shape to conform to the cylindrical shape of said articles, a portion of said bottom member surrounding each of said receptacles being beveled to substantially conform to the chine portion of the corresponding articles received within the receptacle.

20. The tray according to claim 19 wherein the rib members in each cooperating pair diverge away from one another along the bottom member so that at least a portion of the corresponding receptacle is received within the corresponding recessed region defined by each cooperating pair of rib members, the rib members in each cooperating pair converging toward adjacent rib members on opposite sides of the corresponding recessed region so that the rib members in each cooperating pair intersect with respective adjacent rib members substantially between respective adjacent receptacles.

21. The tray according to claim 1 wherein said structural members are comprised of a plurality of rib members extending at least partially along the height of each of the four walls of the tray, selected ones of said rib members being arranged in respective cooperating pairs to define said recessed regions therebetween, said tray further including a plurality of posts disposed between each of said cooperating pairs of rib members on each of said four walls, said posts extending upwardly from said bottom member to a predetermined position on the corresponding walls for engaging the bottom member of another tray when multiple trays are being nested to prevent said other tray from penetrating into said enclosure beyond said predetermined position.

22. The tray according to claim 21 further including a rim member which extends outwardly and curves downwardly from each of said walls around the perimeter of said tray.

23. The tray according to claim 21 wherein said rib members have a substantially half-conical shape and extend substantially along the entire height of the corresponding walls, the width of each rib member decreasing upwardly along the corresponding wall so that the width of each rib member is greatest adjacent to the bottom member and smallest adjacent to an upper edge of the corresponding wall.

24. The tray according to claim 21 wherein each of said walls is comprised of a first portion extending from said bottom member to a first selected position on the corresponding wall, a second portion extending from the first selected position to a second selected position on the corresponding wall and a third portion extending from said second selected position to an upper edge of the corresponding wall, said first portion being angled outwardly with respect to a vertical axis which is perpendicular to said bottom member to provide a first predetermined draft angle, said second portion being angled outwardly with respect to said vertical axis at a second predetermined draft angle which is less than said first predetermined draft angle and said third portion being angled outwardly with respect to said vertical axis at said first predetermined draft angle, to facilitate separation of adjacent ones of said trays and to allow a plurality of said trays to be nested together, each of said rib members defining first, second and third half-conical shapes on the respective first, second and third portions of the corresponding wall.

25. The tray according to claim 24 wherein said predetermined position to which said posts extend on the corresponding walls corresponds to said second selected position.

26. The tray according to claim 25 wherein said rib members and said posts are disposed on respective inner surfaces of the corresponding walls, said tray further including a plurality of stiffeners disposed on respective outer surfaces of the corresponding walls, said stiffeners extending from respective upper edges of the corresponding walls to said first selected position thereon to enhance the structural strength and integrity of the tray.

27. The tray according to claim 21 wherein said bottom member is comprised of a plurality of elongated support members arranged to define a predetermined grid pattern, portions of said support members defining a substantially circular support base for the substantially circular bottom portion of each of the articles to be stored and transported in the tray.

28. The tray according to claim 27 wherein said bottom member is open between adjacent support members 29. A system for pac king containers into corresponding trays, comprising:

first conveyor means for transporting said containers along a first track;

means for dividing said containers into selected groups, the number of containers in each group corresponding to the number of containers to be packed into each tray;

second conveyor means for transporting said trays along a second track, a portion of said second track being inclined with respect to said first track so that the first and second tracks converge at a predetermined location; and a support member disposed adjacent to said predetermined location for journally supporting said containers as said containers are being packed into the corresponding tray, said support member being reciprocally moveable along an upstream-downstream axis between a first position at which said support member is substantially fully extended for introducing a corresponding group of containers into the corresponding tray and a second position at which said support member is substantially fully retracted for allowing the trailing edge of the corresponding tray to clear said support member as said tray is moved along the inclined portion of the second track after all of the containers in the corresponding group have been packed into the tray.

30. The system according to claim 29 further including means for selectively moving said support member between said first and second positions, said moving means being comprised of cam means which is moveable along said first track and stationary spring-loaded push rod follower means coupled to said support member for engaging said cam means as said cam means is moved along said first track, said cam means for exerting downward pressure on said push rod follower means to move said support member to said second position when said cam means is in engagement with said push rod follower means, said push rod follower means for being moved upwardly by spring-bias when said push rod follower means is not in engagement with said cam means, to move said support member to said first position.

31. The system according to claim 30 wherein said push rod follower means is comprised of a spring-loaded push rod follower, the major axis of which is oriented substantially orthogonal with respect to the major surface of said first track so that said push rod follower is moveable along its major axis, and linkage means coupled between said push rod follower and said support member for translating the axial motion of said push rod follower into corresponding reciprocating motion of said support member along the upstream-downstream axis of the first track.

32. The system according to the claim 31 wherein said cam means is comprised of a plurality of cams disposed at predetermined positions on said first conveyor means so that one of said cams comes into engagement with said push rod follower means while a corresponding group of containers is being packed into the corresponding tray, to begin moving said support member from said first position to said second position.

33. The system according to claim 32 wherein each of said cams has a length along the upstream-downstream axis which is sufficient to engage the push rod follower means to maintain the support member in the second position during the time period beginning just prior to the arrival of the trailing edge of the corresponding tray at said predetermined location and ending just after the arrival of the leading edge of the next tray in sequence at said predetermined location.

34. The system according to claim 29 wherein said system includes a plurality of support members, each support member being comprised of a relatively flat elongated member, said first track including a corresponding plurality of complementary elongated openings therein for receiving respective ones of said support members when said support members are moved from said first position to said second position, each of said support members for journally supporting a corresponding column of containers, in which the individual containers are arranged along the upstream-downstream axis, when a group of containers is being journally supported by the support members.

35. The system according to claim 34 wherein each of said support members includes an extension portion for engaging a corresponding facing surface of the first track for preventing the corresponding support member from being moved along an axis which is normal with respect to the major surface of the first track.

36. The system according to claim 29 further including means for controlling the movements of the containers on the first track and the trays on the second track so that each group of containers is packed into corresponding trays in succession from the leading edge to the trailing edge of the tray while the tray is being moved upwardly along the inclined portion of the second track, said control means being comprised of:

first detector means for generating a first electrical signal when a container is present at a first selected position on said first track substantially upstream from said support member;

second detector means for generating a second electrical signal when a container is present at a selected position on said support member;

third detector means for generating a third electrical signal when a tray is at a selected position on said second track in proximity to said support member;

fourth detector means for generating a fourth electrical signal when said support member is in the first position;

means for activating said first conveyor means to transport containers on the first track in response to the presence of said first electrical signal and for deactivating said first conveyor means in response to the absence of said first and third electrical signals; and means for activating said second conveyor means to transport trays on said second track in response to either the absence of said third electrical signal when the first conveyor means is deactivated or the presence of said second electrical signal when said first conveyor means is activated and for deactivating said second conveyor means in response to either said third electrical signal when said first conveyor means is deactivated or to the presence of said third and fourth electrical signals in the absence of said second electrical signal when the first conveyor means is activated.

37. The system according to claim 36 wherein said first track is comprised of a moveable portion and a stationary portion downstream of said moveable portion and said first conveyor means includes first, second and third sprocket-driven chain means arranged to form respective first, second and third continuous vertical loops, a portion of said first chain means defining said moveable portion of said first track and said second and third chain means for moving said groups of containers along said stationary portion of said first track.

38. The system according to claim 37 wherein said dividing means includes fourth and fifth sprocket-driven chain means and said system further includes first drive means for driving said first chain means, second drive means for driving said second conveyor track, third drive means for driving said second and third chain means and fourth drive means for driving said fourth and fifth chain means.

39. The system according to claim 38 wherein said control means further includes fifth detector means for generating a fifth electrical signal when said dividing means is properly positioned with respect to said containers, said fourth drive means being activated in response to the absence of said fifth electrical signal to position said dividing means as desired with respect to said containers and being deactivated in response to the presence of said fifth electrical signal when said first drive means is deactivated.

40. The system according to claim 39 wherein said control means further includes sixth detector means positioned downstream from said first detector means for generating a sixth electrical signal when containers are present between adjacent ones of said dividing means, said first drive means being activated in response to said sixth electrical signal when said fourth drive means is deactivated.

41. The system according to claim 39 wherein said control means further includes seventh detector means positioned downstream from said first detector means in proximity to said support members and upstream thereof, for generating a seventh electrical signal when a container is present at the position of the seventh detector means, said first, second, third and fourth drive means being deactivated in response to said seventh electrical signal when said third electrical signal is not generated.

42. The system according to claim 41 wherein said system further includes third conveyor means for transporting the packed tray to a predetermined destination, said third conveyor means including a third track located downstream of said first and second conveyor tracks, and eighth detector means for detecting the presence of packed trays at selected positions on the third track and for generating an eighth electrical signal when the presence of a packed tray is detected for a predetermined length of time, thereby indicating a blockage downstream on the third track, said first, second, third and fourth drive means being deactivated in response to said eighth electrical signal.

43. The system according to claim 29 further including means for selectively moving said support member between said first and second positions, said moving means being comprised of eccentric cam means which is rotatable about a predetermined axis and spring-loaded push rod follower means coupled to said support member for engaging said cam means as said cam means is rotated, said cam means for exerting a force on said push rod follower means which is directed upstream relative to said first track to move said support member to said second position when said push rod follower means is in engagement with the eccentric portion of the cam means, said push rod follower means for being moved in a downstream direction relative to said first track by spring-bias when said push rod follower means is not in engagement with the eccentric portion of the cam means, to move said support member to said first position.

44. The system according to claim 43 wherein said push rod follower means is comprised of a spring-loaded push rod follower, the major axis of which is oriented substantially parallel with respect to major surface of said first track so that said push rod follower is moveable along its major axis, a cam follower disposed at a first end of said push rod follower for engaging said cam means and linkage means coupled to a second end of said push rod follower, which is opposite from said first end, and to said support member for translating the axial motion of said push rod follower to reciprocating motion of said support member along the upstream-downstream axis of the first track.

45. The system according to claim 44 wherein said linkage means is comprised of a pivot arm, one end of which is pivotally attached to a portion of said first track and the other end of which is coupled to said support member, the second end of the push rod follower being coupled to the pivot arm between the opposite ends of said pivot arm for rotating said pivot arm in a first direction for retracting said support member when the push rod follower is moved upstream relative to said first track and for rotating said pivot arm in a second direction opposite from said first direction for allowing the spring-bias of said push rod follower to extend said support member when said push rod follower is moved in a downstream direction relative to said first track.

46. The system according to claim 43 further including first and second flap members positioned downstream of said support member and the inclined portion of said second track, said first and second flap members being pivotally attached to a common shaft for being independently moveable between respective third positions at which said flap members are oriented substantially parallel with respect to the inclined portion of the second track and respective fourth positions at which the flap members are oriented substantially parallel with respect to the first track, said flap members being maintained in the respective third positions to maintain each tray at an inclined position while each group of containers is being packed into a corresponding tray and for being disposed in respective fourth positions after each group of containers has been packed into the corresponding tray, to move the packed tray to a substantially horizontal position.

47. The system according to claim 46 wherein said first flap member is located on the upstream side of said common shaft and said second flap member is located on the downstream side of said common shaft with said common shaft defining the intersection between said first and second flap members, said first flap member for being disposed in the third position so that its upstream edge is tilted downwardly with respect to said common shaft when the trailing edge of each packed tray passes the intersection between the first and second flap members in the downstream direction.

48. The system according to claim 46 wherein said cam means is comprised of a first eccentric cam and said push rod follower means includes a first cam follower and said system further includes means for selectively moving said flap members between the respective third and fourth positions, said moving means being comprised of second and third eccentric cams which are rotatable about a predetermined axis in synchronism with the first cam, second and third cam followers which are in engagement with the respective second and third cams and first and second rocker arms coupled between the respective second and third cam followers and the respective first and second flap members for translating the axial motion of said rocker arms into corresponding pivoting motion of said flap members relative to said common shaft.

49. The system according to claim 48 wherein each of said rocker arms includes respective first portions which are pivotable about respective fixed shafts and respective second portions which are moveable along their respective major axes by the rotational motion of the respective first portions, the engagement of said cam follower with the second cam for moving said first flap member to said third position when said second cam follower is in engagement with the eccentric portion of the second cam and for moving said first flap member to said fourth position when said second cam follower is not in engagement with the eccentric portion of the second cam, said second flap member for being moved to said third position when the third cam follower is in contact with the non-eccentric portion of the third cam and for being moved to said fourth position when the third cam follower is in contact with the eccentric portion of the third cam.

50. The system according to claim 43 wherein said first and second conveyor means and said dividing means are synchronously driven.

51. A system for packing containers into corresponding trays, comprising:

first conveyor means for transporting said containers along a first track;

means for dividing said containers into selected groups, the number of containers in each group corresponding to the number of containers to be packed into each tray;

second conveyor means for transporting said trays along a second track, a portion of said second track being inclined with respect to said first track so that said first and second tracks converge at a predetermined location;

means positioned at the downstream end of said first track for introducing a corresponding group of containers into the corresponding tray; and first and second flap members pivotally mounted on a common shaft downstream of said predetermined location, said first and second flap members being independently moveable between respective first positions at which said flap members are oriented substantially parallel with respect to said inclined portion of said second track and respective second positions at which said flap members are oriented substantially parallel with respect to said first track.

52. The system according to claim 51 wherein said first and second flap members are maintained in their respective first positions while each tray is being packed to maintain the corresponding tray in an inclined position and are disposed in their respective second positions after the corresponding tray has been packed to move the packed tray to a substantially horizontal position for transport downstream.

53. The system according to claim 52 wherein said first flap member is moved from said second position to said first position when the trailing edge of the corresponding tray passes the common shaft which defines the intersection between the first and second flap members in the downstream direction.

54. A tray for storing a plurality of substantially cylindrically-shaped articles in a substantially upright position, each of said articles having a substantially circular lateral cross-section, said tray having a bottom member and four wall members interconnected to provide an enclosure for receiving said articles, each of said wall members having a plurality of recessed regions separated by corresponding ones of a plurality of inwardly extending surfaces, the wall surface within each region being curved to conform to the curved surface of the corresponding article, at least a portion of each article being disposed within the corresponding recessed region.

55. A tray for storing a plurality of substantially cylindrically-shaped articles in a substantially upright position, each of said articles having a substantially circular lateral cross-section and a chine portion, said tray having a bottom member and four wall members interconnected to provide an enclosure for receiving said articles, said bottom member having a plurality of receptacles, each of said receptacles for receiving a predetermined bottom portion of a corresponding one of said articles when said articles are disposed within said tray in said substantially upright position, a portion of the bottom member surrounding each of said receptacles being beveled to receive the chine portion of the corresponding article.

56. A tray for storing a plurality of substantially cylindrically-shaped articles, each of said articles having a substantially circular lateral cross-section, said tray having a bottom member and four wall members interconnected to provide an enclosure for receiving said articles, at least a portion of each of said wall members being angled outwardly on both interior and exterior surfaces of each of said wall members with respect to a vertical axis which is perpendicular to said bottom member, so that the wall members have a predetermined draft angle to allow the bottom member and substantial portions of the wall members of a first tray to be received within the enclosure of a second tray, whereby a plurality of trays can be nested together.

57. A tray for storing a plurality of substantially cylindrically-shaped articles in a substantially upright position, each of said articles having a substantially circular lateral cross-section, said tray having a bottom member and four walls interconnected to provide an enclosure for receiving said articles, each of said walls having a plurality of rib members extending inwardly therefrom, selected ones of said rib members being arranged in respective cooperating pairs to define a recessed region between each cooperating pair of rib members, said tray further including at least one support member disposed between each of said cooperating pairs of rib members, each support member extending upwardly from said bottom member to a predetermined position on the corresponding wall for engaging the bottom member of another tray when multiple trays are being nested, to prevent said other tray from preventing into said enclosure beyond said predetermined position.

* * * * *